US008955838B2

(12) United States Patent
Saito et al.

(10) Patent No.: US 8,955,838 B2
(45) Date of Patent: Feb. 17, 2015

(54) SHEET STORAGE APPARATUS AND IMAGE FORMATION SYSTEM USING THE APPARATUS

(71) Applicants: Takehiko Saito, Yamanashi-ken (JP); Satoshi Yamanushi, Yamanashi-ken (JP); Tatsuzo Aoyagi, Yamanashi-ken (JP); Yuichi Ichinose, Yamanashi-ken (JP)

(72) Inventors: Takehiko Saito, Yamanashi-ken (JP); Satoshi Yamanushi, Yamanashi-ken (JP); Tatsuzo Aoyagi, Yamanashi-ken (JP); Yuichi Ichinose, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/051,562

(22) Filed: Oct. 11, 2013

(65) Prior Publication Data

US 2014/0103604 A1 Apr. 17, 2014

(30) Foreign Application Priority Data

| | | |
|---|---|---|
| Oct. 12, 2012 | (JP) | 2012-227464 |
| Oct. 12, 2012 | (JP) | 2012-227465 |
| Oct. 12, 2012 | (JP) | 2012-227466 |
| Oct. 12, 2012 | (JP) | 2012-227467 |
| Dec. 28, 2012 | (JP) | 2012-286514 |
| Dec. 28, 2012 | (JP) | 2012-287009 |

(51) Int. Cl.

| | |
|---|---|
| ***B65H 31/32*** | (2006.01) |
| ***B65H 31/24*** | (2006.01) |
| ***B65H 31/30*** | (2006.01) |

(Continued)

(52) U.S. Cl.

CPC ..... *B65H 31/24* (2013.01); *B65H 31/3009* (2013.01); *B65H 31/32* (2013.01);

(Continued)

(58) Field of Classification Search

CPC . B65H 31/32; B65H 31/3009; B65H 31/3081
USPC ..... 271/189, 218, 207, 213; 270/58.12, 270/58.13, 58.11, 58.08

See application file for complete search history.

(56) References Cited

U.S. PATENT DOCUMENTS

| | | | | |
|---|---|---|---|---|
| 5,098,074 | A * | 3/1992 | Mandel et al. | 270/58.13 |
| 5,649,695 | A * | 7/1997 | Lawrence | 270/58.12 |

(Continued)

FOREIGN PATENT DOCUMENTS

| | | | |
|---|---|---|---|
| JP | 2000-169036 | A | 6/2000 |
| JP | 2001-026366 | A | 1/2001 |

(Continued)

*Primary Examiner* — Luis A Gonzalez
(74) *Attorney, Agent, or Firm* — Manabu Kanesaka

(57) ABSTRACT

A paper mount surface is disposed while being inclined in the sheet discharge direction or sheet-discharge orthogonal direction, and first and second support members that support the sheet rear and portion in the sheet discharge direction and rear end portion are disposed to be able to shift between actuation positions inside the tray and retract positions. Then, after collecting sheets on both support members, the support member positioned in the direction orthogonal to the inclined direction of the paper mount surface is first retracted from above the tray, and next, the support member positioned in the inclined direction is retracted to the waiting position.

13 Claims, 33 Drawing Sheets

(52) U.S. Cl.
CPC ..... *B65H 31/02* (2013.01); *B65H 31/3081* (2013.01); *B65H 31/34* (2013.01); *B65H 33/08* (2013.01); *B65H 39/10* (2013.01); *B65H 2301/4212* (2013.01); *B65H 2404/152* (2013.01); *B65H 2404/693* (2013.01); *B65H 2405/113* (2013.01); *B65H 2405/114* (2013.01); *B65H 2801/27* (2013.01)
USPC ..... 271/218; 271/189; 271/207

(51) Int. Cl.

| | |
|---|---|
| ***B65H 31/02*** | (2006.01) |
| ***B65H 31/34*** | (2006.01) |
| ***B65H 33/08*** | (2006.01) |
| ***B65H 39/10*** | (2006.01) |

(56) References Cited

U.S. PATENT DOCUMENTS

| | | | | |
|---|---|---|---|---|
| 6,145,826 | A * | 11/2000 | Kawata | 270/58.28 |
| 6,290,220 | B1 * | 9/2001 | Takehara et al. | 270/58.12 |
| 7,690,636 | B2 * | 4/2010 | Noh | 270/58.12 |
| 2011/0215523 | A1 * | 9/2011 | Tsuji et al. | 271/226 |

FOREIGN PATENT DOCUMENTS

| | | | |
|---|---|---|---|
| JP | 2002-265117 | A | 9/2002 |
| JP | 2005-132614 | A | 5/2005 |
| JP | 2006-044897 | A | 2/2006 |
| JP | 2006-044898 | A | 2/2006 |
| JP | 2010-195579 | A | 9/2010 |

* cited by examiner

Ts1
Ts2
19f
20f
Xp1
Xp2
Xp3
Yp1
Yp2
Yp3
on
off
19
20
15
16
17
23
FIRST ACTUATION POSITION
SECOND ACTUATION POSITION
WAITING POSITION

BASIC CONFIGURATION (WAITING STATE)

STAPLE OPERATION

BOUND SHEET DISCHARGE

SHEET DROP

SHEET COLLECTION

SHEET STORAGE APPARATUS AND IMAGE FORMATION SYSTEM USING THE APPARATUS

RELATED APPLICATIONS

The present application is based on, and claims priority from, Japanese Applications No. JP2012-227464 filed Oct. 12, 2012; No. JP2012-227465 filed Oct. 12, 2012; No. JP2012-227466 filed Oct. 12, 2012; No. JP2012-227467 filed Oct. 12, 2012; No. JP2012-286514 filed Dec. 28, 2012; and No. JP2012-287009 filed Dec. 28, 2012, the disclosure of which is hereby incorporated by reference herein in its entirety.

BACKGROUND OF THE INVENTION

1. Field of the Invention

The present invention relates to a sheet storage apparatus that stores a sheet fed from an image formation apparatus or the like on a stack tray, and more particularly, to improvements in the sheet storage mechanism for enabling sheets to be stored neatly in a correct position on a paper mount surface having a height difference from a sheet discharge outlet.

2. Description of the Related Art

Generally, as this type of apparatus, such a stack mechanism is widely known that a stack tray is disposed on the downstream side of a sheet discharge path and that a sheet is dropped onto a paper mount surface having a height difference from the sheet discharge outlet to store. Then, such a post-processing mechanism is also known that a sub-tray is provided between the sheet discharge outlet and the paper mount surface to temporarily hold a sheet, the sheet undergoes post-processing such as binding processing, paper folding processing and punching processing on the tray, and that the processed sheet is stored on the paper mount surface.

For example, Patent Document 1 (Japanese Patent Gazette No. 4901082) discloses an apparatus in which a stack tray is disposed in a sheet discharge path of an image formation apparatus, support members are provided between a sheet discharge outlet and a paper mount surface to support the sheet rear end and sheet corner, and that binding processing is performed on a bunch of sheets collated and collected on the support members to store on the paper mount surface. In the apparatus in the Document, the rear end support member for supporting the sheet rear end and corner support member for supporting the sheet corner are disposed between the sheet discharge outlet and the paper mount surface, and the apparatus is provided with a shift mechanism that causes both support members to reciprocate between actuation positions above the tray and waiting positions outside the tray.

SUMMARY OF THE INVENTION

As described above, in the post-processing mechanism in which the support members to temporarily collect sheets are provided above the stack tray and are configured to be able to proceed and retract between above the tray and the outside, it is possible to make the apparatus small and compact. Meanwhile, it is also known that when a difference in height from the sheet discharge outlet is increased, the storage capacity is increased on the tray paper mount surface but the storage posture is in disorder on the sheet which is dropped from the sheet discharge outlet and stored, and that when the difference in height is decreased, the storage capacity is limited. Then, the mechanism is also known that moves up and down the paper mount surface of the stack tray corresponding to the load amount, but has problems that the size of the apparatus is increased and that the cost is high.

Conventionally, in the case of configuring the support members that temporarily support the sheet between the sheet discharge outlet and the paper mount surface to be able to proceed and retract with respect to the tray, the rear end support member that supports the sheet rear end and the side edge support member that supports the sheet side edge are both retracted from the support positions above the tray to outside the tray at the same time, and the entire sheets are dropped onto the paper mount surface at the same time and stored.

Accordingly, sheets (bunch) supported by the support members above the paper mount surface are dropped onto the paper mount surface and stored in a stage in which the support members are retracted. In this storage, the entire sheets are currently dropped, and therefore, are stored disorderly with the sheet posture in disorder. When the sheets are stored with the sheet posture in an unstable state, it is difficult to perform sorting storage for offsetting sheets for each group to load on the paper mount surface.

For example, when a sub-tray is provided between the sheet discharge outlet and the paper mount surface, and sheets are offset by a predetermined amount, collected on the sub-tray, then dropped onto the paper mount surface and are stored, such a problem arises that the sheet posture is in disorder on drop impact and that it is not possible to sort.

Therefore, the inventor of the present invention arrived at the idea that the paper mount surface is inclined in the sheet discharge direction or the sheet-discharge orthogonal direction, support members that support the sheet rear end portion and the side end portion are configured to be able to retract from the tray independently, and that in dropping sheets collected on both support members, the support member in the inclined direction is first retracted from the sheets to then retract the remaining support member from the sheets.

It is an object of the present invention to provide a sheet storage apparatus that enables sheets to be collected neatly in a correct position in an apparatus configuration with a sub-tray for temporarily holding sheets disposed between a sheet discharge outlet and a paper mount surface. Further, it is another object of the invention to provide a sheet storage apparatus that enables successive sheets to be sorted for each group, stacked and stored on the paper mount surface.

To attain the above-mentioned objects, in the present invention, the paper mount surface is inclined in the sheet discharge direction or the sheet-discharge orthogonal direction and disposed, while first and second support members that support the sheet rear end portion in the sheet discharge direction and rear end portion are disposed to be able to shift between actuation positions inside the tray and retract positions. Then, it is a feature that after the sheets are collected on both support members, the support member positioned in the direction orthogonal to the inclined direction of the paper mount surface is first retracted from above the tray, and that the support member positioned in the inclined direction is then retracted to a waiting position.

Further, the configuration will be described specifically. The apparatus is provided with a sheet discharge outlet (13) that carries out a sheet, a stack tray (15) having a paper mount surface (15*a*) to load sheets disposed on the downstream side of the sheet discharge outlet, and sub-tray means (18) disposed between the sheet discharge outlet and the paper mount surface to temporarily hold a sheet discharged from the sheet discharge outlet.

The paper mount surface (15*a*) of the stack tray is provided with a difference in height to support the sheet in an inclined posture in the sheet discharge direction or the sheet-discharge orthogonal direction, and the sub-tray means (18) is comprised of a first support member (19) that supports a sheet end edge positioned in the inclined direction of the stack tray, a second support member (20) that supports a sheet end edge positioned in the inclination orthogonal direction of the stack tray, first shift means (21) for causing the first support member to reciprocate between an actuation position above the paper mount surface and a retract position outside the paper mount surface, second shift means (22) for causing the second support member to reciprocate between an actuation position above the paper mount surface and a retract position outside the paper mount surface, and sheet discharge control means (50) for controlling the first and second shift means.

In shifting the first and second support members from the actuation positions to the retract positions, the above-mentioned sheet discharge control means (50) first shifts the second support member to the retract position, and then, shifts the first support member to the retract position.

In the present invention, the paper mount surface is disposed while being inclined in the sheet discharge direction or the sheet-discharge orthogonal direction, while the first and second support members that support the sheet rear end portion in the sheet discharge direction and the rear end portion are disposed to be able to shift between the actuation positions inside the tray and the retract positions, after collecting sheets on both support members, the support member positioned in the direction orthogonal to the inclined direction is first retracted to next retract the support member positioned in the inclined direction to the waiting position, and therefore, the invention exhibits the effects as described below.

Sheets are collected while being supported on the first and second support members, the support member in the direction orthogonal to the inclined direction of the paper mount surface is retracted, then the remaining support member is retracted, and therefore, it is possible to collect the sheets neatly in the correct position on the paper mount surface. In other words, when the paper mount surface is inclined (rising inclination in the sheet discharge direction) in front and back in the sheet discharge direction, after retracting the side edge support member that supports the sheet side edge portion, the sheets are landed on the paper mount surface with a small drop (difference in height) starting at the front end with the sheet rear end portion supported by the rear end support member, the rear end support member is then retracted, and the sheets are stored on the paper mount surface.

Therefore, as compared with the case of concurrently dropping the entire sheets on the paper mount surface with a large difference in height to store, the sheets are landed on the paper mount surface starting at the end portion with a small difference in height, then the sheet rear end portion is landed, and therefore, the sheets are stored in a relatively correct posture with little positional displacement.

Further, when the sheets, which are supported by the support members positioned in the inclined direction of the paper mount surface and the orthogonal direction, are offset by a predetermined amount corresponding to collation information and are then stored on the paper mount surface, it is possible to perform a jog sort of sheets with little positional displacement.

DETAILED DESCRIPTION OF THE INVENTION

Figure 1:
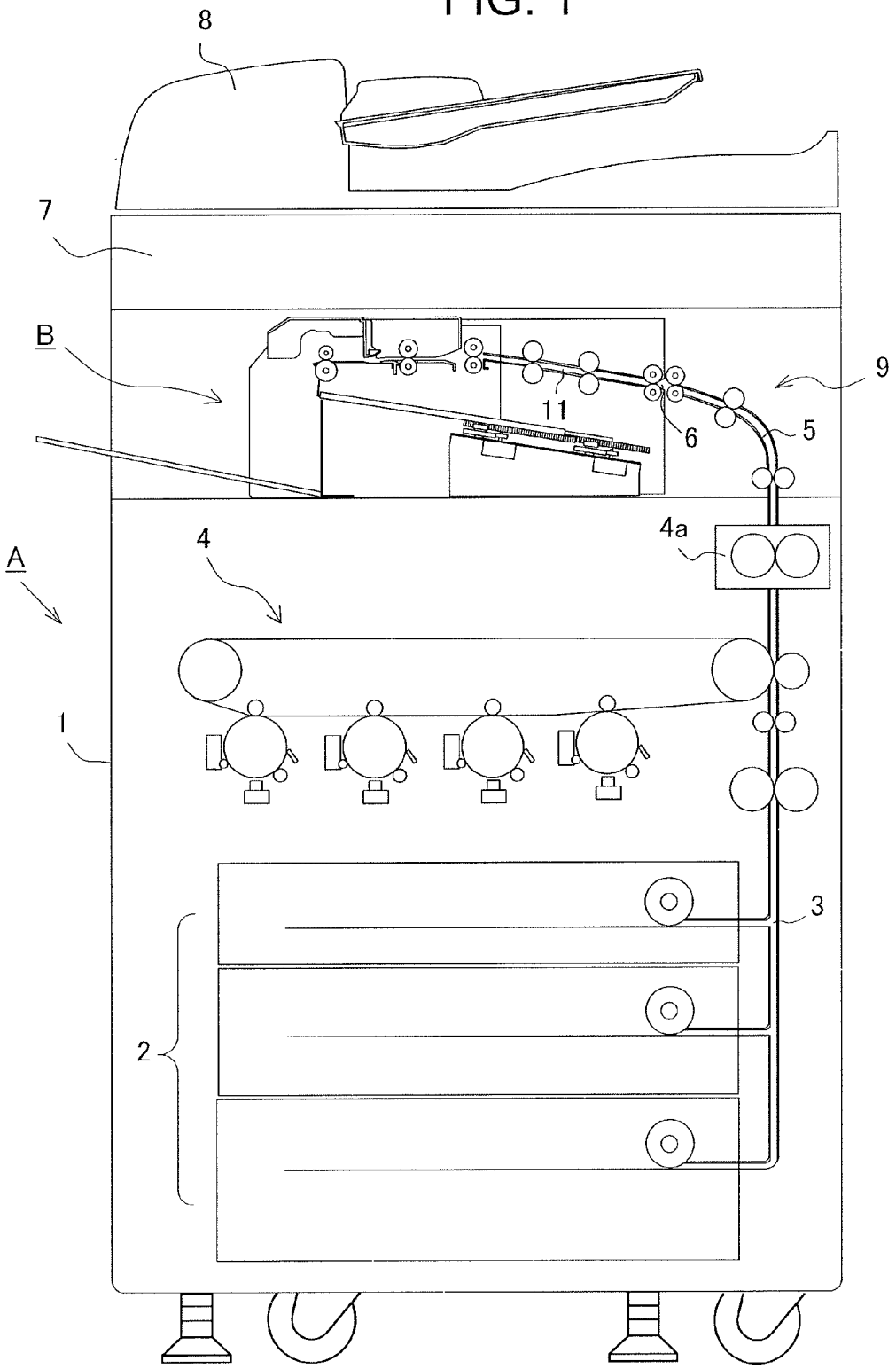
FIG. 1 is an explanatory view of the entire configuration of an image formation system according to the present invention.

The present invention will specifically be described below based on preferred Embodiments shown in drawings. FIG. 1 shows the entire configuration of an image formation system according to the invention, and is comprised of an image formation apparatus A that forms an image on a sheet, and a post-processing apparatus B that performs post-processing such as binding processing and jog sort processing on sheets with images formed in the image formation apparatus A to store on a stack tray on the downstream side. A sheet storage apparatus C is incorporated into the post-processing apparatus B.

The image formation apparatus A is capable of adopting various image formation mechanism such as an inkjet printing mechanism and offset printing mechanism as well as an electrostatic printing mechanism described later. The post-processing apparatus B is capable of adopting processing mechanisms of a paper folding apparatus, magazine folding apparatus, punching apparatus, stamping apparatus and the like as well as a staple binding processing apparatus described later.

[Image Formation Apparatus]

The image formation apparatus A as shown in FIG. 1 is coupled to an image handling apparatus such as a computer and network scanner not shown, and forms an image on a designated sheet based on image data transferred from these apparatuses to carry out of a predetermined sheet discharge outlet 6. In the sheet discharge outlet 6 is provided a sheet discharge tray to load and store sheets. As a substitute for the sheet discharge tray, the post-processing apparatus B is installed as an optional apparatus. Further, as well as such a network configuration, the image formation apparatus A is configured as a copier or facsimile, and is configured to copy and form an image on a sheet based on data obtained by reading an image with an original document scanning unit.

In the image formation apparatus A, a plurality of paper feed cassettes 2 is prepared in a housing 1, and a sheet of the selected size is fed from the cassette to a paper feed path 3 on the downstream side. In the paper feed path 3 is provided an image formation mechanism (image formation section) 4. Known as the image formation mechanism 4 are the inkjet printing mechanism, electrostatic printing mechanism, offset printing mechanism, silk screen printing mechanism, ribbon transfer printing mechanism and the like. The present invention is capable of adopting any printing mechanism.

A sheet discharge path 5 is provided on the downstream side of the image formation mechanism 4, and a sheet is carried out of the sheet discharge outlet 6 (hereinafter, referred to as a main-body sheet discharge outlet) disposed in the housing 1. In addition, depending on the printing mechanism, a fuse unit 4*a* is incorporated into the sheet discharge path 5. The sheet of the selected size is thus fed to the image formation section 4 from the paper feed cassette 2, and after forming the image, is carried out to the main-body sheet discharge outlet 6 from the sheet discharge path 5. Moreover, when a duplex path (not shown) is disposed inside the housing 1, after forming an image on the frontside of the sheet in the image formation section 4, it is also possible to reverse the side of the sheet to circulate and feed again to the image formation section 4.

The main-body sheet discharge outlet 6 is coupled to the post-processing apparatus B described later. Further, into the housing 1 are incorporated a scanner unit 7, and an original document feed unit 8 that feeds an original document sheet to the scanner unit 7. In this case, the scanner unit 7 scans the original document sheet placed on platen or fed from a feeder mechanism to read the image, and transfers the read data to the image formation apparatus A. Further, the original document feed unit 8 is provided with the feeder mechanism that feeds an original document sheet to the platen of the scanner unit 7.

[Post-Processing Apparatus]

Figure 2:
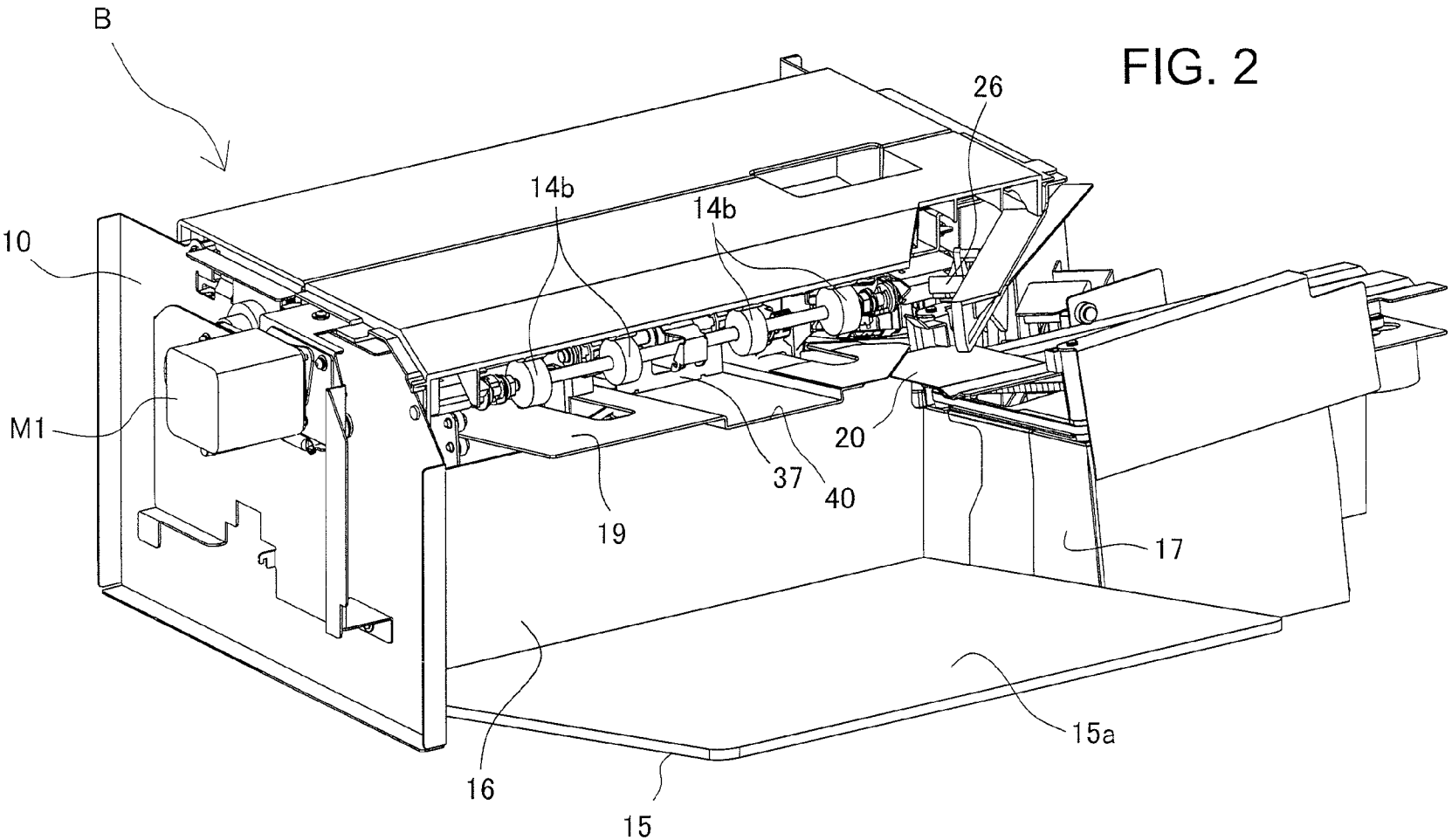
FIG. 2 is a perspective explanatory view of the entire configuration of a post-processing apparatus (sheet storage apparatus) in the image formation system of FIG. 1.

The post-processing apparatus B in the image formation system of FIG. 1 is incorporated into a sheet discharge area 9 of the image formation apparatus A as an optional apparatus. In other words, the post-processing apparatus B is incorporated into a sheet discharge section of the apparatus housing constituting the image formation apparatus A as a unit of inner finisher structure. The present invention is not limited to such an inner finisher structure, and the post-processing apparatus B may be configured as a standalone structure and coupled to the main-body sheet discharge outlet 6 of the image formation apparatus A. FIG. 2 shows a perspective configuration of the post-processing apparatus B of the inner finisher configuration. A housing 10 constituting the unit is configured in a dimensional shape capable of being incorporated into the sheet discharge area 9 of the image formation apparatus A.

Figure 3A:
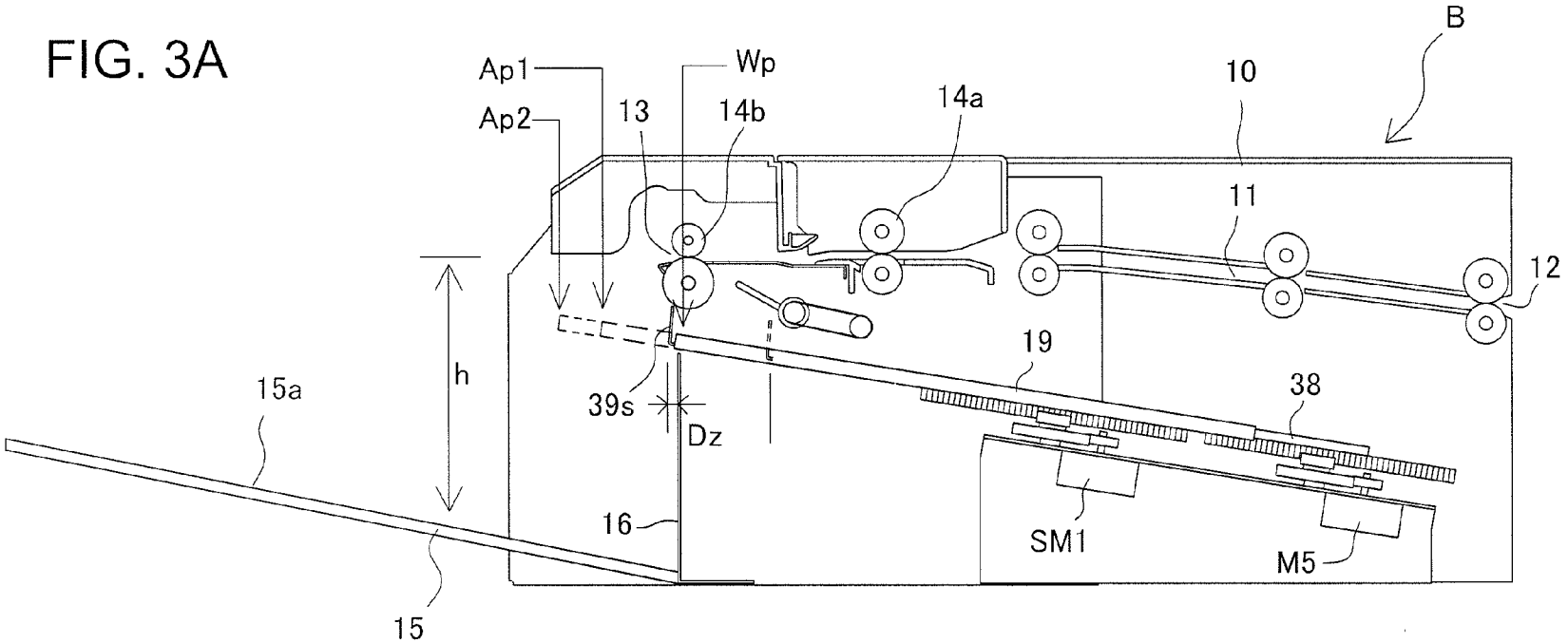
FIG. 3A is an explanatory view of the front configuration of the post-processing apparatus in the system of FIG. 1.

FIG. 3A shows a cross-sectional configuration thereof, and the post-processing apparatus B is provided with a sheet carry-in path 11 to carry a sheet in from the image formation apparatus A, and a stack tray 15 disposed on the downstream side of the path. A height difference with a difference in height h is formed between a path sheet discharge outlet 13 (hereinafter, simply referred to as a "sheet discharge outlet") of the sheet carry-in path 11 and a paper mount surface 15*a* of the stack tray 15. The height difference h is set for an allowable maximum storage amount. In addition, the stack tray 15 shown in the figure adopts a stack structure fixed to a predetermined height difference without moving up and down in the load direction corresponding to a load amount of sheets. This is because of forming the apparatus configuration in small and compact size to be stored in the sheet discharge area 9 of limited space. Accordingly, when the apparatus cost and storage space are allowed, an up-and-down tray structure may be adopted to move the stack tray 15 up and down in the sheet load direction. In this case, the tray may be moved up and down corresponding to the weight of discharged sheets using an elastic member such as a spring, or drive to move the tray up and down may be used.

The sheet carry-in path 11 is disposed in the substantially horizontal direction in the housing 10, and transports a sheet from the carry-in entrance 12 to the sheet discharge outlet 13. Therefore, in the sheet carry-in path 11 are provided a sheet transport guide, a plurality of transport rollers 14*a* arranged at predetermined intervals, and carry-in sensor Se1 and sheet discharge sensor Se2 that detect the front and rear ends of the sheet. Then, the transport rollers 14*a* are coupled to a transport motor M1 not shown. "14*b*" shown in the figure denotes a sheet discharge roller disposed on the path exist end, and is coupled to the same transport motor M1 as that of the transport rollers 14*a*.

[Stack Tray]

The configuration of the stack tray 15 will be described according to FIG. 2. The stack tray 15 is fixed to the apparatus frame 10 (housing; the same in the following description), and has the paper mount surface 15*a* to load and accommodate sheets fed from the sheet discharge outlet 13. In the apparatus shown in the figure, the tray is of mold forming of a synthetic resin and is fixed to the apparatus frame 10 in the shape of a tray on which sheets are mounted (cantilever support structure). The height difference with the difference in height h is formed between the sheet discharge outlet 13 and the paper mount surface 15*a*, and a rear end regulation surface (sheet rear end regulation surface) 16 and side edge regulation surface 17 are provided in wall surface structure in between the sheet discharge outlet 13 and the paper mount surface 15*a*. In each regulation surface, the rear end regulation surface 16 regulates the rear end surface of sheets loaded on the paper mount surface, and the side edge regulation surface 17 regulates the side edge surface of the sheets.

In addition, the paper mount surface 15*a* of the stack tray 15 is configured in fixed tray structure having the difference in height h from the sheet discharge outlet 13 as shown in FIG. 3A. In this case, the difference in height h is set at a height adapted to the maximum load amount capable of being held. Moreover, the stack tray 15 may be configured to move up and down in the sheet load direction in the apparatus frame 10, and the up-and-down tray structure may be adopted to adjust the height position of the paper mount surface 15*a* upward and downward corresponding to the load amount of sheets carried out of the sheet discharge outlet 13.

[Sub-Tray]

Figure 4A:
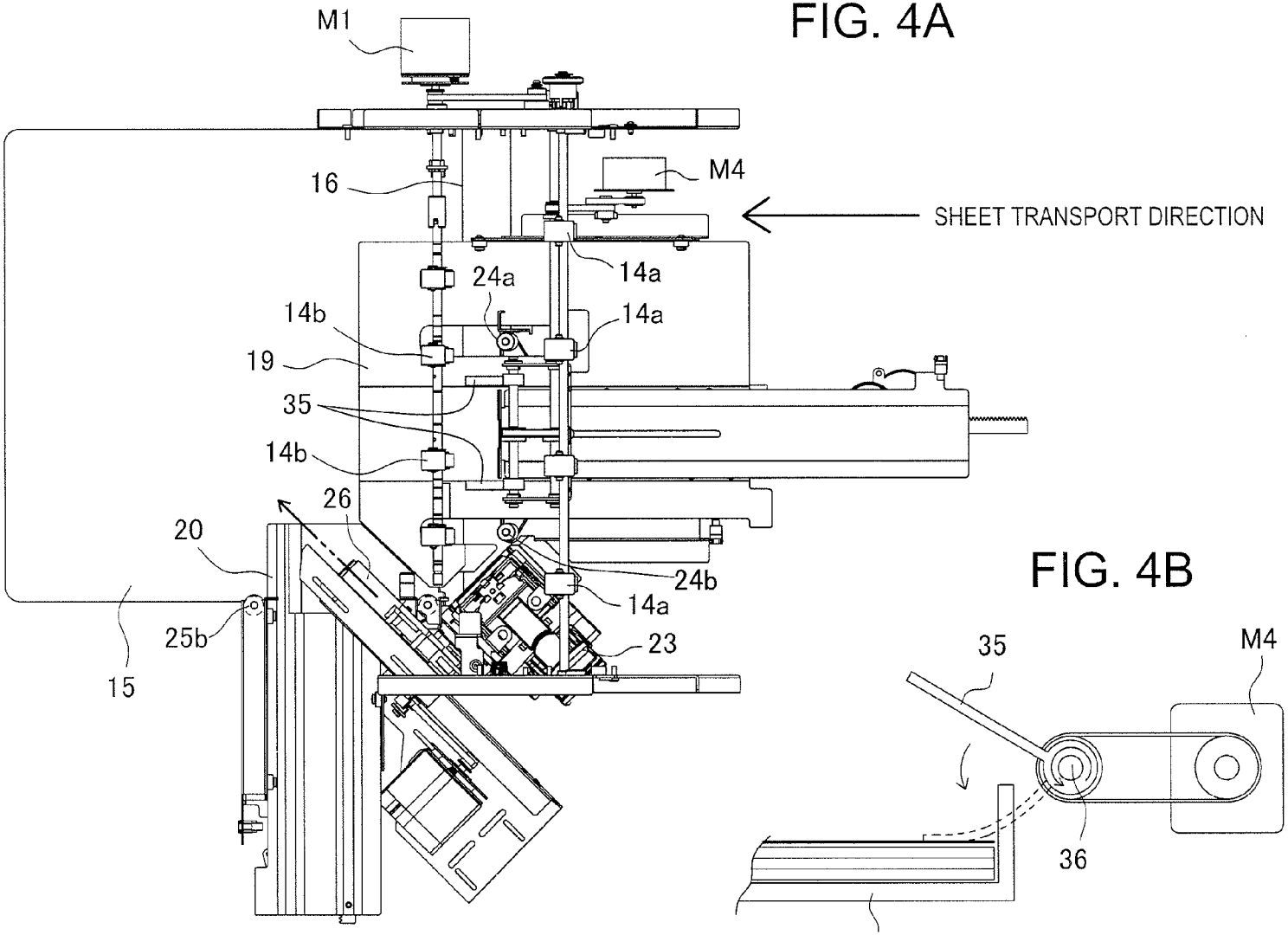
FIG. 4A is an explanatory view of the plan configuration of the post-processing apparatus in the system of FIG. 1.
Figure 5A:
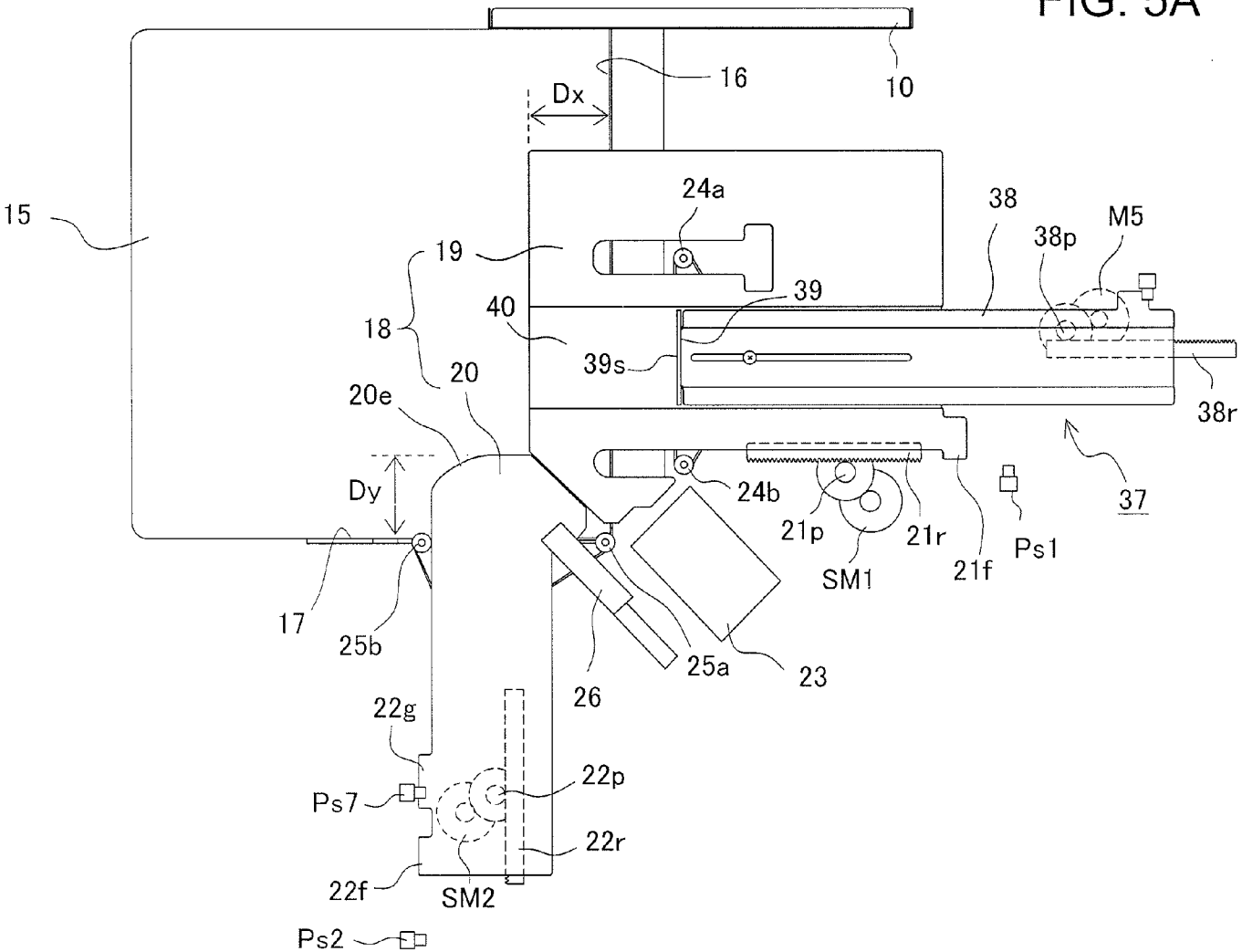
FIG. 5A is a structure explanatory view of a sub-tray in the invention (explanatory view of a state in which the sheet discharge mechanism in FIG. 4 is omitted)

As shown in FIGS. 2, 3A and 5A, a sub-tray 18 is disposed between the sheet discharge outlet 13 and the paper mount surface 15*a*. The sub-tray 18 temporarily supports sheets dropping onto the paper mount surface 15*a* from the sheet discharge outlet 13 to be mounted in the middle position, performs post-processing on the sheets and then stores on the paper mount surface 15*a*. The configuration of the post-processing will be described later. FIG. 4A shows the plan configuration of the sheet discharge outlet 13 and stack tray 15, and is a schematic view with the transport guide constituting the sheet carry-in path 11 omitted. The sheet carry-in path (not shown) is disposed from the right side to the left side as viewed in the figure, and the transport rollers 14*a* and sheet discharge roller 14*b* carry the sheet coming from the carry-in entrance 12 to the sheet discharge outlet 13. The sheet fed to the sheet discharge outlet 13 is collected on the paper mount surface 15*a* of the stack tray 15, and is stacked with the sheet end surface regulated by the rear end regulation surface 16.

Figure 5B:
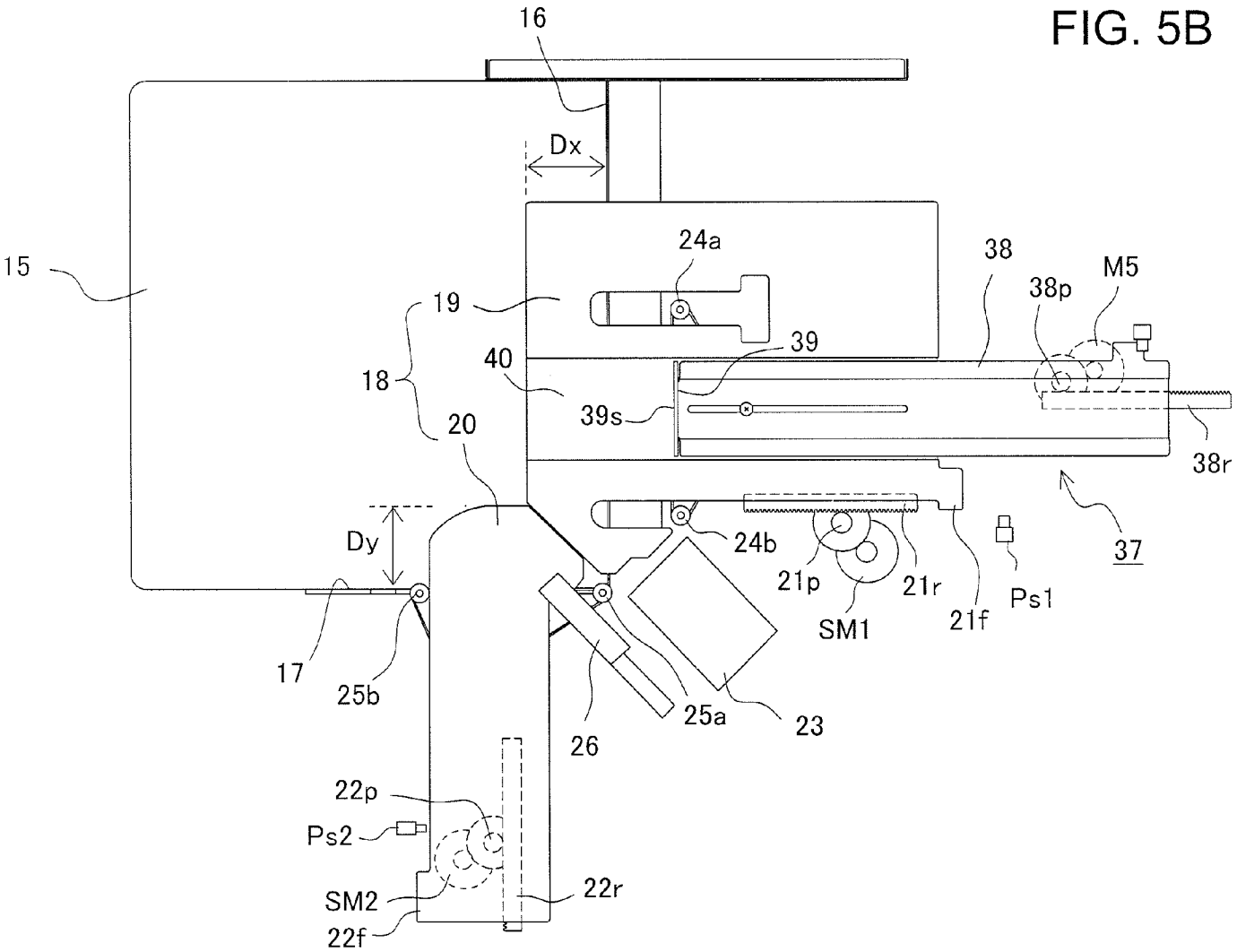
FIG. 5B is another structure explanatory view of the sub-tray in the invention.

The sub-tray 18 partially supports the sheet fed from the sheet discharge outlet 13 and holds the sheet in this position. The sub-tray 18 shown in the figure is comprised of a rear end support member 19 (first support member) that supports the sheet rear end in the sheet discharge direction, and a side edge support member 20 (second support member 20) that supports one side edge portion (in the apparatus as shown in the figure, the left side edge portion in the sheet discharge direction) of the sheet. In FIGS. 5A and 5B, the rear end support member 19 protrudes by Dx from the rear end regulation surface 16 of the stack tray 15 to the inside of the tray, and the side edge support member 20 protrudes by Dy from the side edge regulation surface 17 to the inside of the tray. Then, the protrusion amounts Dx (protrusion amount of the first support member) and Dy (protraction amount of the second support member) are formed in areas allowed to mount and support any of sheets of the maximum size to the minimum size and sheets of the maximum weighing to the minimum weighing on both support members.

Further, the first support member (rear end support member) 19 and the second support member (side edge support member) 20 are configured to be able to shift from actuation positions Ap (Ap1 or Ap2) protruding to the inside of the stack tray 15 and retract positions Wp (not protruding from any of the rear end regulation surface 16 and side edge regulation surface 17) retracted to the outside of the stack tray 15. In other words, the first support member 19 reciprocates between the actuation position Ap protruding to the inside of the stack tray 15 and the retract position Wp retracted to the outside of the stack tray 15 (inside the sheet rear end regulation surface 16; the right side in FIG. 4A). Similarly, the second support member 20 reciprocates between the actuation position Ap (position shown in the figure) protruding to the inside of the stack tray 15 and the retract position Wp retracted to the outside of the stack tray 15 (inside the sheet side edge regulation surface 17; the front side in FIG. 4A). This slide structure is capable of adopting various mechanisms, and in the apparatus as shown in the figure, the plate-shaped first and second support members 19, 20 are fitted into guide rails (not shown) formed in the apparatus frame 10 to be slidable with slide rollers and the like.

[Shift Mechanism]

As described above, the first support member (rear end support member) 19 and the second support member (side edge support member) 20 are supported by the apparatus frame 10 to be able to reciprocate between the actuation positions Ap and the retract positions Wp by predetermined strokes. The first support member 19 is equipped with a first tray shift means 21, the second support member 20 is equipped with a second tray shift means 22, and the shift means drive respective support members 19, 20 to enable the members to reciprocate between the actuation positions Ap and the waiting positions Wp. The first tray shift means 21 and the second tray shift means 22 adopt the same configuration, and therefore, one of the means is described. FIGS. 5A and 5B are explanatory views illustrating the relationships between the first and second support members 19, 20 and the shift means 21, 22. With the description given according to the figures, a rack 21*r* is integrally formed on the back side of the first support member 19, and the support member 19 reciprocates with a first shift motor SM1 fixed to the apparatus frame 10, and a pinion 21*p* coupled to the motor. In other words, the rack 21*r* is integrally formed on the back side of the first support member 19, and meshes with the pinion 21*p* axially supported by the apparatus frame 10. The pinion 21*p* is coupled to the first shift motor SM1, and forward and backward rotation of the motor causes the rear end support member 19 to reciprocate between the retract position Wp and the actuation position Ap.

In other words, the rack 21*r* integrally formed in the first support member (rear end support member) 19 reciprocates via the pinion 21*b* by forward and backward rotation of the first shift motor SM1. "21*f*" shown in the figure denotes a sensor flag disposed in the support member 19, and is to detect a position (for example, home position; retract position) of the support member 19 using a position sensor Ps1 disposed in the apparatus frame 10. In addition, the shift motor SM1 is comprised of a stepping motor capable of rotating forward and backward, and for example, is allowed to control the support member 19 by a predetermined amount in the predetermined direction by PMW control. The second support member (side edge support member) 20 has the same configuration, and is shifted from the actuation position Ap to the retract position Wp. Therefore, the second support member 20 is provided with a second shift motor SM2, second pinion 22*p*, second rack 22*r*, second position sensor Ps2 and second sensor flag 22*f*.

Figure 6A:
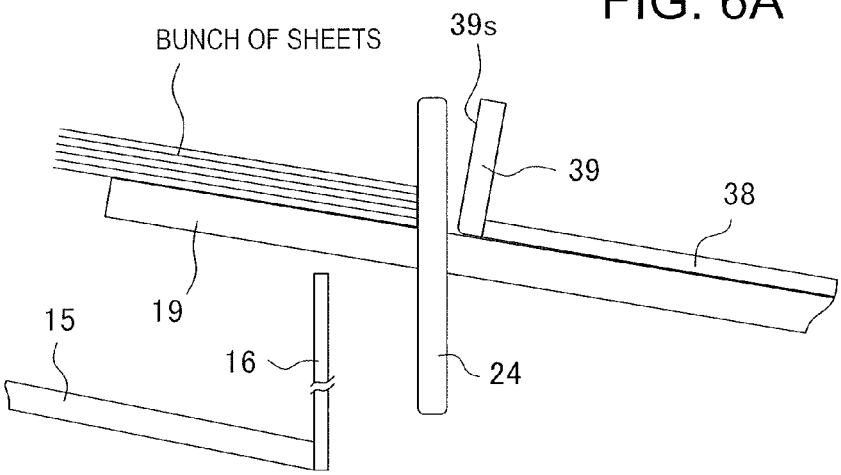
FIG. 6A is an explanatory view illustrating the position relationship between a sheet press member and a rear end regulation surface, while illustrating a state of the sheet press member and sheet press surface thereof in collecting sheets on the sub-tray.
Figure 6B:
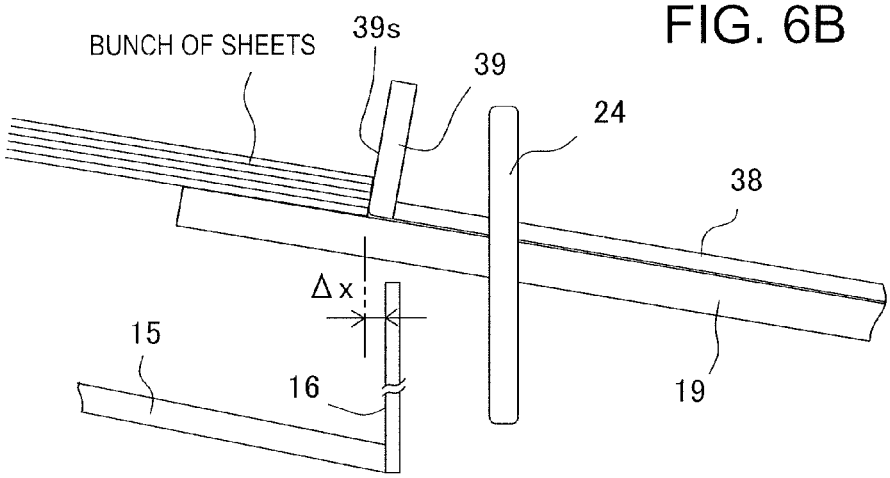
FIG. 6B is another explanatory view illustrating the position relationship between the sheet press member and the rear end regulation surface, while illustrating a state of shifting the position of a bunch of sheets collected on the sub-tray from a binding processing position to the tray side to store on a stack tray.
Figure 6C:
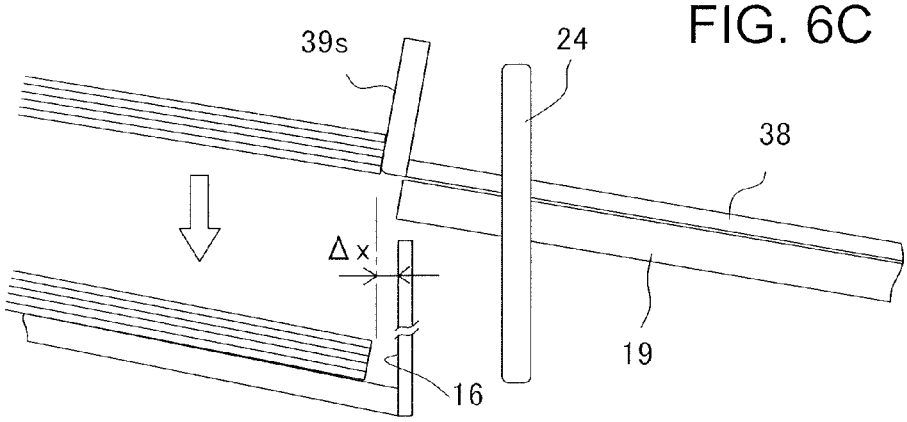
FIG. 6C is still another explanatory view illustrating the position relationship between the sheet press member and the rear end regulation surface, while illustrating a state of dropping the bunch of sheets shifted in the position to the stack tray side to store.

FIGS. 6A, 6B and 6C are explanatory views illustrating the position relationship between a paper press surface 39*s* of a sheet push member 38 and the rear end regulation surface 16 of the stack tray. FIG. 6A shows a state of the sheet push member 38 and the paper press surface 39*s* thereof in collecting sheets on the sub-tray 18. FIG. 6B shows a state of shifting the position of a bunch of sheets collected on the sub-tray from the binding processing position to the tray side to store on the stack tray 15. FIG. 6C shows a state of dropping the bunch of sheets shifting in the position to the stack tray side to store.

In FIG. 6A, the sheet push member 38 waits in a position retracted from a rear end regulation stopper 24 disposed in the rear end support member 19 together with the paper press surface 39*s*. In this state, sheets fed from the sheet discharge outlet 13 are stacked and collected on the rear end support member 19 and side edge support member 20 protruding above the stack tray 15.

In FIG. 6B, the sheet push member 38 shifts the position of the bunch of sheets on the rear end support member 19 from the binding processing position to a tray storage position. At this point, the paper press surface 39*s* formed in a bent piece 39 of the sheet push member 38 shifts the sheets to a position with a distance Δx formed from the rear end regulation surface 16 of the stack tray 15.

In FIG. 6C, the sheet push member 38 shifts backward the rear end support member 19 from above the stack tray to outside the tray with the paper press surface 39*s* regulating the sheet rear end edge. The operation of the sheet push member 38 is performed by controlling rotation of a pusher motor M5 described later.

As described in FIGS. 4A, 5A and 5B, the sub-tray 18 is disposed between the sheet discharge outlet 13 and the stack tray 15, and the sub-tray 18 shown in the figure is comprised of the first support member (rear end support member) 19 and the second support member (side end support member) 20. Further, the support members 19, 20 shift from the actuation positions Ap inside the path (shift trajectory) to the waiting position Wp outside the path (shift trajectory) with respect to the shift path (drop trajectory) of the sheet from the sheet discharge outlet 13 to the stack tray 15 by the shift motors SM1 and SM2, respectively. Reference numeral "23" shown in the figure denotes a post-processing unit, and is a staple unit for performing binding processing on the bunch of sheets that are collated and collected on the first and second support members 19, 20.

As the staple unit 23 (post-processing means; the same in the following description), various structures are known, and the description thereof is omitted. A blank staple stored in a cartridge is bent in the shape of a U and is inserted into a bunch of sheets, and the staple tips are bent by an anvil. In addition, as a substitute for the staple unit, or together with the unit, it is possible to install a punch unit that punches a punch hole in a bunch of collated sheets, stamp unit and the like as the post-processing apparatus.

[Regulation Stopper]

In the sub-tray 18 (first and second support members 19, 20) as described previously, stopper members are provided to regulate the position of the end edge of sheets that are placed and supported. In the first support member (rear end support member) 19 is disposed the rear end regulation stopper 24 that regulates the sheet rear end, and in the second support member (side edge support member) 20 is disposed a side edge regulation stopper 25 that regulates the sheet side edge. The regulation stoppers 24, 25 shown in the figure are comprised of pluralities of floating rollers 24*a*, 24*b* and floating rollers 25*a*, 25*b* having distances, respectively and are axially supported by the apparatus frame 10 to be rotatable.

Then, each floating roller (regulation stopper) 24 (25) engages in the edge side of the sheets, and when the sheets shift, rotates in the shift direction. In this case, by forcibly rotating a plurality of rollers in a predetermined direction, it is possible to perform alignment of sheets more correctly and promptly. For example, the floating roller 24*a* and the floating roller 24*b* are interlocked with a belt, and a drive motor (not shown) is coupled to the belt. By thus configuring, the sheets are shifted in the alignment direction in cooperation with an aligning transport means 26 described late, and are aligned in a more correct position. Moreover, the regulation stoppers 24, 25 may be formed by height difference surfaces. For example, a height difference portion, protrusion or the like is integrally formed in each of the support members 19, 20, the end surface is made a regulation surface, and thus, it is possible to adopt various structures.

In each of the regulation stoppers 24, 25, in a second sheet discharge mode described later, the sheet rear end is struck by the rear end stopper 24 to regulate, the sheet side edge is struck by the side edge stopper 25 to regulate, and the sheets are positioned in the binding processing position. Further, in a third sheet discharge mode described later, the sheet side edge is struck by the side edge stopper 25 to regulate, and the sheets are positioned in a jog offset position. In addition, in the Embodiment shown in the figure in the third sheet discharge mode, the sheet rear end edge is struck by the rear end stopper 24 to regulate concurrently with the sheet side edge, but such a configuration is not inevitable (in other words, in the third sheet discharge mode, the rear end regulation stopper 24 may be retracted from the first support member (rear end support member) 19).

[Configuration of the Aligning Transport Means]

As shown in FIG. 4A, the aligning transport means 26 is disposed in the apparatus frame 10 to carry the sheet placed and supported on the first support member (rear end support member) 19 and the second support member (side edge support member) 20 toward the rear end regulation stopper 24 and the side edge regulation stopper 25. With respect to the sheet carried out to the sheet discharge outlet 13 by the sheet discharge rollers 14*b*, when the sheet rear end is separated from the roller periphery, the sheet drops onto the first and second support members 19, 20 and is placed in a free state. The aligning transport means 26 that transports the sheet backward to the rear end regulation stopper 24 and the side edge regulation stopper 25 is disposed in a corner portion (right end in FIG. 4A) of the first and second support members 19, 20.

In the apparatus shown in the figure, the aligning transport means 26 is disposed on the second support member (side edge support member) 20, and is disposed to transport backward the sheets placed on the first support member (rear end support member) 19 and the second support member 20 in the arrow inverse direction (sheet corner direction) in FIG. 4A. The aligning transport means 26 may be disposed on the first support member 19, and described is the case where the means 26 is disposed on the second support member 20 as shown in the figure.

The aligning transport means 26 is comprised of a friction transport body 27 that engages in the top surface of a sheet supported by the first support member (rear end support member) 19 and the second support member (side end support member) 20, and a transport body travel means 28 to cause the friction transport body to travel in an angle direction crossing the sheet discharge direction in the sheet-discharge opposite direction.

Figure 7:
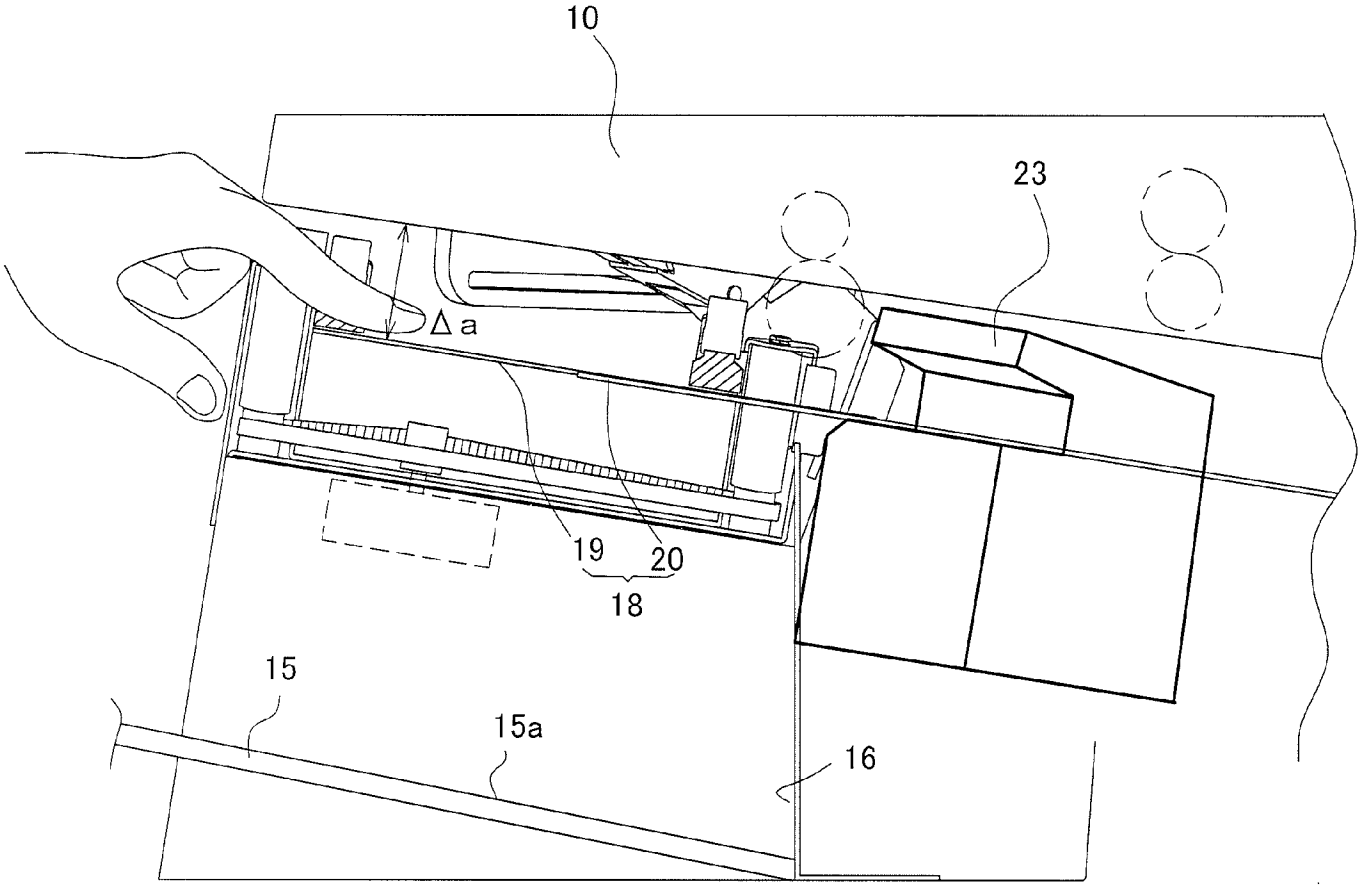
FIG. 7 is an arrangement view of a staple unit disposed on the sub-tray.

The friction transport body 27 engages in the sheet top surface supported on the support member 20, and shifts the sheet in the travel direction of the transport body by the friction force acting on both. Therefore, the friction transport body is formed of a high friction material such as a rubber material and resin material, and its shape is formed in the shape of a pad (rectangle), the shape of a roll, the shape of a half roll (the shape of a semicircle), the shape of a sphere or the like. The Embodiment in FIG. 7 shows the case where the body is comprised of a floating roller (the shape of a roll). Then, the friction transport body 27 is mount-supported by a holder member (transport body travel means 28 described below; the same in the following description).

Figure 9:
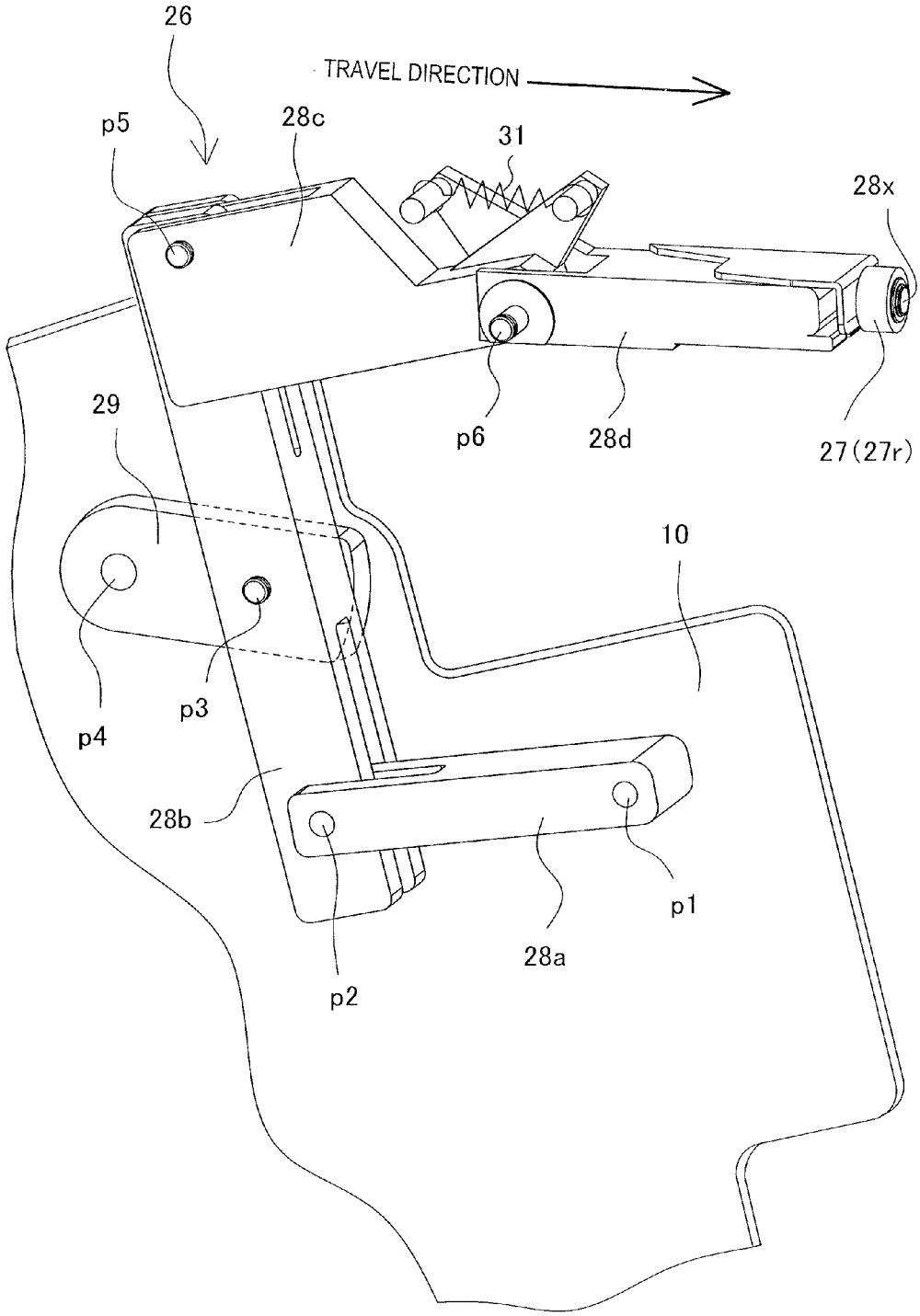
FIG. 9 shows Embodiment 1 (rotating body and inch motion mechanism) of a friction transport body in the apparatus of FIG. 2.

FIG. 9 shows the transport body travel means 28 that shifts the friction transport body 27 to a waiting position Wu retracted from sheets on the side end support member 20 and an engagement position Ad for engaging in the sheet top surface in a predetermined carry direction (X direction) while engaging in the sheet top surface so as to drag and transport the sheets. The transport body travel means 28 shown in the figure is comprised of a manipulator 28 installed in the apparatus frame 10.

The manipulator (transport body travel means) 28 is comprised of a first arm 28*a*, a second arm 28*b* axially supported by the first arm to be swingable, a third arm 28*c* axially supported by the front end portion of the second arm, and an actuation arm 28*d* axially supported by the front end portion of the third arm. In other words, the manipulator 28 is comprised of an arm coupling body (link coupling) of four-axis configuration, the first arm 28*a* is axially supported by the apparatus frame 10, the second arm 28*b* is coupled to a drive arm 29, motion of the third arm 28*c* is regulated with a guide groove 30 of the apparatus frame 10, and the friction transport body 27 is fixed to the front end of the actuation arm 28*d* axially supported by the third arm 28*c*.

In FIG. 9, "p1" denotes a rotating pin that axially supports the first arm 28*a* on the apparatus frame 10 to be swingable, and "p2" denotes a rotating pin that axially supports the base end portion of the second arm 28 on the first arm front end. "p3" denotes a rotating pin that axially couples the front end of the drive arm 29 to the second arm 28*b* to be rotatable, and the drive arm 29 is coupled to a travel motor M3. "p4" denotes a drive shaft that axially supports the drive arm 29 on the apparatus frame 10 to be rotatable. The drive shaft p4 is coupled to the travel motor M3 via a deceleration mechanism. Accordingly, when the drive arm 29 rotates in a counterclockwise direction with the drive shaft P4 as the center by the travel motor M3, the friction transport body 27 mounted on the actuation arm 28*d* turns and rotates in right rotation in FIG. 9.

Further, "p5" denotes a rotating pin that axially supports the third arm, 28*c* on the second arm front end to be rotatable, and "p6" denotes a rotating pin that axially supports the actuation arm base end on the third arm front end to be rotatable. Further, p6 works also as a guide pin fitted into the guide groove 30 provided in the apparatus frame 10. Then, the guide groove 30 of the apparatus frame 10 is configured in the shape of guiding the actuation arm 28 *d* to perform inch worm motion.

Furthermore, a biasing spring 31 for biasing the friction transport body 27 mounted on the actuation arm front end to the side end support member 20 side is laid between the third arm 28*c* and the actuation arm 28*d*. This is because of engaging the friction transport body 27 on the sheet surface always by nearly constant press force irrespective of the thickness (bunch thickness) of sheets loaded on the support member 20. The friction transport body 27 is comprised of a floating roller 27*r* in the shape of a roll. The floating roller 27*r* is axially supported by the actuation arm 28*d* to be rotatable via a roll support shaft 28*x*, and its rotation direction is the orthogonal direction to the sheet travel direction (the arrow direction in FIG. 9) described later.

In addition, in the Embodiment in FIG. 9, as long as the floating roller 27*r* constituting the friction transport body 27 is in the substantially orthogonal direction to the travel direction, it is not technically inevitable to set the angle strictly. In other words, the angle can be approximately 90 degrees with respect to the travel direction of the friction transport body. Then, the rotating shaft angle of the floating roller 27*r* is set at angles in the range in which friction drag acting on the sheet surface in the travel direction of the friction transport body and the orthogonal direction is set to be large in the former while being small in the latter. In addition, herein, the friction drag is referred to as a resistance force by friction acting on a substance (the same as friction drag in hydrodynamics), and when the friction drag is small, the substance shifts in the direction freely.

In addition, the travel motor M3 is an angle control-capable motor such as a stepping motor and DC motor provided with an angle control mechanism such as an encoder. Then, by detecting a flag disposed in the motor rotating shaft with a sensor (not shown), the angle is set at a home position.

Figure 10A:
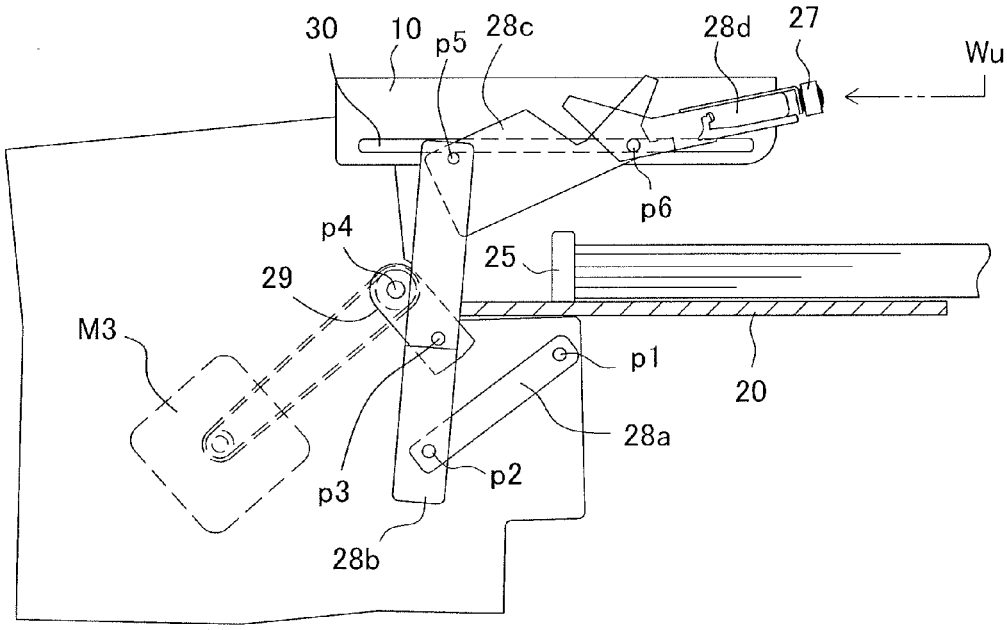
FIG. 10A is a view illustrating an operation state of a transport body travel means 28 and shows a home position.
Figure 10B:
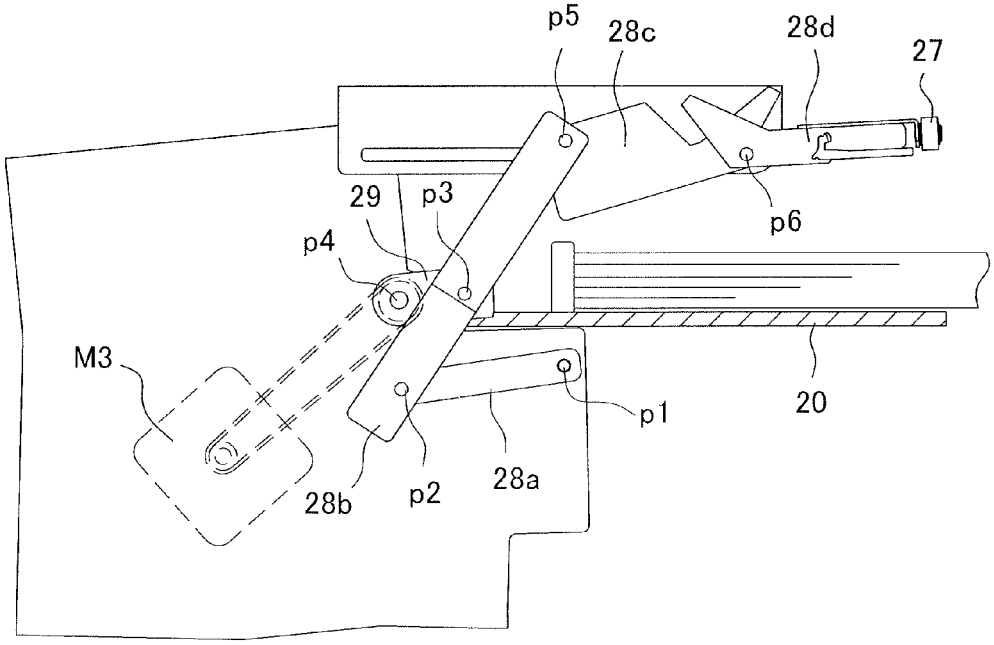
FIG. 10B is a view illustrating another operation state of the transport body travel means 28 and shows a state in which a drive motor is rotated in a counterclockwise direction (about 90 degrees in the figure)

FIGS. 10A, 10B, 11A, 11B, 12A and 12B show operation states of the transport body travel means 28. FIG. 10A shows a home position, and the friction transport body 27 is positioned in a state of retracting above the uppermost sheet of the side end support member 20. At this point, the drive arm 29 is positioned at about 120 degrees in the state as shown in the figure. The angle of the drive arm does not have any technical relationship with motion of the transport body travel means 28, but is shown to describe link motion. FIG. 10B shows a state in which the travel motor M3 is rotated in a counterclockwise direction (about 90 degrees in the figure), and the friction transport body 27 at this point is positioned in a farthest position (right end in FIG. 10B) in the sheet discharge direction above the sheets on the side end support member 20. In other words, the body 27 is positioned in a link coupling state with the inch worm motion extended most.

Figure 11A:
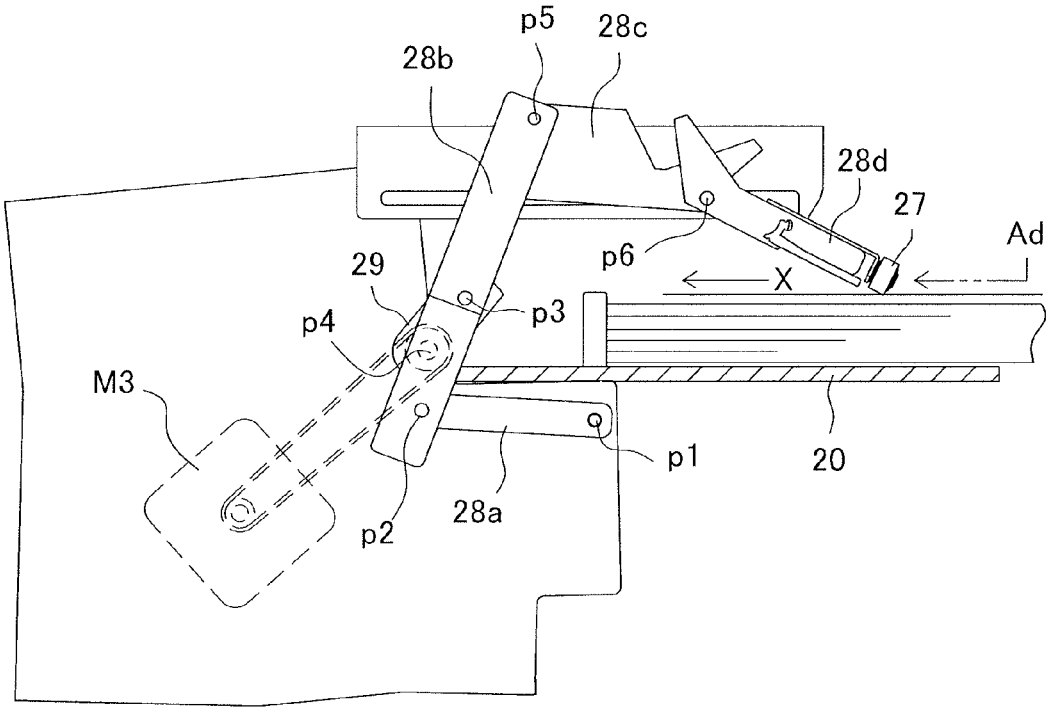
FIG. 11A is a view illustrating still another operation state of the transport body travel means 28 and shows a state of engaging in (contacting) the uppermost sheet.

FIG. 11A shows a state in which the friction transport body 27 engages in (contacts) the uppermost sheet on the side end support member 20, and the drive arm 29 at this point rotates in a counterclockwise direction, and is positioned in an angle position of about 15 degrees. In this state, the biasing spring 31 between the actuation arm 28*d* and the third arm 28*c* provides the friction transport body 27 with the force for pressing the sheet top surface. Then, the spring 31 provides the friction transport body 27 with the almost uniform pressing force irrespective of the thickness of sheets stacked on the side end support member 20.

Figure 11B:
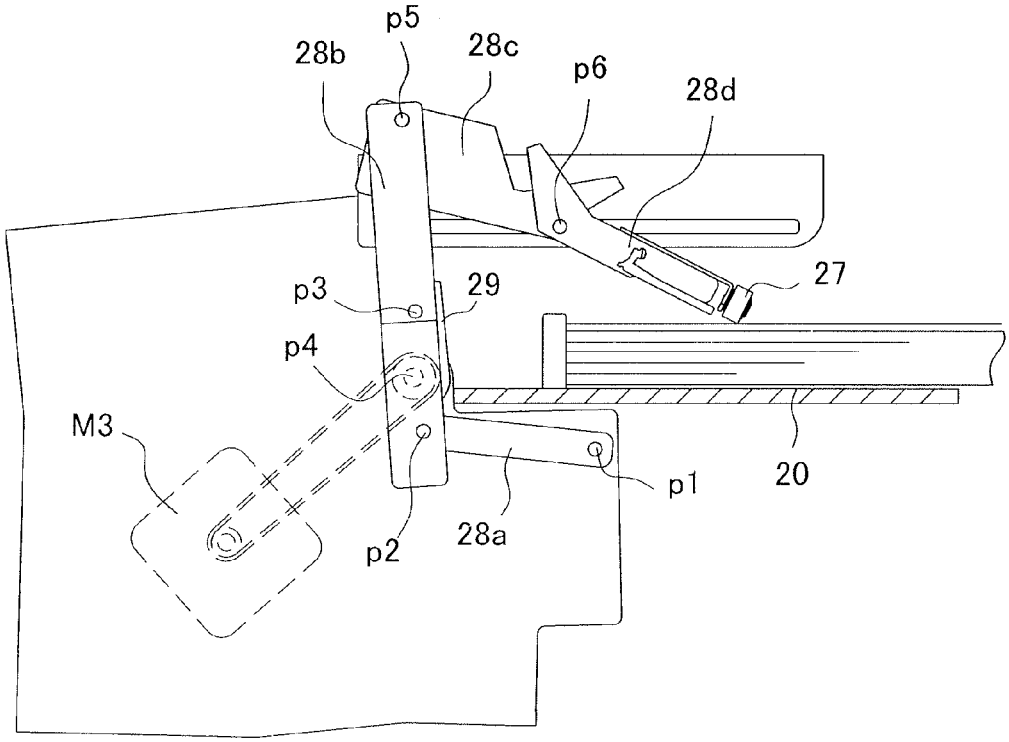
FIG. 11B is a view illustrating still another operation state of the transport body travel means 28 and shows a state in which the drive motor is further rotated in the counterclockwise direction (about 0 degree)

FIG. 11B is the case of rotating the travel motor M3 further in the counterclockwise direction (about 0 degree), and the friction transport body 27 shifts the sheets while dragging in the arrow direction in the figure. The second arm 28*b* and third arm 28*c* at this point are in the most contracted link coupling state. By such operation, the friction transport body 27 contacts the uppermost sheet surface in the state in FIG. 11A, travels and shifts to the position in FIG. 11B along the support surface to drag and transport the sheets, and causes the sheets to strike each regulation stopper. In other words, the friction force in the travel direction of the friction transport body 27 is set at a coefficient of friction allowed to obtain friction sufficiently higher than the friction force between sheets.

Figure 12A:
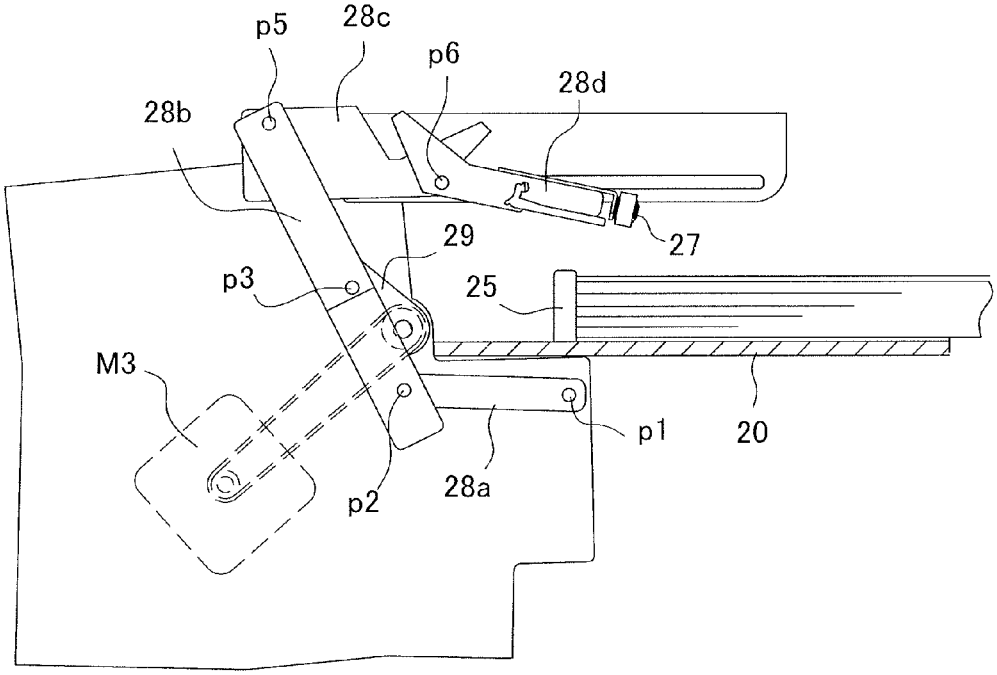
FIG. 12A is a view illustrating still another operation state of the transport body travel means and shows a state of retracting from above the sheet.
Figure 12B:
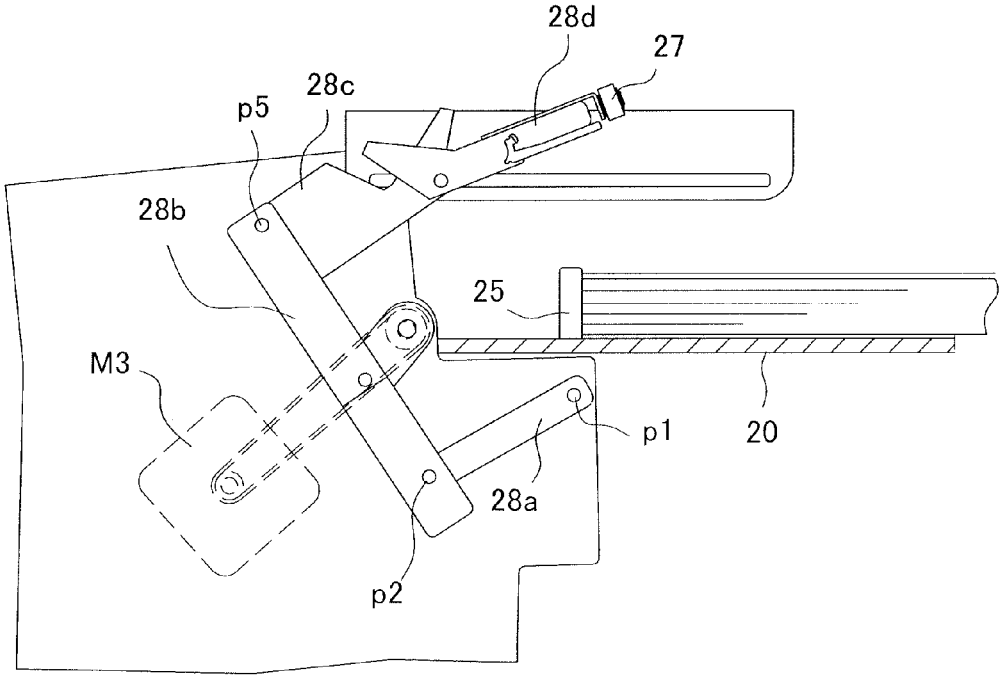
FIG. 12B is a view illustrating still another operation state of the transport body travel means and shows another state of retracting from above the sheets.

FIG. 12A shows a state in which the body 27 separates from the sheet top surface after causing the sheet end to strike the regulation stoppers, and the body 27 shifts to the home position in FIG. 10A via FIG. 12B to wait for carry-in of the next sheet. In addition, among the bunch of sheets aligned by the aligning transport means 26, when the last sheet immediately before discharge (a single sheet in the case of aligning only the single sheet to discharge) is aligned, the motor M3 is stopped in the sheet strike position in FIG. 11B, and the side edge support member 20 and the friction transport body 27 nip the bunch of sheets. In this state, the post-processing (staple processing) is performed on the bunch of sheets in the second sheet discharge mode described later. Meanwhile, in the third sheet discharge mode, the side edge support member 20 is retracted with the bunch of sheets nipped by the side edge support member 20 and the friction transport body 27, then the rear end support member 19 is retracted, and the bunch of sheets is discharged onto the paper mount surface 15*a* of the stack tray 15. Then, the aligning transport means 26 shifts to the home position. In shifting the side edge support member 20 to the waiting position, since the friction transport body 27 presses the sheets, even when the area supported by the side edge support member 20 is small, the sheets do not fluctuate to the sheet width direction (the shift direction of the side edge support member 20).

Figure 13A:
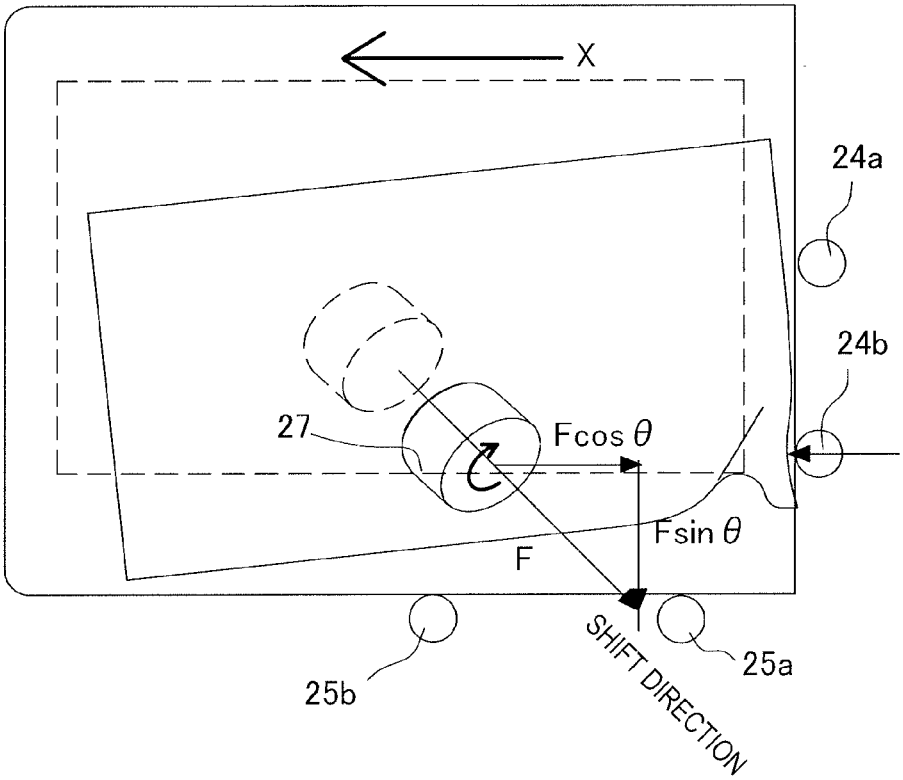
FIG. 13A is an explanatory view illustrating the action of the friction transport body and shows a case of transporting a sheet in a direction (θ=45°) crossing the sheet discharge direction arrow X.
Figure 13B:
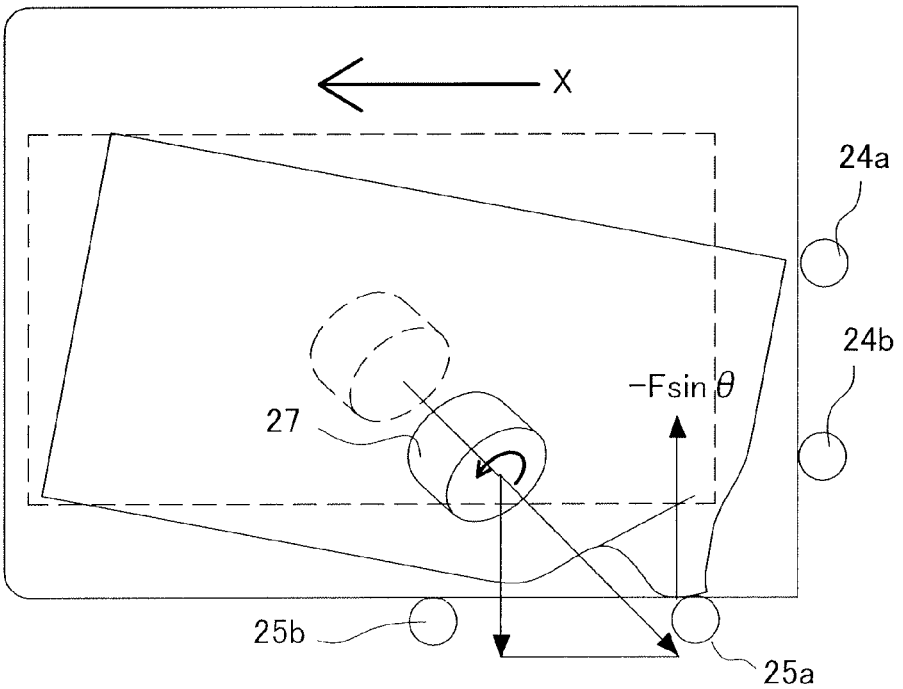
FIG. 13B is another explanatory view illustrating the action of the friction transport body and shows a case where a sheet is transported in a different direction from that in FIG. 13A.

FIGS. 13A and 13B are explanatory views illustrating the action of the friction transport body 27. FIG. 13A shows the case of transporting the sheet in the direction (θ=45 degrees) crossing the sheet discharge direction of the arrow X. Then, when the sheet is shifted from the dashed-line state to the solid-line state shown in the figure, FIG. 13A shows a state in which the sheet rear end edge strikes the rear end regulation stopper 24 first. The transport force F acts on the sheet in the travel direction, the component force (F cos θ) in the X direction acts on the rear end regulation stopper 24, and the component force (F sin θ) in the Y direction acts on the side edge regulation stopper 25 side.

At this point, when the sheet rear end strikes the rear end regulation stopper 24 first as shown in the figure, the reaction force of the X-direction component force (F cos θ) acts on the sheet. Although the sheet buckles and is distorted by the reaction force, the friction transport body 27 rotates in a clockwise direction in the figure. By this rotation, the sheet is prevented from buckling and being distorted due to the reaction force. In addition, by the friction transport body 27 rotating, since the sheet is acted upon by the force in the direction for shifting the sheet to the regulation stopper 25 side, the sheet side edge is struck by the regulation stopper 25 by the friction transport body 27 shifting in the travel direction while rotating after causing the sheet side edge to strike the regulation stopper 24.

Next, FIG. 13B shows the case where the sheet is transported in the different direction from the former direction. FIG. 13B shows a state in which the sheet side edge first strikes the side edge regulation stopper 25 when the sheet is dragged and transported in the direction crossing the sheet discharge direction (the arrow X) shown in the figure. As described previously, the sheet is acted upon by the X-direction component force and the Y-direction component force (F sin θ), the sheet side edge is struck, and the reaction force is conveyed to the sheet. Then, the friction transport body 27 rotates in the counterclockwise direction as shown in the figure, and corrects the posture of the sheet so as to prevent the sheet from buckling and being distorted. In addition, by the friction transport body 27 rotating, since the sheet is acted upon by the force in the direction for shifting the sheet to the regulation stopper 24 side, the sheet rear edge is struck by the regulation stopper 24 by the friction transport body 27 shifting in the travel direction while rotating after causing the sheet side edge to strike the regulation stopper 25. Particularly, when the sheet size is large, the distance by which the friction transport body 27 shifts is long after the sheet side edge is struck by the regulation stopper 25. Accordingly, when the sheet size is large, the rotation amount of the friction transport body is also large, and it is possible to obtain a large force to shift the sheet to the regulation stopper 24 side.

[Sheet Alignment Mechanism in the First Support Member (Rear End Support Member)]

The first support member (rear end support member) 19 as described previously is provided with a support surface to mount and support the rear end portion of the sheet fed from the sheet discharge outlet 13, a paddle mechanism 35 that presses and holds the rear end portion of the sheet, and a push-out mechanism for pushing a bunch of collected sheets toward the tray. Each component will be described below.

[Paddle Mechanism]

Figure 4B:
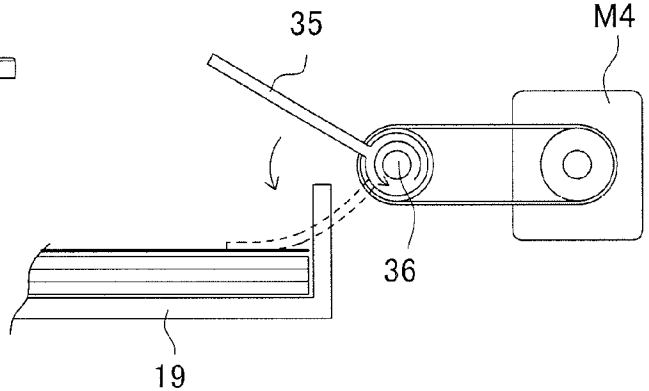
FIG. 4B is an explanatory view of a paddle sheet discharge mechanism of the post-processing apparatus in the system of FIG. 1.

The first support member (rear end support member) 19 is disposed with a height difference formed from the sheet discharge roller 14*b*, and the sheet separated from the roller is supported on the side edge support member 20 in a free state. Then, when the subsequent sheet is fed out of the sheet discharge rollers 14*b*, the sheet front end may cause positional displacement of the sheet that is previously mounted. Therefore, required is a means for pressing the rear end portion of the sheet mounted on the first support member 19 to hold. In the apparatus as shown in the figure, as shown in FIG. 4B, paddle members 35 are disposed above the first support member 19.

As shown in the figure, a plurality of paddle members 35 is attached to a rotating shaft 36 to the left and right in the sheet width direction while being spaced a distance apart. The front end of each of the paddle members 35 is comprised of an elastic member in the length shape for pressing and holding the sheet rear end portion on the support member 19, and the member rotates on the rotating shaft 36. Then, the rotating shaft 36 is coupled to a paddle motor M4, a flag (not shown) for angle detection is provided in any one of transmission rotating shafts, and a position sensor Ps4 is disposed on the apparatus frame 10 side. In addition, an encoder and encoder sensor may be configured as a substitute for the flag.

Then, a control means 50 described later rotates the paddle members 35 in the state of pressing the rear end portion of the preceding sheet to retract from the rear end portion of the sheet, before (before execution of) alignment operation for causing the sheet rear end portion carried out of the sheet discharge outlet 13 to be struck against the rear end regulation stopper 24 by the aligning transport means 26 as described previously. Then, the means 50 halts the paddle motor M4 at timing at which the paddle members 35 press the sheet top surface after the finish of alignment operation for causing the sheet to be struck against the rear end regulation stopper 24 by the aligning transport means 26.

[Push-Out Mechanism]

In the first support member (rear end support member) 19 as described previously are disposed the rear end regulation stopper 24 to position the sheet in a predetermined processing position, and the aligning transport means 26 as described previously to shift the sheet toward the stopper. Then, the sheets collected in the shape of a bunch on the support members 19, 20 undergo post-processing by the binding processing apparatus or the like, and then, are carried out toward the stack tray 15. Therefore, a pusher means 37 to push the bunch of sheets subjected to the post-processing toward the stack tray 15 is disposed in the first support member 19.

FIGS. 5A and 5B show the pusher means 37. The pusher means 37 is comprised of a slide member (pusher member, sheet press member) 38 supported by the first support member (rear end support member) 19 to be slidable, the bent piece 39 (pusher member; the same as in the following description) provided at the front end of the slide member 38, and the rear end contact surface (paper press surface) 39*s* formed in the bent piece. The rear end contact surface 39*s* engages in the sheet rear end on the first support member.

The slide member (sheet press member) 38 shown in the figure is fitted into a guide groove 40 formed in the first support member (rear end support member) 19, and is configured so that the rear end contact surface (paper press surface) shifts back and forth by a predetermined distance in the sheet discharge direction. A rack 38*r* is attached to the base end portion of the slide member 38, a pinion 38*p* engaging therein is attached to the apparatus frame 10, and a pusher motor M5 is coupled to the pinion 38*p*. Then, in mounting and supporting sheets fed from the sheet discharge outlet 13 on the support member 19, the control means 50 described later causes the rear end contact surface 39*s* to wait in a position retracted from the rear end regulation stopper 24, and starts the pusher motor M5 with a job end signal of the post-processing. Then, the slide member 38 shifts in the direction of the stack tray 15 from the waiting position (retract position) Wp in the sheet discharge direction. At this point, the rear end contact surface engages in the rear end of the bunch of sheets, and pushes the bunch toward the stack tray 15. In addition, the rack 38*r*, pinion 38*p* and pusher motor M5 constitute a push shift means 39.

Then, when the rear end contact surface (paper press surface) 39*s* shifts to a predetermined position, the control means 50 halts the pusher motor M5, and next, shifts the support member 19 from the actuation position Ap above the stack tray 15 to the waiting position (retract position) Wp retracted to outside the stack tray 15. By this operation, the bunch of sheets is dropped on the paper mount surface 15*a* of the stack tray 15 and is stored.

Figure 3B:
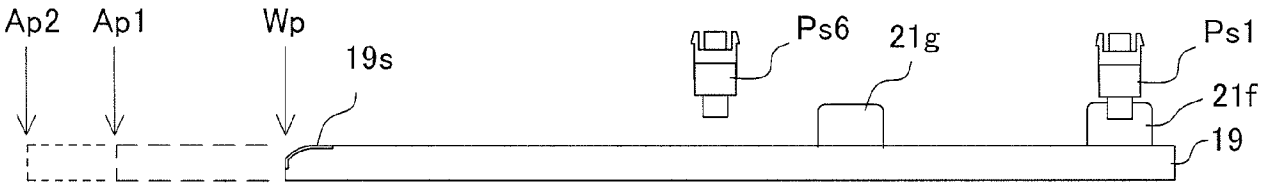
FIG. 3B is an explanatory view illustrating a shift amount of a tray while illustrating operation of a rear end support member in the post-processing apparatus in the system of FIG. 1.

In addition, in the first sheet discharge mode described later, the apparatus as shown in the figure uses the first support member (rear end support member) 19 as an assist means for carrying out the sheet to the paper mount surface 15*a* from the sheet discharge outlet 13 in cooperation with the sheet discharge rollers 14*b*. More specifically, this Embodiment is characterized in that the first support member 19 is configured as a movable guide means (hereinafter, referred to as a "movable guide 19") that carries out the sheet from the sheet discharge outlet 13 to the paper mount surface 15*a* in cooperation with the sheet discharge rollers 14*b*. Therefore, as shown in FIG. 3B, in the rear end support member 19 described previously is formed a sheet engagement surface 19S that engages in the lower surface of the sheet traveling toward the paper mount surface 15*a* from the sheet discharge outlet 13. As shown in FIG. 3B, in the plate-shaped first support member (movable guide) 19, the sheet engagement surface 19S is provided at its front end portion (part protruding to the paper mount surface 15*a*), and in the member shown in the figure, the support member itself of a synthetic resin, metal or the like constitutes the sheet engagement surface 19S. Moreover, as the sheet engagement surface 19S, a soft pad with relatively high friction such as a resin, rubber material and cork may be embedded in the support member surface. In any configuration, it is preferable that the sheet engagement surface 19S is provided with a coefficient of friction to shift the sheet in the sheet discharge direction and softness of the extent to which the sheet lower surface does not sustain damage.

Thus, in this Embodiment, as shown in FIGS. 3A, 5A and 5B, the apparatus is provided with the sheet carry-in path 11 having the sheet discharge outlet 13, stack tray 15 having the paper mount surface 15*a* spaced the height difference h apart in the height direction from the sheet discharge outlet 13, sub-tray 18 disposed between the sheet discharge outlet 13 and the paper mount surface 15*a* to temporarily support at least the rear end portion (rear edge and side edge) of a sheet fed from the sheet discharge outlet 13, tray shift means 21, 22 for shifting the position of the sub-tray 18 between the actuation position Ap inside the paper mount surface 15*a* and the retract position Wp outside the paper mount surface 15*a*, rear end regulation surfaces 16, 17 disposed in the stack tray 15 to regulate the end edge of sheets loaded on the paper mount surface 15*a*, sheet push member 38 having the paper press surface 39*s* engaging in the rear end surface of a bunch of sheets supported on the sub-tray 18, pusher shift means 39 for shifting the position of the sheet push member 38 between the retract position Wp in which the paper press surface 39*s* is retracted to the outside of the paper mount surface 15*a* and the actuation position Ap protruding to the inside of the paper mount tray 15*a*, and control means 50 for controlling the tray shift means 21, 22 and the pusher shift means 39.

Figure 17A:
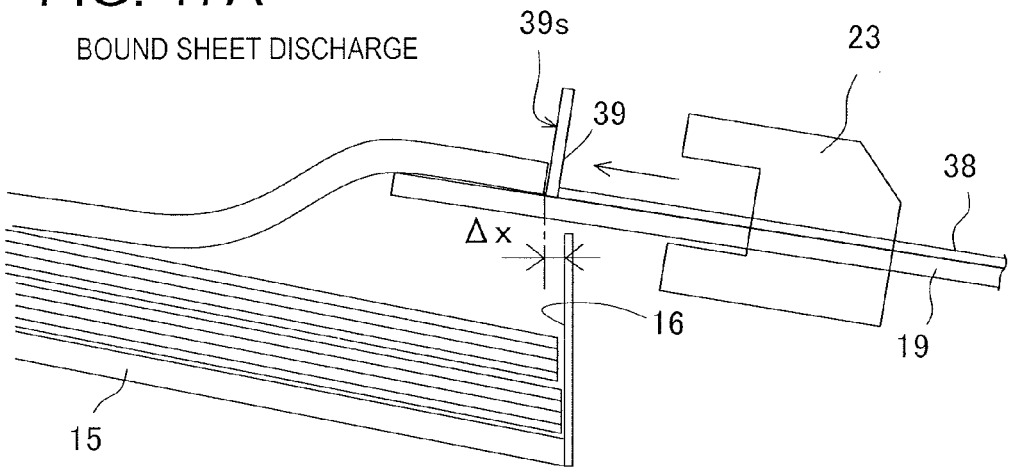
FIG. 17A is an explanatory view on a series of sheet discharge operation for storing sheets on the stack tray after collecting the sheets on the sub-tray and performing binding processing, and shows a state of shifting the bunch of sheets from a post-processing position to the stack tray side.
Figure 17B:
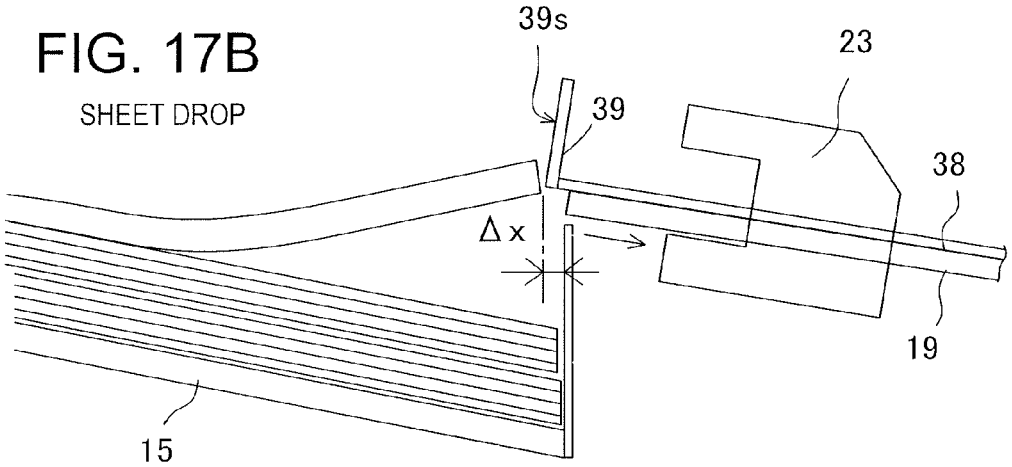
FIG. 17B is another explanatory view on a series of sheet discharge operation for storing sheets on the stack tray after collecting the sheets on the sub-tray and performing binding processing, and shows a state of dropping the bunch of sheets that is carried to above the stack tray on the uppermost sheet on the paper mount surface.
Figure 17C:
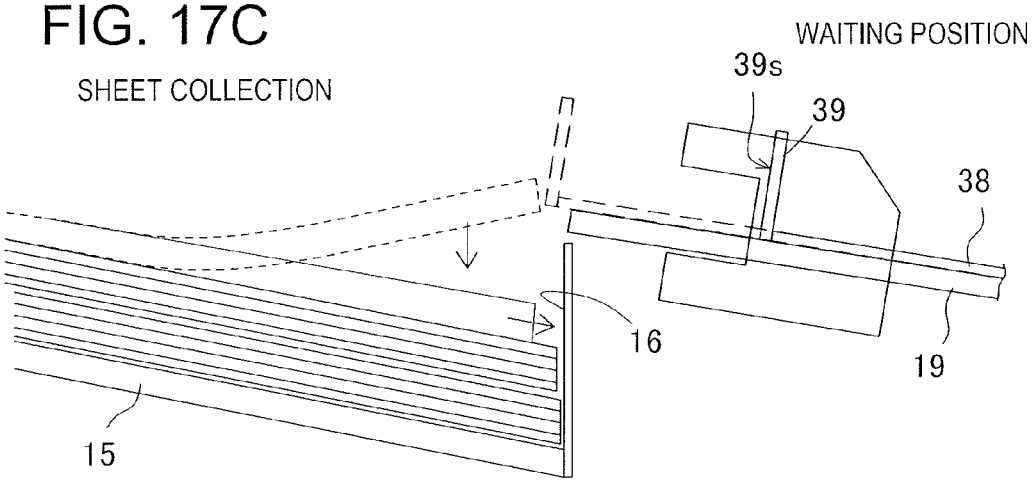
FIG. 17C is another explanatory view on a series of sheet discharge operation for storing sheets on the stack tray after collecting the sheets on the sub-tray and performing binding processing, and shows a state in which the bunch of sheets drops onto the stack tray.

Further, as shown in FIGS. 17A, 17B and 17C, the actuation position Ap of the sheet push member 38 is set at the position such that the paper press surface 39*s* forms a distance from the rear end regulation surface 16 to protrude to the paper mount surface 15*a* side.

As shown in FIGS. 5A and 5B, when the rear end support member 19 protrudes from the rear end regulation surface 16 to the inside of the stack tray 15 by Dx and is in the actuation position Ap, while the side edge support member 20 protrudes from the side edge regulation surface 17 to the inside of the stack tray 15 by Dy, image formation-processed sheets S are loaded sequentially.

Then, when the predetermined number of sheets is loaded in a state in which the sub-tray 18 (rear end support member 19, side edge support member 20) protrudes to the inside of the paper mount tray 15*a*, the control means 50 performs the post-processing (staple binding processing) with the post-processing unit 23.

Next, the control means 50 controls the pusher shift means 39 so that the paper press surface 39*s* of the sheet push member 38 is retracted from the actuation position Ap to the retract position Wp outside the stack tray 15.

In addition, the height difference Δx between the paper press surface 39*s* and the rear end regulation surface 16 in the actuation position Ap of the sheet push member 38 is capable of being set at a different distance position corresponding to the material, size, weighing or the like of the sheet S. Accordingly, the control means 50 changes the rotation amount of the pusher motor M5 constituting the pusher shift means 39 corresponding to the property of the sheet fed from the sheet discharge outlet 13.

Further, when the sheet fed from the sheet discharge outlet 13 is a thinner sheet or weaker than a normal sheet as a reference and is of property easy to become distorted from the input information from an input means (touch panel type of liquid crystal screen or the like provided in the image formation apparatus A), it is desirable that the control means 50 sets the actuation position Ap at a distance position such that the height difference Δx is formed to be larger (sets the height difference in the sheet discharge direction to be larger in a sheet easy to become distorted while setting the height difference to be smaller in a strong sheet).

Furthermore, it is possible to set the height difference Δx between the paper press surface 39*s* and the rear end regulation surface 16 in the actuation position Ap of the sheet push member 38 at a different distance position corresponding to the load amount of sheets loaded on the paper mount surface 15*a*. At this point, the control means 50 changes the rotation amount of the pusher motor M5 constituting the pusher shift means 39 with a signal from a load amount identifying means (number-of-sheet counter, weight sensor, height sensor or the like) that identifies the load amount of sheets S loaded on the paper mount surface 15*a*.

For example, when the load amount identifying means is comprised of a counting means (counter) that counts the number of sheets carried out of the sheet discharge outlet 13, the control means 50 sets the height difference of the actuation position Ap at a different distance position stepwise corresponding to the count number from the counting means.

More specifically, when the sheet load amount is large, in other words, when the difference in height between the sheet discharge outlet 13 and the uppermost paper surface is small, the height difference is set to be large (so as to push without being caught).

Further, the first shift means 21 described previously constitutes a guide means for causing the first support member (movable guide) 19 to reciprocate between the actuation position Ap above the paper mount surface 15*a* and the retract position Wp retracted therefrom. Hereinafter, the first guide means 21 described previously is described as the "guide shift means". As shown in FIGS. 3A, 5A and 5B, the guide shift means 21 is comprised of the rack 21*r*, pinion 21*p* and first shift motor SM1, and the first support member (movable guide) 19 having the sheet engagement surface 19S is supported to be able to reciprocate between the actuation position Ap above the paper mount surface 15*a* and the retract position Wp retracted from the paper mount surface 15*a*. The support structure is configured by fitting (not shown) a guide roller into the guide rail formed in the apparatus frame 10 to reciprocate in the left and right direction in FIG. 3A.

Then, as shown in FIG. 3A, the first support member (movable guide) 19 reciprocates in the order of the retract position Wp, first actuation position Ap1 and second actuation position Ap2. The retract position Wp is set at a position in which the sheet engagement surface 19S is retracted to outside the tray. The first actuation position Ap1 is set at a position in which the sheet nipped by the sheet discharge rollers 14*b* forms a predetermined angle (see FIG. 14B). Further, the second actuation position Ap2 is set at a position in which the sheet rear end shifts from the first actuation position Ap1 in the sheet discharge direction by a predetermined amount Δk (see FIG. 15A). The shift amount Δk is set at a position in which the sheet rear end is offset to inside the tray from the periphery of the sheet discharge roller 14*b* (lower roller positions on the paper mount surface side).

Further, in the first support member (movable guide) 19 are formed a sensor flag 21*g* to detect the actuation position Ap1, and a sensor flag 21*f* to detect the retract position Wp, and in the apparatus frame 10 are disposed the position sensor Ps1 to detect the flag 21*f* and a position sensor Ps6 to detect the sensor flag 21*g*. In the flags and sensors, the sensor Ps1 detects the flag 21*f* to determine that the first support member 19 is in the home position that is the retract position, and the sensor Ps6 detects the flag 21*f* to determine that the first support member 19 is in the first actuation position Ap1.

Furthermore, the first shift motor SM1 is rotated predetermined pulses from a detection signal of the sensor Ps6 to shift the first support member (movable guide) 19 to the second actuation position Ap2. Thus, the first support member 19 reciprocates in the order of the retract position Wp, first actuation position Ap1 and second actuation position Ap2 by the first shift motor SM1 (stepping motor).

Moreover, the control means (sheet discharge control means) 50 described later is configured to shift the sheet engagement surface 19S by a predetermined amount in the sheet discharge direction while engaging in the sheet lower surface after the sheet rear end separates from the sheet discharge rollers 14*b*, and then, move the sheet engagement surface 19S backward toward the retract position. This control is performed by controlling the rotation amount of the first shift motor SM1.

The configuration of the first support member means (movable guide means) 19 will specifically be described below according to FIGS. 14A, 14B and 14C and FIGS. 15A, 15B and 15C.

Figure 14A:
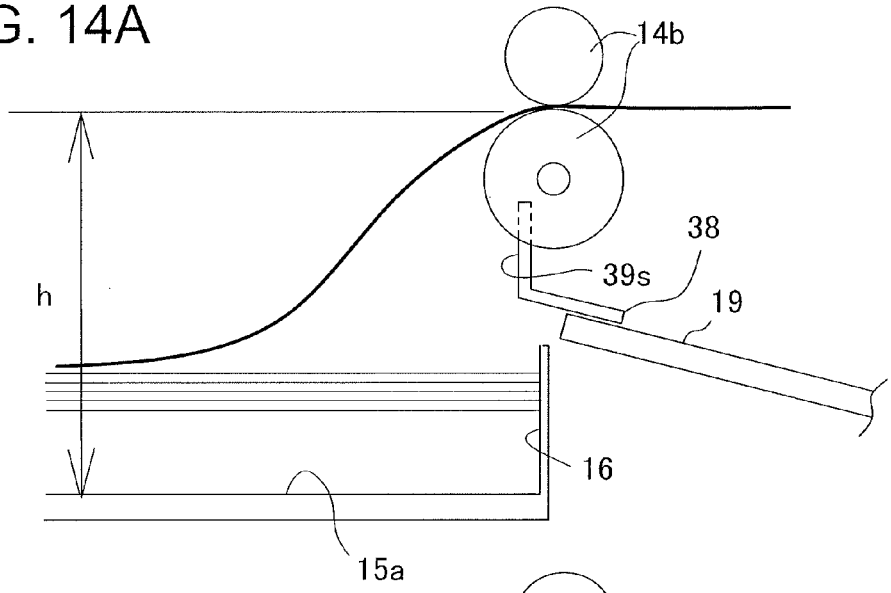
FIG. 14A is an operation explanatory view of a movable guide means and shows a case where a movable guide is not disposed.

FIG. 14A shows the case of discharging the sheet without the first support member (movable guide) 19 being disposed between the sheet discharge rollers 14*b* and the paper mount surface 15*a*. In this case, the front end of the sheet discharged from the sheet discharge roller 14*b* is curved while rubbing on the loaded sheets on the paper mount surface 15*a* as shown in the figure. In the usual tray configuration, the sheet is curved in the shape of an inverse S, and is carried out starting at the front end then the rear end. At this point, the sheet rear end separated from the roller nip point remains on the roller peripheries as shown in the dashed lines in the figure. In this phenomenon, when the sheet is weak, or static electricity occurs between the loaded sheets and the carrying-out sheet, transport resistance is large in the sheet front end portion, and the sheet rear end jams while being caught by the roller peripheries.

Figure 14B:
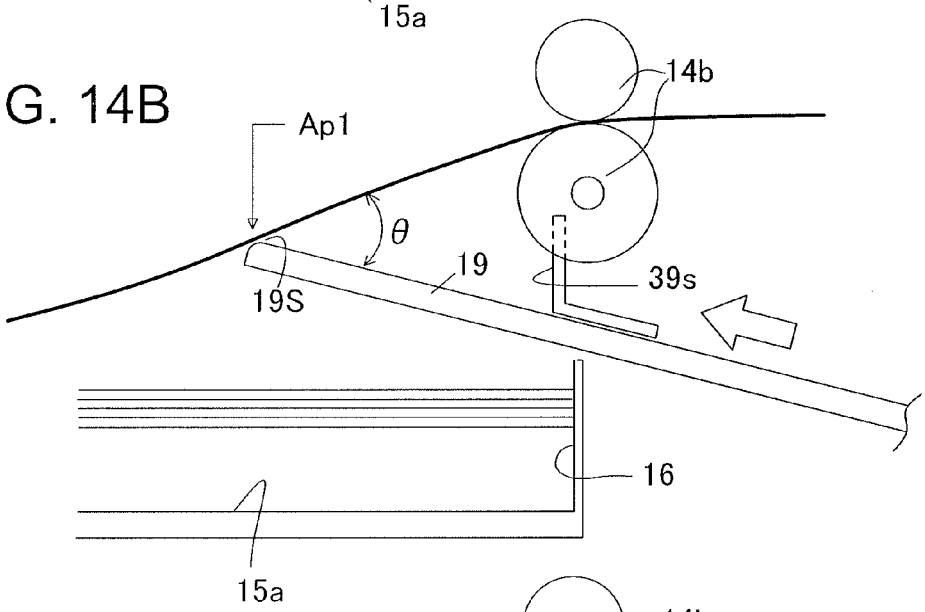
FIG. 14B is another operation explanatory view of the movable guide means and shows a state in which the means is in a first actuation position.

FIG. 14B shows a state in which the first support member (movable guide) 19 is shifted to the first actuation position Ap1. At this point, the sheet engagement surface 19S engages in the lower surface of the sheet fed by the sheet discharge rollers 14*b*, and holds its height position at the state of angle θ as shown in the figure. Accordingly, the sheet fed onto the paper mount surface 15*a* by the sheet discharge rollers 14*b* is in an almost linear sheet shape between the roller nip point and the sheet engagement surface 19S, and the transport force of the rollers is conveyed to the sheet front end portion. By this means, the sheet is reliably fed onto the paper mount surface 15*a*. Then, in carrying out the sheet by the sheet discharge rollers 14*b*, since the sheet rear end is supported by the first support member 19, even when friction resistance such as static electricity acts on between the sheet front end and loaded sheets on the paper mount surface 15*a*, the posture of the sheet rear end is maintained linearly between the roller nip point and the first support member 19, the transport force of the rollers acts on the sheet rear end, and it is thereby possible to carry out the sheet reliably.

Figure 14C:
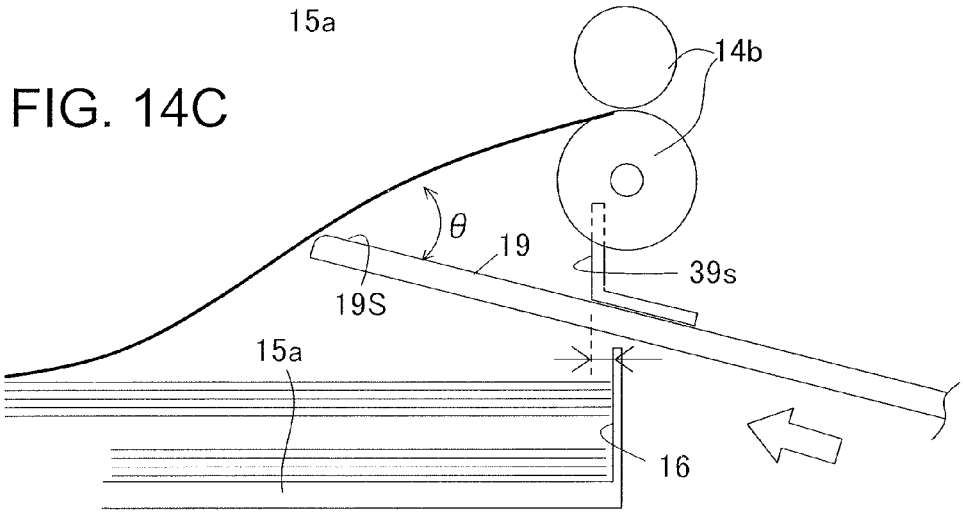
FIG. 14C is another operation explanatory view of the movable guide means and shows a state in which a sheet rear end is separated from a roller nip point.

FIG. 14C shows the initial state in which the sheet rear end separates from the roller nip point, the sheet front end is on the uppermost sheet on the paper mount surface 15*a*, the sheet rear end portion is supported in the first actuation position (guide position) of the first support member (movable guide) 19, and the sheet rear end edge is positioned in the state engaging in the periphery of the sheet discharge roller 14*b*.

Figure 15A:
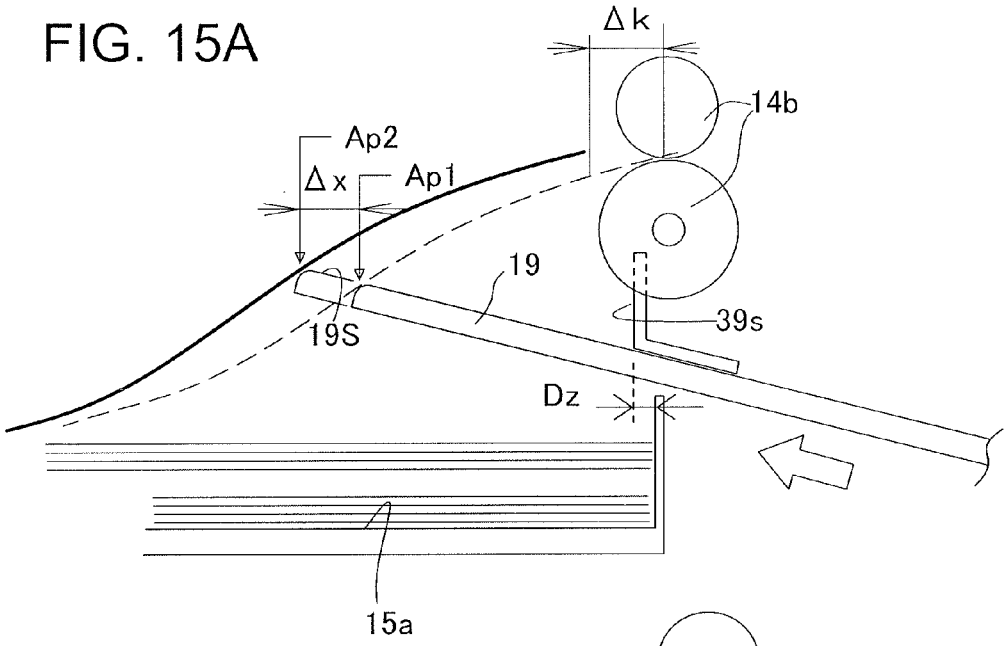
FIG. 15A is still another operation explanatory view of the movable guide means and shows a state in which the means shifts from the first actuation position to a second actuation position.

FIG. 15A shows a state in which the first support member (movable guide) 19 is shifted from the first actuation position Ap1 to the second actuation position Ap2. By the shift from the actuation position Ap1 to the second actuation position Ap2, the sheet is fed out in a transport direction by a predetermined amount. The shift distance Δx is set at a position such that the sheet rear end separates from the periphery of the sheet discharge roller 14*b*.

Figure 15B:
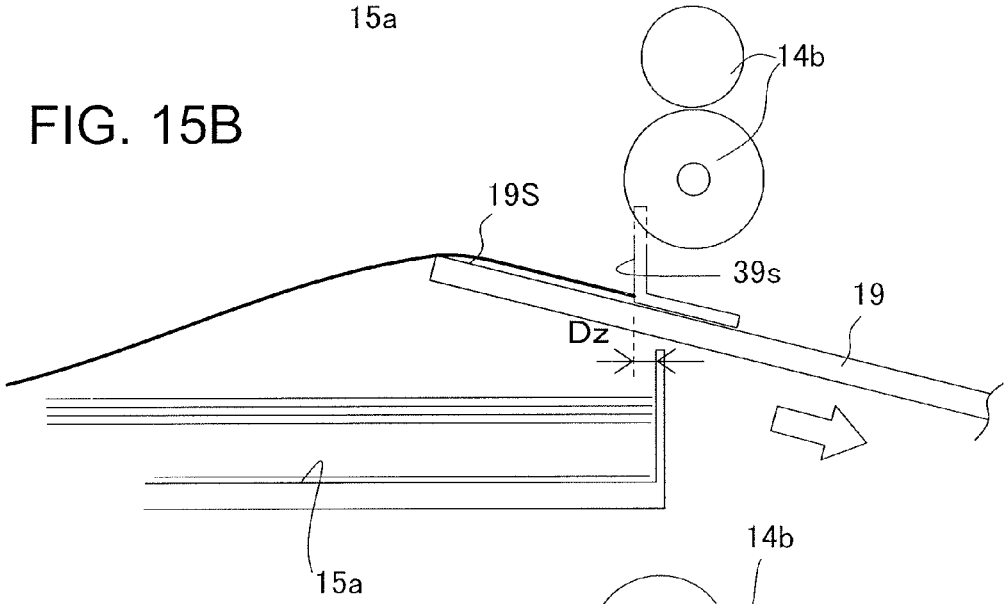
FIG. 15B is still another operation explanatory view of the movable guide means and shows a state in which the means shifts backward to a retract position.

FIG. 15B shows a state in which the first support member (movable guide) 19 is shifted backward from the second actuation position Ap2 to the retract position Wp side. After the sheet engagement surface 19*s* of the first support member 19 hits the sheet lower surface, the sheet rear end portion drops onto the first support member 19. In this state, while the sheet rear end edge is struck against the rear end contact surface 39*s* formed in the bent piece 39 provided at the front end of the slide member 38, the first support member 19 is shifted to the retract position Wp side.

Figure 15C:
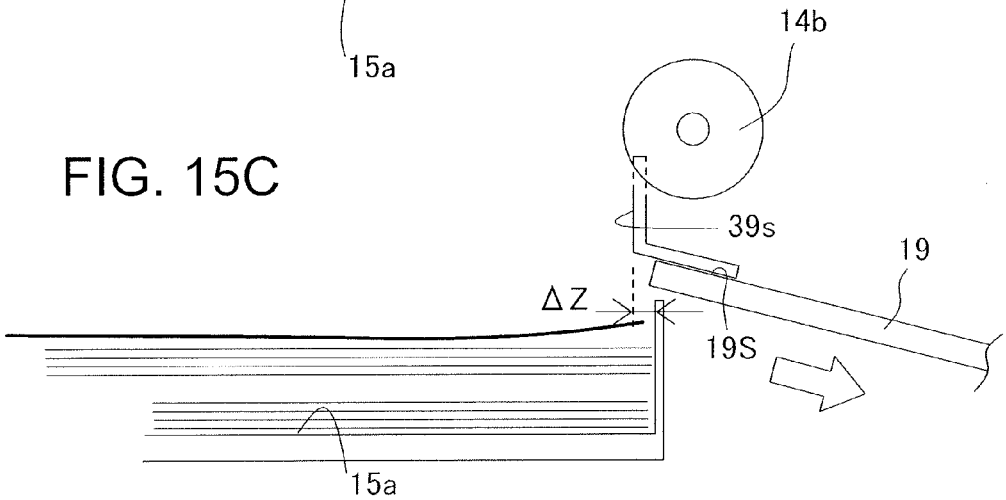
FIG. 15C is still another operation explanatory view of the movable guide means and shows a state in which the sheet rear end drops onto a paper mount surface.

FIG. 15C shows a state in which the sheet rear end drops onto the paper mount surface 15*a*, and after the sheet engagement surface 19S is retracted to outside the tray, the sheet fed from the sheet discharge outlet 13 drops onto the paper mount surface under its own weight. At this point, since the sheet rear end is struck against the rear end contact surface 39*s*, the rear end contact surface 39*s* guides the sheet rear end in dropping the sheet rear end, the contact surface forms a height difference for protruding to the inside of the tray with respect to the rear end regulation surface 16, and therefore, the sheet is not caught on the regulation surface 16 and is stored smoothly on the uppermost sheet on the paper mount surface 15*a*.

Figure 26A:
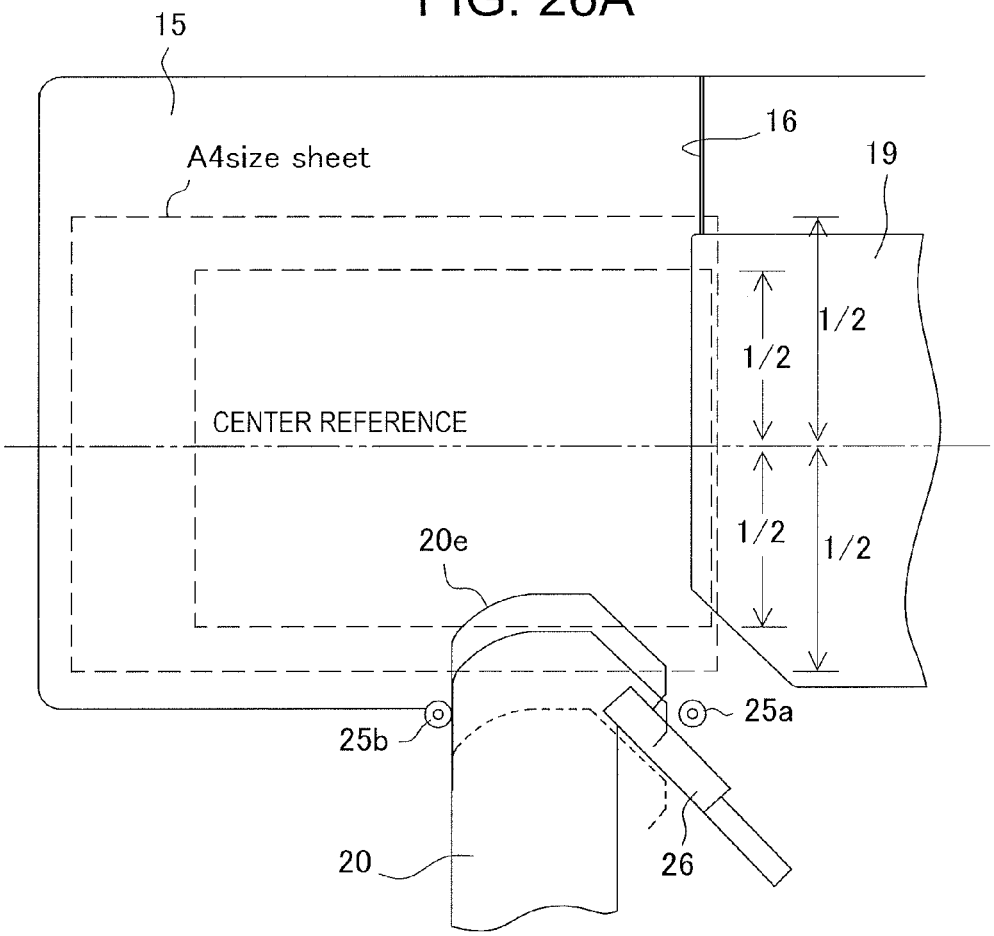
FIG. 26A is an explanatory view illustrating a regulation state of the sheet side edge in directly carrying out a sheet from the sheet discharge outlet to the stack tray (first sheet discharge mode, and the third sheet discharge mode in Embodiment 1), and is an explanatory view of a state of carrying out the sheet from the sheet discharge outlet to the paper mount surface.
Figure 26B:
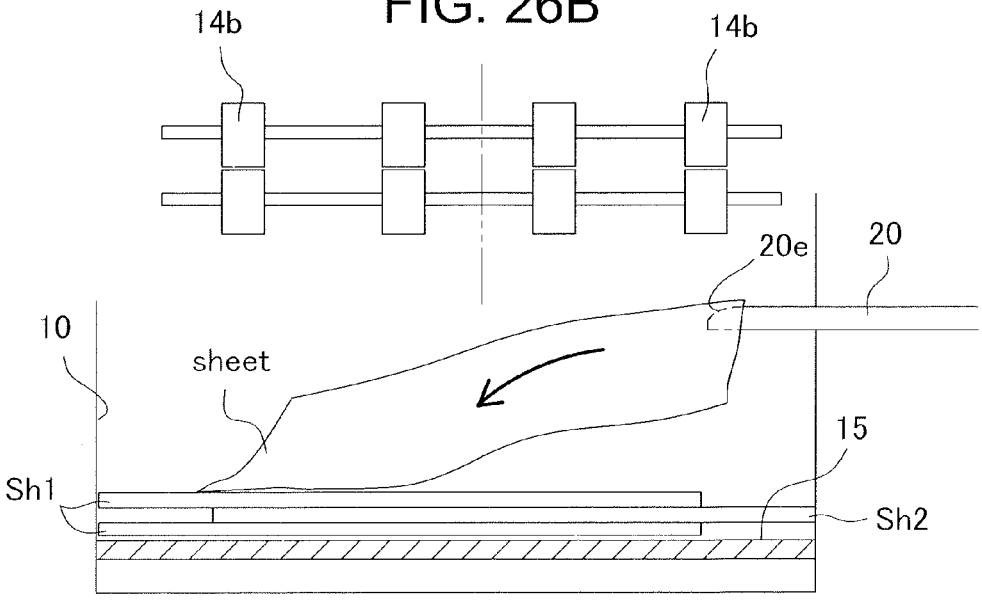
FIG. 26B is another explanatory view illustrating the regulation state of the sheet side edge in directly carrying out the sheet from the sheet discharge outlet to the stack tray (first sheet discharge mode, and the third sheet discharge mode in Embodiment 1), and is an explanatory view of a state in which sheets are collected in a stacked shape on the paper mount surface.

This Embodiment is characterized in that in the side edge support member 20 is formed an end surface guide 20*e* positioned on the tray paper mount surface side, and that in the first discharge mode described later, the end surface guide 20*c* regulates the position of the side edge of the sheet that is carried out. The configuration will specifically be described below. As shown in FIGS. 26A and 26B, the side edge support member 20 (the member shown in the figure is disposed in a portion on the right side of the sheet to carry out, but the member may be disposed on the left side) is comprised of a plate member of metal, nonmetal resin or the like. Then, the plate surface is comprised of an almost horizontal plane to mount a sheet carried out from the sheet discharge outlet 13, its side end surface is comprised of a plate-shaped thick edge surface, and the end surface guide 20*e* is formed on the plate-shaped end surface.

As described previously, the second rack 22*r* is integrally formed in the side edge support member 20, the second pinion meshing therewith is coupled to the second shift motor SM2, and the motor SM2 is comprised of a stepping motor, Then, as shown in FIGS. 5A and 5B, the second sensor flag 22*f* and second position sensor Ps2 are disposed in the side edge support member 20 to detect whether or not the side edge support member 10 is positioned in the home position (the position shown in the figure is the retract position). Concurrently therewith, in the side edge support member 20 are formed a third sensor flag 22*g* and seventh position sensor Ps7, the third flag 22*g* is integrally formed in the side edge support member 20, and the position sensor Ps7 is fixed to the apparatus frame 10.

Then, the apparatus as shown in the figure has apparatus specifications for carrying out A4-size sheet, latter-size sheet and legal-size sheet from the sheet discharge outlet 13. In relation thereto, the position sensor Ps7 detects the sensor flag 22*g*, and the position relationship is set to position the end surface guide 20*e* of the side edge support member 20 in the side edge position (or the defined position in the vicinity thereof) of the first-size sheet. By this means, in discharging the sheet on a sheet-by-sheet basis in the first sheet discharge mode described later, as shown in FIG. 26B, the end surface guide 20*e* of the side edge support member 20 supports one of sheet side edges, the other sheet side edge hangs under its own weight, and the sheet is acted upon by the force for shifting the sheet in the direction (leftward in FIG. 26B) away from the side edge support member 20 in the sheet-discharge orthogonal direction, is offset in the sheet-discharge orthogonal direction and is dropped.

In such a configuration, the sheet discharge control means 50 detects the second sensor flag 21*f* using the second position sensor Ps2, and controls the position of the side edge support member 20 to the home position. In a similar manner thereto, the means 50 detects the third sensor flag 22*g* using the seventh position sensor Ps7, and is capable of positioning the side edge support member 20 so that the end surface guide 20*e* coincides with the predetermined defined position.

In addition, as shown in FIGS. 5A and 5B, the end surface guide 20*e* is formed in the shape of a semicircular arc in which the front end in the sheet discharge direction is curved. The reason is that the side edge position of the sheet fed from the sheet discharge outlet 13 causes a position error by the cause of dimensional error, skew in the path, register or the like, and that the curved end guide surface 20*e* is always made engaging in the sheet end surface with the error of the sheet side edge position. Accordingly, the end surface guide 20*e* is not limited to the shape of an arc, and can be the shape of having an inclined surface.

[Position of the Support Member and the Position Detection Sensor]

Figures 8A, 8B, 8C:
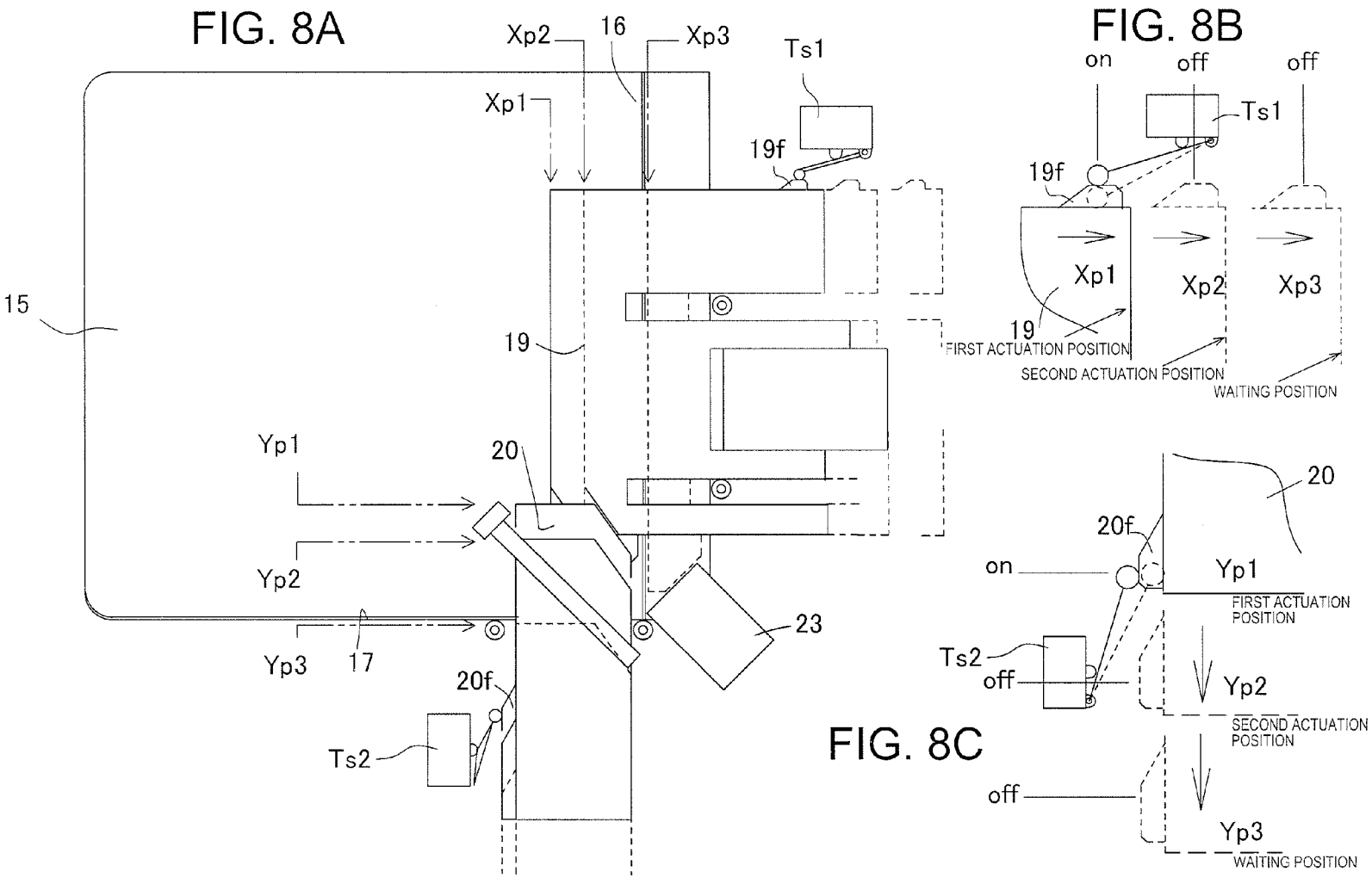
FIG. 8A illustrates the entire configuration of position control in sheet discharge operation of rear end support member and side end support member.
FIG. 8B illustrates a tray position detection means of the rear end support member.
FIG. 8C illustrates a tray position detection means of the side end support member.

FIGS. 8A, 8B and 8C illustrate position control of the rear end support member 19 and side edge support member 20. The rear end support member 19 is set for the position in the sheet discharge direction among three positions (that may be four or more) of the first actuation position Xp1, second actuation position Xp2 and waiting position Xp3. The first actuation position Xp1 is a position (maximum protruding position) for most protruding to the inside of the tray from the rear end regulation surface 16 in the sheet discharge direction to support the maximum area of the sheet fed from the sheet discharge outlet 13 above the paper mount surface 15*a*. In the first actuation position Xp1, the rear end support member is set for the position to execute the staple processing mode (second sheet discharge mode) described later.

The second actuation position Xp2 is a position for protruding to the tray center from the rear end regulation surface 16 by a predetermined amount to mount and support the sheet fed from the sheet discharge outlet 13 above the tray paper mount surface 15*a*. The sheet support area at this point is a smaller area than that in the first actuation position Xp1. In the second actuation position Xp2, the rear end support member is set for the position to execute the jog sort mode (third sheet discharge mode) described later.

The waiting position Xp3 is set at a position retracted to outside the tray from the rear end regulation surface 16, and to store the sheets undergoing the post-processing in the first and second actuation positions Xp1 and Xp2 on the tray paper mount surface 15*a*, the rear end support member 19 positioned above the paper mount surface is retracted from above the paper mount surface.

As shown in FIGS. 8A, 8B and 8C, the side end support member 20 is supported to be able to shift to the position among the first actuation position Yp1, second actuation position Yp2 and waiting position Yp3, and is controlled in the position by the second shift motor SM1 and position sensor Ps2 (home position sensor) as described previously. The first actuation position Yp1 is a position (maximum protruding position) for most protruding to the inside of the tray from the side end regulation surface 17 in the sheet-discharge orthogonal direction to support the sheet fed from the sheet discharge outlet 13 above the paper mount surface 15*a*. In the first actuation position Yp1, the side end support member 20 is set for the position to execute the staple processing mode (second sheet discharge mode) described later, and supports the sheet with the maximum area as compared with the second actuation position Yp2.

The second actuation position Yp2 is a position for protruding to the tray center from the side edge regulation surface 17 by a predetermined amount to mount and support the sheet fed from the sheet discharge outlet 13 above the tray paper mount surface 15*a*. The sheet support area at this point is a smaller area than that in the first actuation position Yp1. In the second actuation position Yp2, the side end support member 20 is set for the position to execute the jog sort mode (third sheet discharge mode) described later.

The waiting position Yp3 is set at a position retracted to outside the tray from the side edge regulation surface 17, and to drop and store the sheets undergoing the post-processing in the first and second actuation positions Yp1 and Yp2 on the tray paper mount surface 15*a*, is set at the position for retracting the side end support member 20 positioned above the paper mount surface from above the paper mount surface.

As described above, the rear end support member 19 is set to reciprocate among the first and second actuation positions Xp1, Xp2 and waiting position Xp3 above the paper mount surface 15*a*, and the side end support member 20 is set to reciprocate among the first and second actuation positions Yp1, Yp2 and waiting position Yp3 above the paper mount surface. Then, position settings are made to position in the first actuation position in the staple processing mode (second operation mode) described later and to position in the second actuation position in the jog sort mode (third operation mode). Described below are the reasons why the sheet support positions of the rear end support member 19 and side end support member 20 are thus set at different positions between the staple processing mode and the jog sort mode.

The first reason is that the area (distance from the regulation surface) to support the sheet is set to be large in the staple processing mode, while being set to be small in the jog sort mode, the bunch of sheets is supported reliably in a stable posture at the time of staple operation, the distance from the regulation surface is set to be short in the jog sort mode, and that it is thereby possible to shift the support member promptly at the time of jog timing (at the time of sort). Further, as the second reason, since the rear and/or side end support member is set for a different position corresponding to the post-processing mode, for example, the safety mechanism at the time of staple processing described later is capable of adopting a simplified structure.

The staple apparatus 23 (post-processing means; the same in the following description) is attached to the apparatus frame 10 as an apparatus that performs binding processing on a bunch of sheets collected on the sub-tray 18. As the staple apparatus 23, various structures are already known, and a general configuration will be described without showing the figure. The staple apparatus 23 is comprised of a head portion and anvil portion, and the head portion is disposed above while the anvil portion is disposed below with a bunch of sheets sandwiched therebetween. The head portion is attached to the frame unit to be able to approach and separate from the anvil portion.

In other words, the head portion is axially supported by the unit frame to be swingable, into the head portion are incorporated a former to bend a supplied staple (blank) in the shape of a U, and a driver member that pushes the staple into a bunch of sheets, and it is configured that the driver member bends the blank staple by swing motion of the head portion to insert into the bunch of sheets, and that the anvil member bends the staple tips. Therefore, in the unit frame are disposed a driver motor, drive cam, and head lever, rotation of the motor is transferred to the drive cam via a deceleration mechanism, and the driver lever provided with a power storing spring is charged by rotation of the cam.

The, when stored power of the power storing spring is released by rotation of the cam, the guide lever vigorously shifts the head portion from an upper waiting position to a lower actuation position in an impact manner. By this impact, the head portion inserts the staple into the bunch of sheets, and the anvil members bends the staple. Further, in the unit frame is installed a staple cartridge that supplies the staple to the head portion, and roll-shaped or sheet-shaped black staples are stored in the cartridge.

In such an apparatus, when a staple jam occurs in the head portion of the staple unit, or when a sheet jam occurs, the operator needs to clear the jam. When such trouble occurs, for example, a drive power supply of the staple motor is turned OFF, and thus, safety measures are taken not to execute staple operation accidentally.

[Safety Mechanism of the Staple Unit]

This Embodiment relates to a safety mechanism of the above-mentioned apparatus, and is to prevent a user from being injured by staple operation of the staple unit 23 disposed on the sub-tray 18. As shown in FIG. 7, the stack tray 15 is disposed below the sub-tray 18, the sheet storage area is formed above the paper mount surface 15*a*, and the user removes the stored sheets from the area to outside the apparatus.

Then, the distance (shown by Δa) between the apparatus housing 10 and sub-tray 18 is set at a distance for the finger of the user not to reach the staple processing section (staple unit 23) with ease. In other words, a distance enough to load sheets is formed above the sub-tray 18, while this distance is set at a distance for preventing the finger of the user from entering the binding processing section with ease. However, when the sub-tray 18 is retracted from above the stack tray to outside the tray, the finger of the user sometimes reaches the binding processing section from the storage area of the stack tray 15. This is because the user needs to put the fingers in the binding processing section to perform jam handling when the staple jam, sheet jam or the like occurs.

This Embodiment is characterized by covering in order for the finger of the user not to reach the post-processing section from above the sub-tray 18 (rear end support member 19 and side end support member 20) with ease, concurrently configuring so that the finger of the user reaches the binding processing section in a state in which the sub-tray 18 is retracted to outside the tray manually or using the tray shift means, detecting the position of the tray and prohibiting the staple operation when there is a possibility that the finger of the user reaches the post-processing section. The configuration will be described below.

As described above, the rear end support member 19 reciprocates among the first actuation position Xp1, second actuation position Xp2 and waiting position Xp3, and similarly, the side end support member 20 reciprocates among the first actuation position Yp1, second actuation position Yp2 and waiting position Yp3. Then, the first actuation positions are actuation positions in the staple binding processing mode, and the second actuation positions are set at actuation positions in the jog sort mode. Then, it is controlled that when each of the support members 19, 20 is positioned in the first actuation position, staple operation is allowed, while being prohibited when each of the members is in the second actuation position. Therefore, the following configuration is adopted.

(Tray Position Detection Mechanism)

In the sub-tray 18 is disposed a tray position detection means 41, and this means is comprised of a sensor that detects whether or not the sub-tray 18 is positioned in the actuation position (first actuation position in the Embodiment shown in the figure). The tray position detection mechanism will be described according to FIGS. 8A, 8B and 8C. FIG. 8A is a plan view illustrating the actuation positions of the rear end support member 19 and side end support member 20, FIG. 8B is an explanatory view of a position detection sensor Ts1 of the rear end support member 19, and FIG. 8C is an explanatory view of a position detection sensor Ts2 of the side end support member 20.

In the Embodiment in FIGS. 8A, 8B and 8C, the actuation position is set at either the first or second corresponding to the post-processing mode. Then, provided are a first sensor flag 19*f* and first sensor Ts1 that detect whether or not the support member is positioned in the first actuation position Xp1 (staple processing position). The first sensor flag 19*f* is integrally formed in the rear end support member 19, and the first sensor Ts1 is attached to the apparatus frame 10.

At this point, the arrangement is made in the position relationship so that the first sensor flag 19*f* makes the first sensor Ts1 "ON state" when the rear end support member 19 is positioned in the first actuation position Xp1, while making the first sensor Ts1 "OFF state" when the rear end support member 19 is positioned in the second actuation position Xp2 or waiting position Xp3. In addition, the relationship between the sensor and the flag may be made the relationship inversely so that the sensor makes "OFF state" in the first actuation position Xp1, while making "ON state" in the other positions.

Similarly, in the side end support member 20 are provided a second sensor flag 20*f* and second sensor Ts2 that detect whether or not the support member is positioned in the first actuation position (staple processing position) Yp1. The second sensor flag 20*f* is integrally formed in the side end support member 20, and the second sensor Ts2 is attached to the apparatus frame 10. Then, the arrangement is made in the position relationship so that the second sensor flag 20*s* makes the second sensor Ts2 ON state when the side end support member 20 is positioned in the first actuation position Yp1, while making the second sensor Ts2 OFF state when the side end support member 20 is positioned in the second actuation position Yp2 or waiting position Yp3.

[Jog Sort Mechanism]

In addition, the post-processing apparatus B is provided with a jog sort mechanism for varying the storage posture of sheets for each number of printed copies in storing sheets on the stack tray 15 from the sheet discharge outlet 13 as described above. In other words, sheets carried out of the sheet discharge outlet 13 are stacked in different positions in the sheet width direction in a group that is offset by a predetermined amount in the sheet-discharge orthogonal direction (Y direction) and in another group that is not offset (Embodiment 1). As distinct from this offset form, sheets carried out of the sheet discharge outlet 13 are stacked in different positions in front and back in the sheet discharge direction in a group that is offset by a predetermined amount in the sheet discharge direction (X direction) and in another group that is not offset (Embodiment 2).

Embodiment 1 and Embodiment 2 will be descried below in this order.

Embodiment 1 of the Offset Mechanism

Figure 19A:
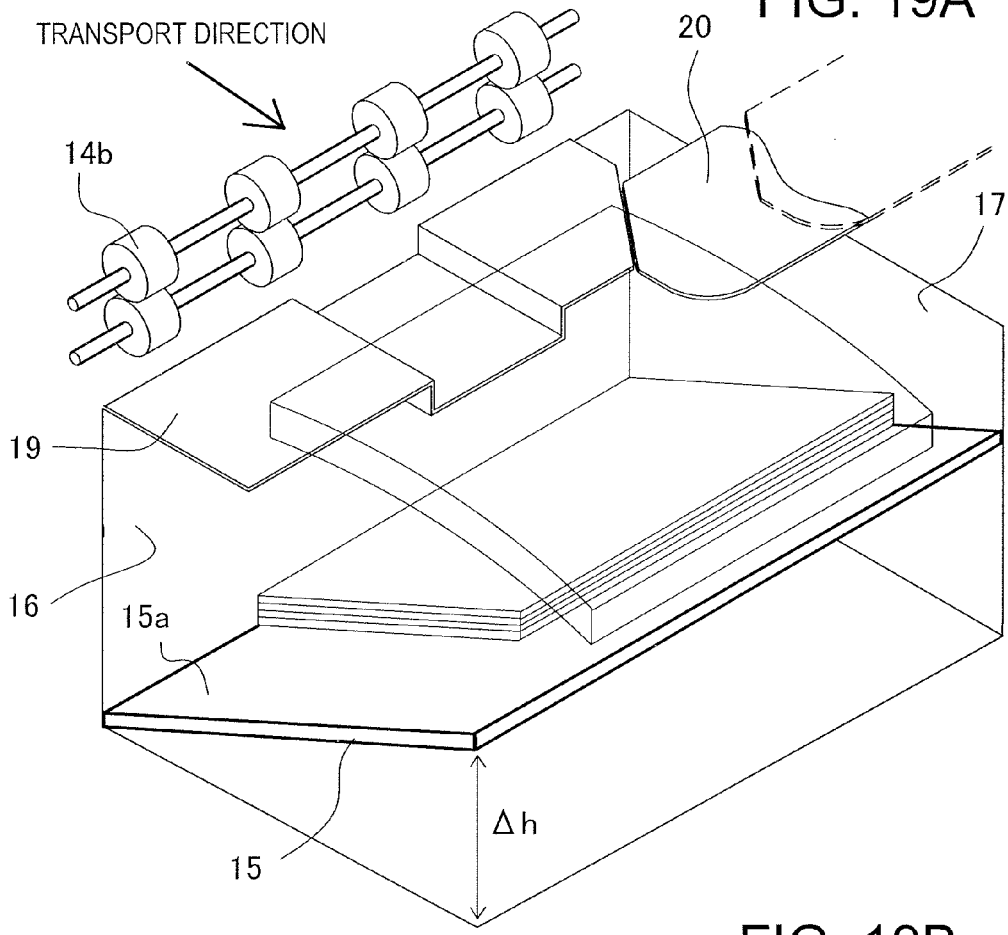
FIG. 19A is an explanatory view of Embodiment 1 of an offset mechanism in the invention and shows a tray perspective view.
Figure 19B:
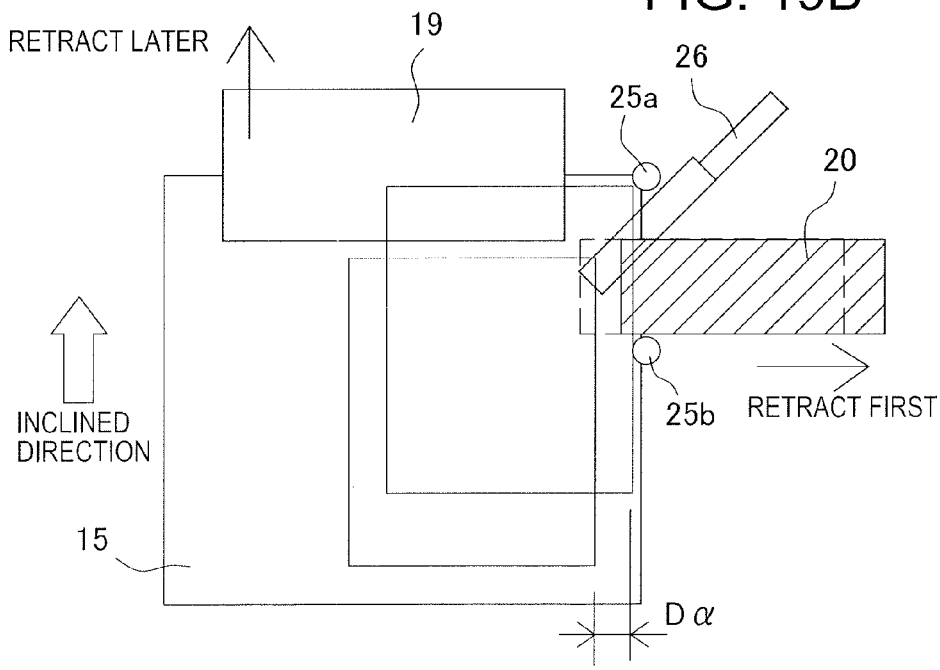
FIG. 19B is another explanatory view of Embodiment 1 of the offset mechanism in the invention and shows a plan view.
Figure 20A:
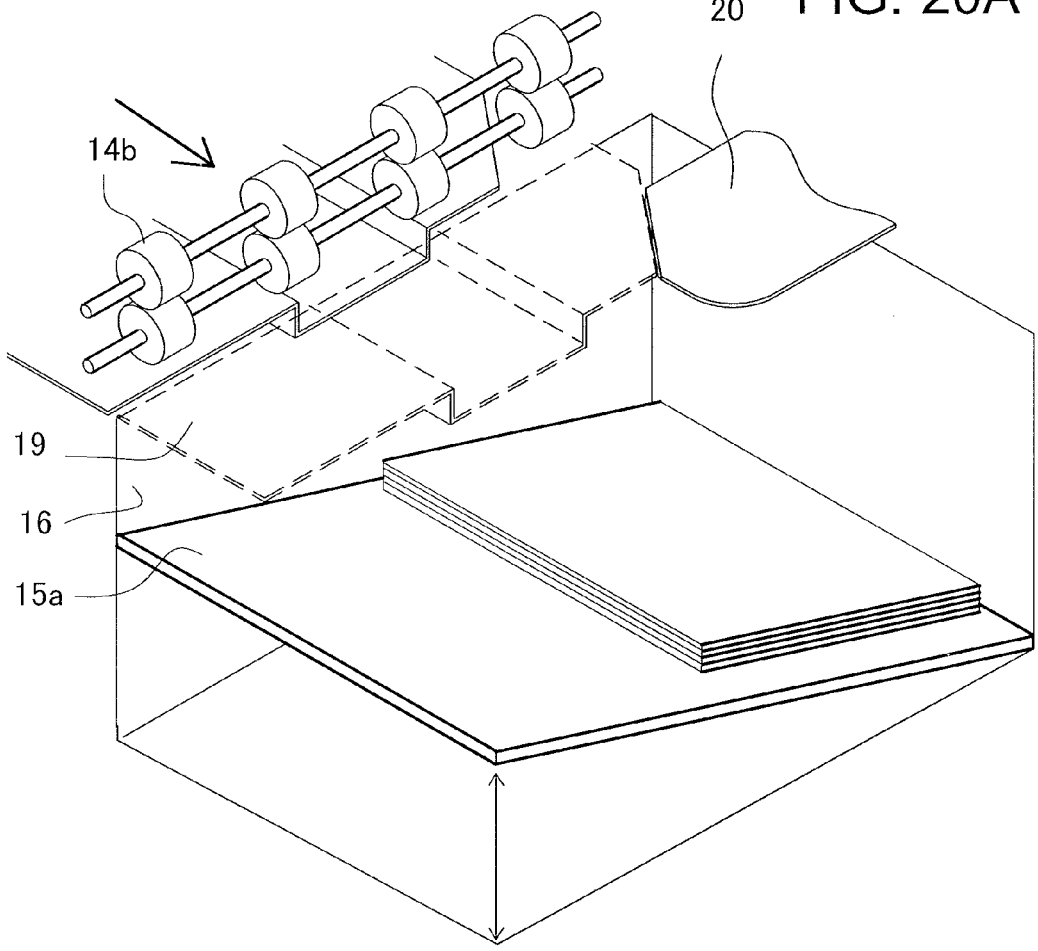
FIG. 20A is an explanatory view of Embodiment 2 of the offset mechanism in the invention and shows a tray perspective view.
Figure 21A:
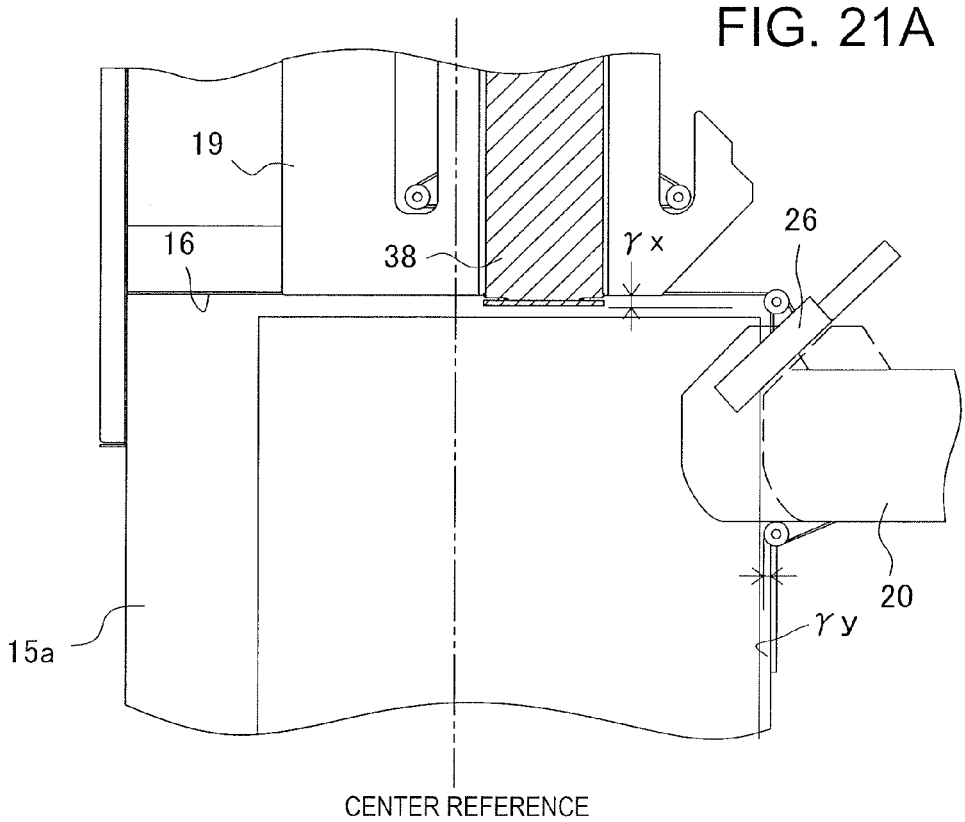
FIG. 21A is an explanatory view of a retract sequence to retract first and second support members from the tray and shows the case (Embodiment 1) of offsetting sheets in the sheet-discharge orthogonal direction.
Figure 21B:
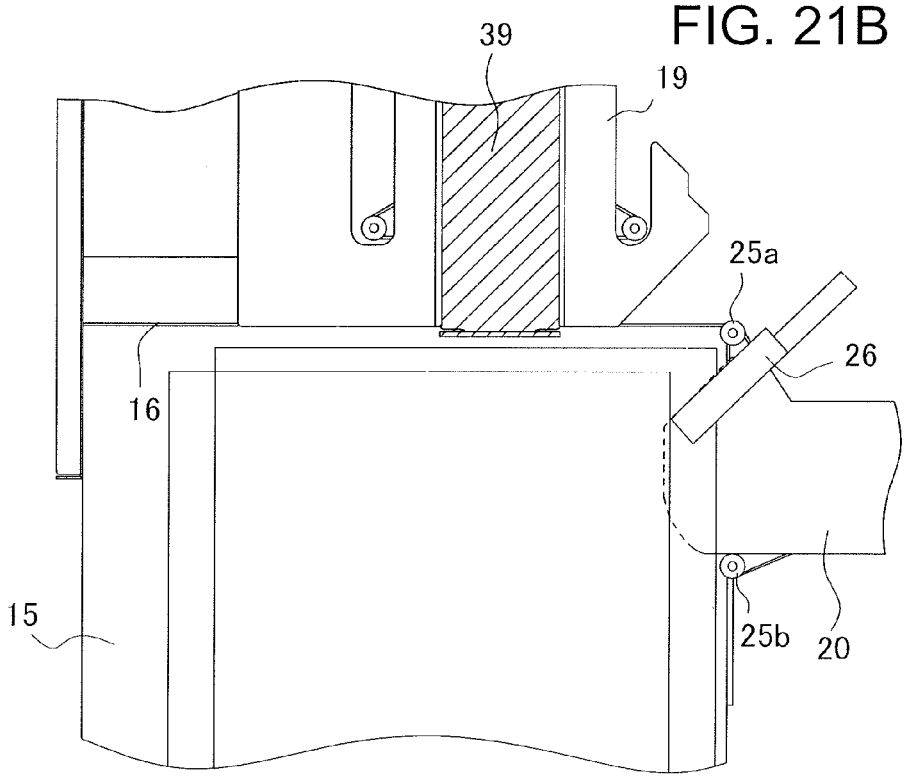
FIG. 21B is another explanatory view of the retract sequence to retract first and second support members from the tray and shows the case (Embodiment 1) of offsetting sheets in the sheet-discharge orthogonal direction.
Figure 22A:
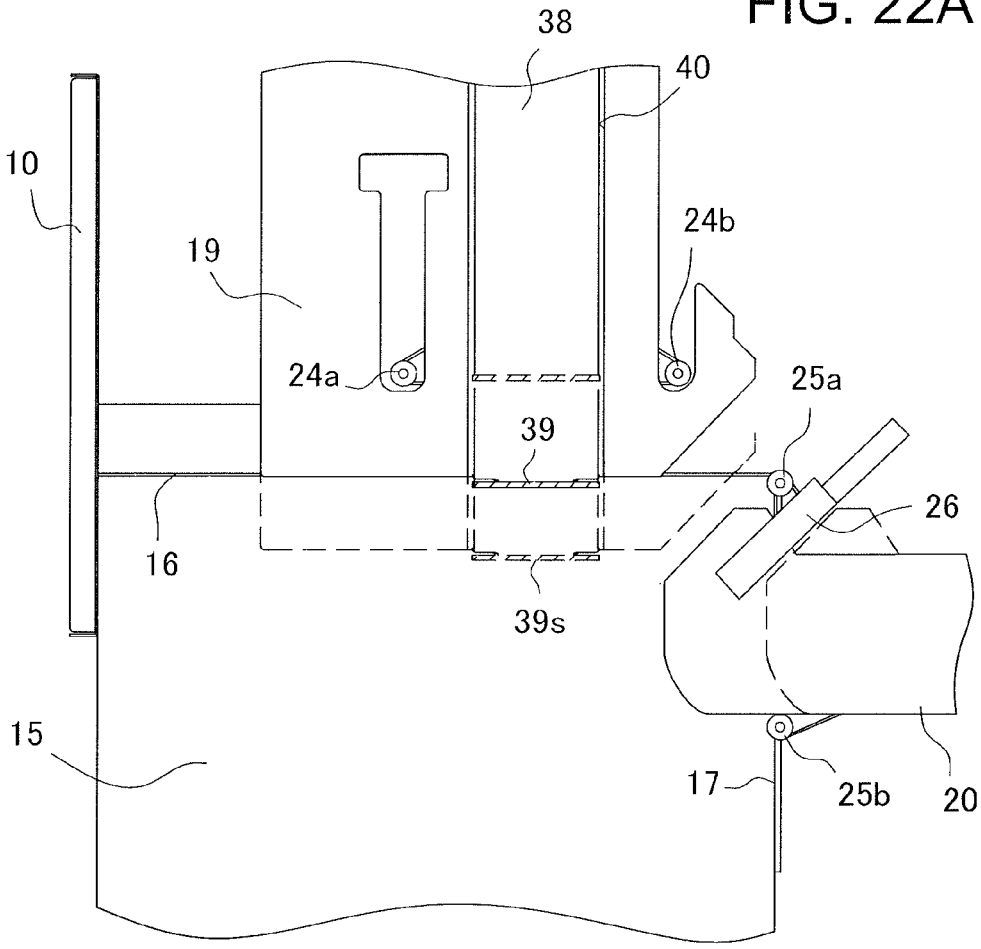
FIG. 22A is still another explanatory view of the retract sequence to retract first and second support members from the tray and shows the case (Embodiment 2) of offsetting sheets in front and back in the sheet discharge direction.
Figure 22B:
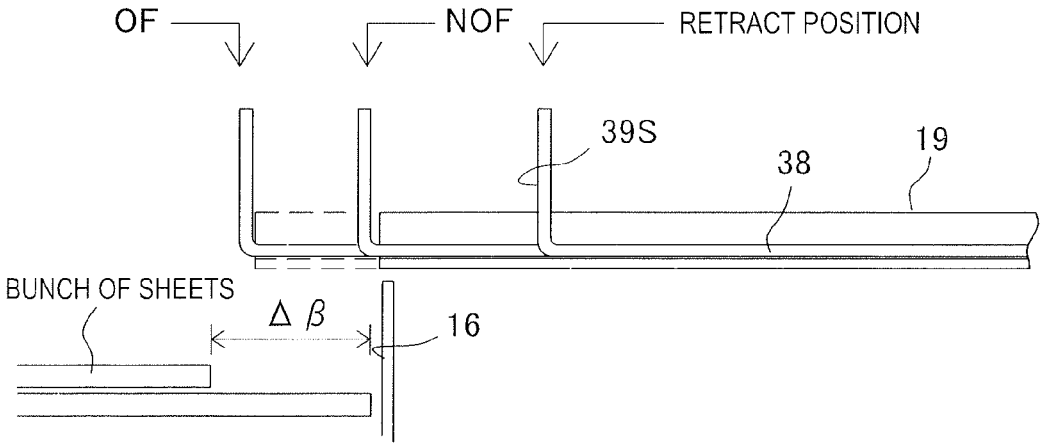
FIG. 22B is still another explanatory view of the retract sequence to retract first and second support members from the tray and shows the case (Embodiment 2) of offsetting sheets in front and back in the sheet discharge direction.

The sheet discharge rollers 14*b* are disposed in the sheet discharge outlet 13, and a sheet is carried out from the sheet carry-in path 11 in the center reference (which may be the side reference). Then, according to the print information, sheets are collected on the non-offset position and the offset position on the paper mount surface 15*a*. Embodiment 1 as shown in FIGS. 19A and 19B is the case of offsetting sheets to the right and left in the sheet-discharge orthogonal direction, and Embodiment 2 as shown in FIG. 20A is the case of offsetting sheets in front and back in the sheet discharge direction. Embodiment 3 as shown in FIG. 21A is to sort to a group (non-offset sheet discharge) in which sheets are directly stored on the paper mount surface 15*a* from the sheet discharge outlet 13, and another group (offset discharge) in which sheets are collected on the first and second support members 19, 20 from the sheet discharge outlet 13 while offsetting by a predetermined amount, and after the collection, each support member is retracted from the tray to store on the paper mount surface 15*a*.

The present invention is characterized by inclining the paper mount surface so that one side is higher and that the other side is lower in the direction orthogonal to the direction for offsetting sheets to position the sheet end edge in any of configurations. In other words, in Embodiment 1, in the configuration for offsetting to the left and right in the sheet-discharge orthogonal direction, the paper mount surface is inclined so that the upstream side is lower and that the downstream side is higher in the sheet discharge direction. Further, in Embodiment 2, in the configuration for offsetting in front and back in the sheet discharge direction, the paper mount surface is inclined so that one side is higher and that the other side is lower in the sheet-discharge orthogonal direction. Then, both inclinations are configured to incline so that the end portion in which the support member is disposed is lower and that the end portion on the opposite side is higher (see height difference Δh shown in FIGS. 19A and 20A).

As shown in FIGS. 19A and 19B, in the side edge support member 20 (second support member; the same in the following description) are disposed the side edge regulation stopper 25, and the aligning transport means 26 that carries a sheet toward the stopper. By the aligning transport means 26, the sheet is shifted in the position in the transport orthogonal direction by an offset amount Dα with the sheet supported by the first and second support members 19, 20. Then, since a distance γ is formed between the side edge regulation stopper 25 and the side edge regulation surface 17 of the stack tray, when the second support member 20 shifts backward in the waiting direction, the sheets collected on the first and second members 19, 20 are dropped onto the paper mount surface 15 and are stored (offset sheet discharge).

At this point, since the difference Δh in height is formed in the paper mount surface 15*a*, the sheet front end lands on the paper mount surface 15*a* with the sheet rear end supported by the first support member 19. In this landing of the sheet front end, without causing positional displacement in the offset-amount posture of the sheets, only the front end portion is dropped with the sheet rear end portion held.

In this case, timing of the first and second support members 19, 10 are made different so that after the second support member 20 shifts from the actuation position to the waiting position, the first support member 19 shifts from the actuation position to the waiting position. This sheet discharge operation will be described later based on flowcharts, and the action will be described.

The sheet of non-offset sheet discharge is dropped onto the paper mount surface 15*a* from the sheet discharge outlet 13 via the height difference h in the reference (shown in the figure is the center reference) set on the sheet carry-in path 11, and is collected with this posture sequentially in a stacked shape. Further, the sheet of offset sheet discharge is loaded and stored on the first and second support members 19, 20. At this point, the sheet fed from the sheet discharge outlet 13 is struck by the side edge regulation stopper 25 and rear end regulation stopper 24 by the aligning transport means 26 as described previously. At this point, since the sheet discharge reference and the side edge regulation stopper 25 are displaced by the offset amount Dα in the sheet width direction, the sheets are separated from the non-offset sheet group.

In this offset sheet discharge, since the side edge support member 20 is first shifted backward from the actuation position to the waiting position, the sheets drop onto the paper mount surface 15*a* starting at the sheet front end portion with the rear end portion supported by the rear end support member 19. In addition, in shifting the side edge support member 20 to the waiting position, since the aligning means 26 presses the sheet top surface, even when the area supported by the side edge support member 20 is small, the sheets do not fluctuate to the side of the sheet width direction (the direction in which the side edge support member 20 shifts). In other words, a bunch of sheets is stored on the paper mount surface 15*a* in almost the same behavior as dropping the sheet front end portion from a predetermined height while grasping the sheet rear end portion.

At this point, since the paper mount surface 15*a* is inclined so that the front end side in the sheet discharge direction is higher and that the rear end side is lower, the front end portion lands on the paper mount surface with the rear end portion supported by the rear end support member 19, then the rear end portion lands on the paper mount surface, and therefore, the sheets cause neither disorder of the sheet posture nor positional displacement.

Then, after the sheet front end portion lands on the paper mount surface 15*a*, the rear end support member 19 that supports the sheet rear end portion is shifted backward from the actuation position to the waiting position. By such sheet storage, it is possible to drop and store the offset bunch of sheets on the paper mount surface 15*a* with little positional displacement.

Embodiment 2 of the Offset Mechanism

Figure 20B:
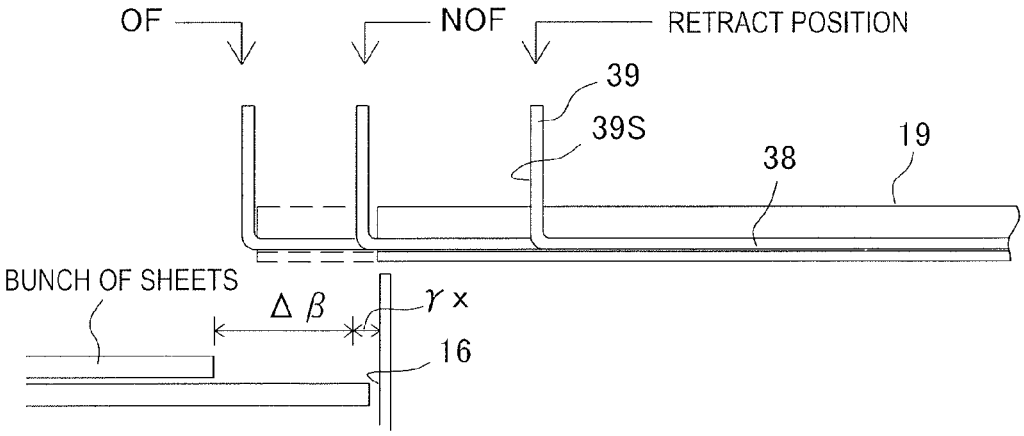
FIG. 20B is another explanatory view of Embodiment 2 of the offset mechanism in the invention and shows an operation explanatory view of a slide member.

Embodiment 2 will be described next. In this Embodiment 2, as shown in FIGS. 20A and 20B, sheets are sorted into the non-offset position "nof" and offset position "of" in the sheet discharge direction to store. Therefore, as shown in FIGS. 20A and 20B, with the rear end (first) support member 19 and side edge (second) support member 20 positioned in the actuation positions above the paper mount surface 15*a*, sheets are collected on both support members from the sheet discharge outlet 13. At this point, the sheets are collected while the sheet side edge strikes the side edge regulation stopper 25 and the sheet rear end edge strikes the side end regulation stopper 24 by the aligning transport means 26 described below.

Then, when a job end signal is transferred from the image formation apparatus A, according to print job information from the image formation apparatus A, the sheet discharge means 50 selectively offsets bunches of sheets to the predetermined position (non-offset position) NOF in the sheet discharge direction and the offset position OF different by the offset amount Dβ using the pusher means 37 described previously. Then, the means 50 first shifts the first support member 19 and next the second support member 20 backward from the actuation positions Ap to the waiting positions Wp.

At this point, as shown in FIG. 20A, the paper mount surface is inclined in the sheet-discharge orthogonal direction different from the sheet discharge direction (X direction) to offset, and the inclination direction is set so that the end portion (right in FIG. 20A) in which the second support member 20 is disposed is lower. By this means, the bunch of sheets offset in the sheet discharge direction lands on the paper mount surface 15*a* starting at the sheet side portion (left end as viewed in the figure) on the opposite side with the sheet side end portion supported.

In other words, the rear end support member 19 is first retracted from the tray 15, and sheets are landed on the paper mount surface starting at the side edge portion on the opposite side with the sheet side portion supported by the side edge support member 20. At this point, since the paper mount surface is inclined so that the end portion in which the support member is disposed is lower and that the end portion on the opposite side is higher, the sheets drop onto the paper mount surface 15*a* starting at the end portion with a small difference in height. Accordingly, the sheets are stored on the paper mount surface while causing neither positional displacement in the offset amount nor disorder in the posture.

In addition, the non-offset position NOF shown in the figure is set at almost the same position as that of the rear end regulation surface 16 of the stack tray. This is because of storing the sheet rear end edge of non-offset along the regulation surface 16. In the position NOF and end regulation surface 16, to be exact, the stopper position protrudes slightly from the rear end regulation surface 16 toward the inside of the tray to reserve a distance γx so as to make drop motion of sheets reliable.

[Sheet Discharge Operation]

A series of sheet discharge operation for collecting sheets on the sub-tray 18 to perform the binding processing and then storing on the stack tray 15 will be described next according to FIGS. 16A, 16B, 17A, 17B and 17C.

Figure 16A:
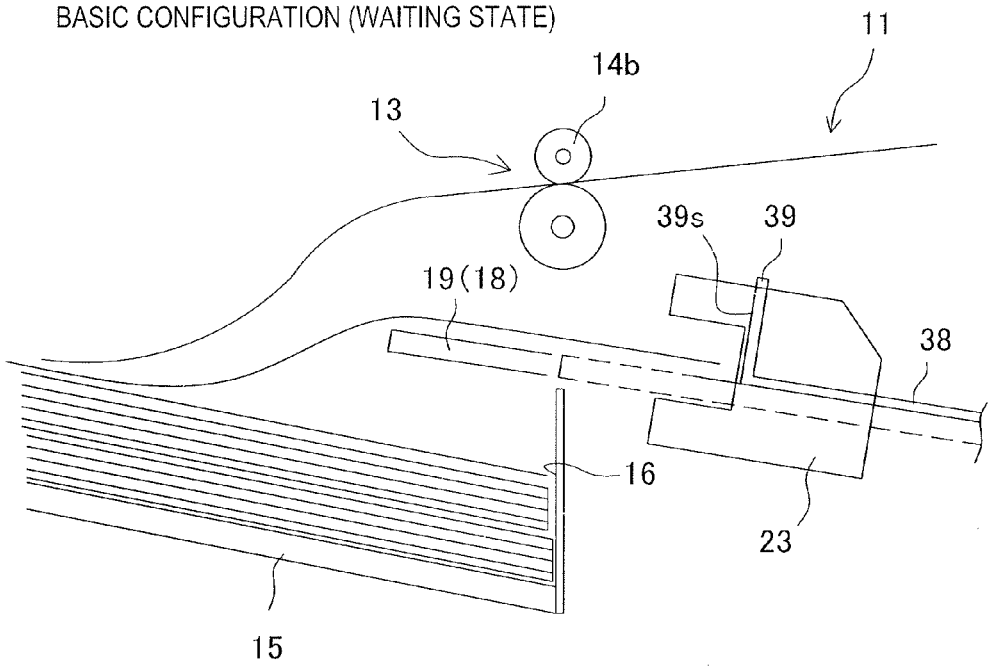
FIG. 16A shows a state of storing sheets fed to a sheet carry-in path on a sub-tray.

FIG. 16A shows a state of storing sheets fed to the sheet carry-in path 11 on the sub-tray 18. The rear end support member 19 and side edge support member 20 constituting the sub-tray are both position-shifted from the waiting positions to the actuation positions. Further, the sheet push member 38 waits in a position retracted to the rear side of the sheet rear end regulation stoppers 24*a*, 24*b* (see FIGS. 3A and 4A) together with the bent piece 39 and paper press surface 39*s*. In this state, sheets fed from the sheet discharge outlet 13 are stacked and collected on the stack tray 18.

At this point, the sheets are struck by the rear end and side end regulation stoppers 24, 25 and are positioned by the aligning transport means 26, and the sheet corner is locked in a predetermined binding processing position. In addition, the rear end support member 19 and side edge support member 20 are formed in the shape and area to mount and support the sheet rear end portion and side end portion so as to support the sheets in a substantially horizontal posture.

Figure 16B:
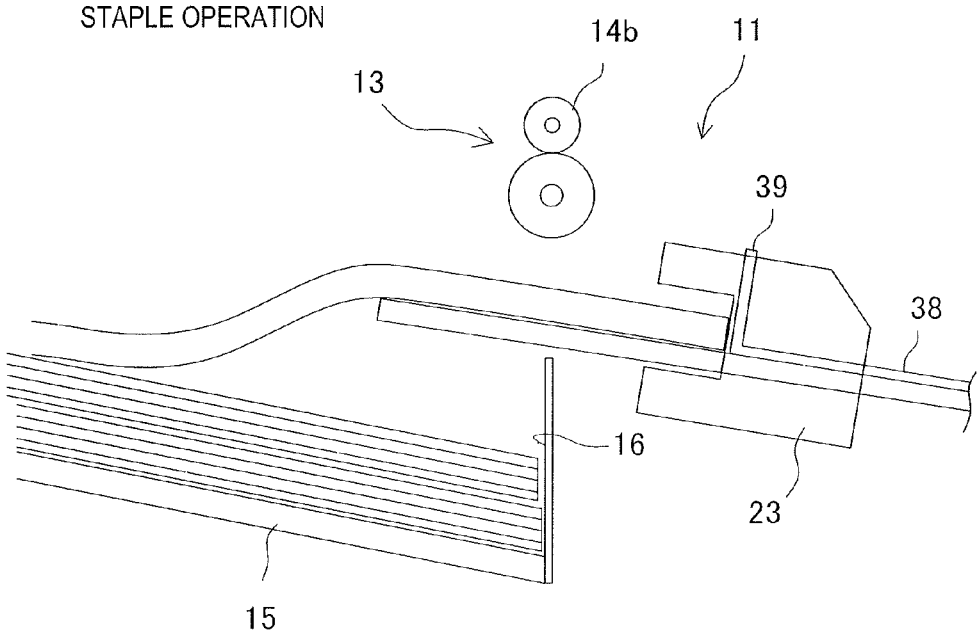
FIG. 16B shows a state of performing binding processing on a bunch of sheets which are collated and collected on the sub-tray.

FIG. 16B shows a state of performing binding processing on a bunch of sheets which are collated and collected on the sub-tray 18. Upon receiving a job end signal from the image formation apparatus A in a stage in which sheets are collected on the sub-tray 18, the control means 50 issues a command signal of binding processing operation to the staple unit 23.

By this means, the staple unit 23 actuates the built-in drive motor (not shown) to execute staple operation. In this staple operation, the drive cam is rotated a predetermined angle by rotation of the motor to store the biasing force in the power storing spring. Then, when the cam reaches a release angle, by the stored force of the spring, the staple head is lowered vigorously toward a bunch of sheets. By this impact of the head, the staple penetrates the bunch of sheets, and staple tips are bent on the opposite side (backside) of the bunch of sheets by the anvil member.

When the binding processing in the staple unit 23 is finished and the control means 50 receives an end signal, the means 50 stores the bunch of sheets on the sub-tray 18 on the stack tray 15 by the following procedure. FIG. 17A shows a state of shifting the bunch of sheets from the post-processing position to the stack tray side to carry out the bunch of sheets from the sub-tray 18 to the stack tray 15. The bunch of sheets, which undergoes the binding processing while being supported by the rear end support member 19 and the side edge support member 20, is pushed to the stack tray 15 side by the sheet push member 38 shifting on the rear end support member. By this operation, the rear end edge of the bunch of sheets is pushed to follow the paper press surface 39*s*, and the distance Δx is formed between the sheet rear end edge and the rear end regulation surface 16 of the stack tray 15.

FIG. 17B shows a state of dropping the bunch of sheets that is carried to above the stack tray 15 on the uppermost sheet on the paper mount surface 15*a*. At timing at which operation of the sheet push member is finished with reference to the end signal from the staple unit as described previously (after a lapse of a timer time since the staple end signal, or after a lapse of a timer time since the position sensor (not shown, see FIGS. 5A and 5B) that detects a flag integrally formed in the sheet push member 38), the control means 50 shifts from the rear end support member actuation position to the waiting position.

FIG. 17C shows a state in which the bunch of sheets drops onto the stack tray. As shown in FIG. 17C, the bunch of sheets drops onto the uppermost sheet loaded on the paper mount surface 15*a* of the stack tray 15. At this point, the bunch of sheets drops while shifting to the rear end regulation surface 16 side of the tray due to the self-weight slide effect (shown by the rightward arrow in FIG. 17C) caused by the inclination (the downstream side in the sheet discharge direction is higher, see the FIG. 17C) of the paper mount surface 15*a*, and since the distance Δx is formed between the sheet rear end edge and the rear end regulation surface 16 of the tray in consideration of slide shift of the bunch of sheets, the sheet rear end is neither caught on the wall surface of the rear end regulation surface 16 nor locked.

Thus, in this Embodiment, in shifting a bunch of sheets collected on the sub-tray from the post-processing position to the tray storage position (actuation position Ap) by the sheet push member, the rear end edge of the bunch of sheets shifts to the inside of the tray up to the position for forming the distance Δx from the rear end regulation surface 16 of the tray, then the rear end support member 19 is retracted to outside the tray, and therefore, when the distance Δx is beforehand set at an appropriate distance by experiments or the like, the bunch of sheets is neatly collected on the paper mount surface without causing positional displacement.

[Description of Control Configuration]

Figure 18:
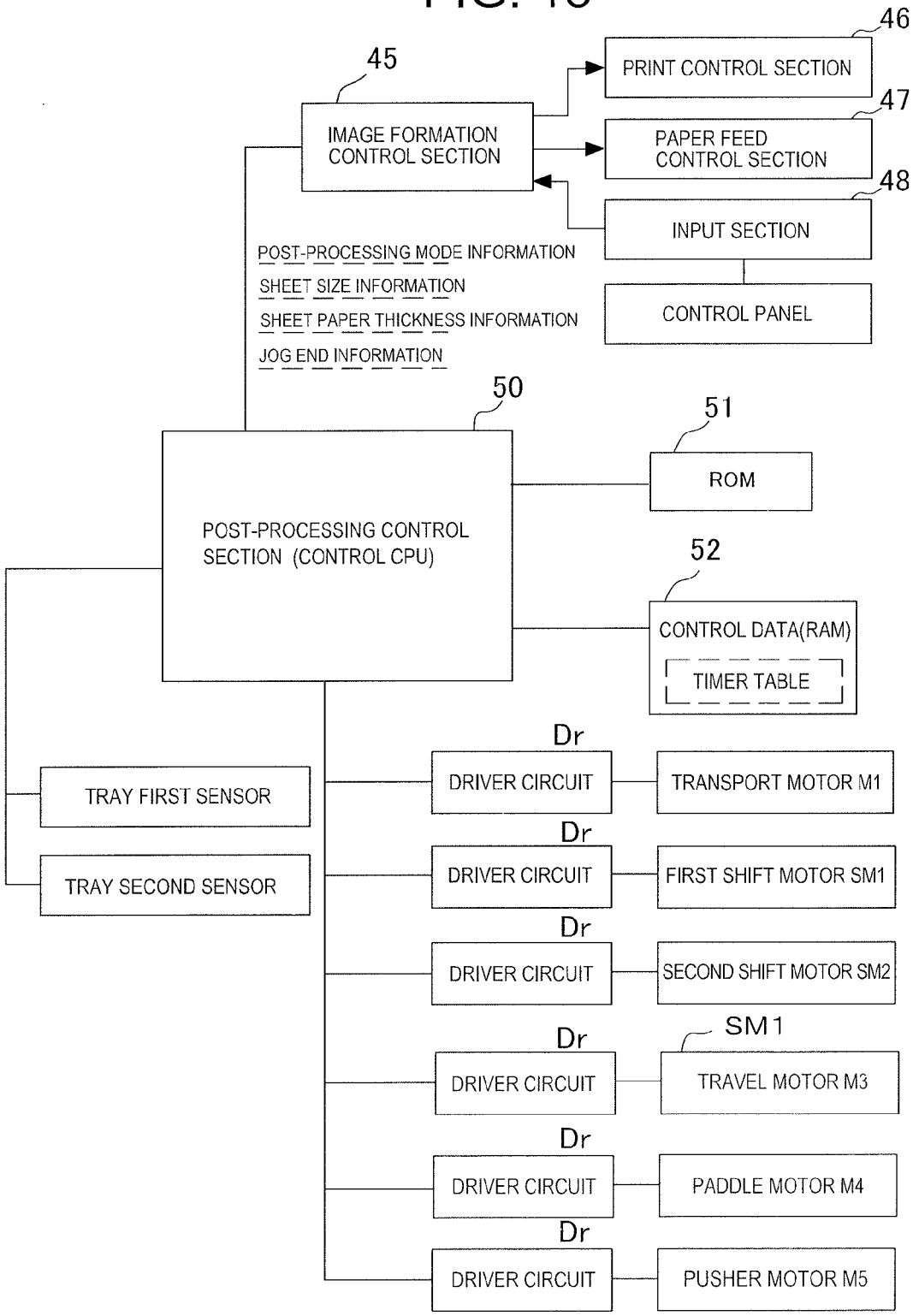
FIG. 18 is an explanatory diagram (block diagram) of a control configuration in the image formation system of FIG. 1.

The control configuration of the image formation system will be described according to the block diagram of FIG. 18. The image formation system as shown in FIG. 1 is provided with a control section 45 (hereinafter, referred to as a "main-body control section") of the image formation apparatus A, and the control section 50 (hereinafter, referred to as a "post-processing control section") of the sheet post-processing apparatus B. The main-body control section 45 is provided with a print control section 46, paper feed control section 47 and input section 48 (control panel).

Then, the setting of an "image formation mode" and "post-processing mode" is performed from the input section 48 (control panel). The image formation mode is to set modes such as color/monochrome print and two-side/one-side print, and to set image formation conditions such as the sheet size, sheet paper property, number-of-print out copies and reduction/enlargement print. Further, for example, the "post-processing mode" is set at "print out mode", "staple finish mode (staple binding processing mode)", "jog sort mode" and the like.

Further, the main-body control section 40 transfers data of the post-processing mode, the number of sheets, information of number-of-copies, sheet thickness information of a sheet for image formation and the like to the post-processing control section 50. Concurrently therewith, the main-body control section 45 transfers a job end signal to the post-processing control section 50 for each finish of image formation.

The post-processing mode will be described. The "print out mode (first sheet discharge mode)" is to store a sheet from the sheet discharge outlet 13 on the stack tray 15 without performing post-processing. In this case, the sheet is directly carried out to the stack tray 15 from the sheet discharge outlet 13 without being collected on the sub-tray 18 (first support member (rear end support member) 19 and second support member (rear end support member) 20). The "staple finish mode (staple binding processing mode, second sheet discharge mode)" is to collect sheets from the sheet discharge outlet 13 on the sub-tray 18 to collate, perform the binding processing on a bunch of the sheets, and then store the sheets on the stack tray 15. In this case, in principle, an operator designates sheets with the same paper thickness of the same size as the sheets to undergo image formation.

The "job sort mode (third sheet discharge mode)" is to sort sheets with images formed in the image formation apparatus A into a group for carrying out the sheet from the sheet discharge outlet 13 to the stack tray 15 on a sheet-by-sheet basis and another group for collating and collecting sheets from the sheet discharge outlet 13 on the sub-tray 18 (first support member (rear end support member) 19 and second support member (side end support member) 20) to carry out onto the stack tray 15, and to thereby perform jog sort. At this point, the side edge regulation stopper 25 described previously is disposed in a position in which the sheet side edge is offset by a predetermined amount in aligning the sheets on the sub-tray 18. Then, after collecting the bunch on the sub-tray 18, the support members 19, 20 are retracted to outside the stack tray 15, and the bunch is dropped onto the stack tray 15 to store. By this means, on the paper mount surface 15*a*, sheet groups carried out in the predetermined reference (center reference or side reference) from the sheet discharge outlet 13, and sheet groups which are offset by a predetermined amount and collected on the sub-tray 18 are stored in different positions in the width direction and are sorted for each collated group.

[Post-Processing Control Section]

The post-processing control section 50 operates the post-processing apparatus B corresponding to the post-processing mode set in the image formation control section 45. The post-processing control section shown in the figure is comprised of a control CPU 50 (hereinafter, referred to as control means). The control CPU 50 is coupled to ROM 51 and RAM 52, and executes sheet discharge operation described later using a control program stored in the ROM 51 and control data stored in the RAM 52.

Therefore, the control CPU 50 transmits command signals to respective driver circuits (shown by Dr in FIG. 18) of the transport motor M1, first shift motor SM1, second shift motor SM2, travel motor M3, paddle motor M4, and pusher motor M5 described previously. Further, the control CPU 50 is connected to sheet sensors Se and position sensors Ps to be able to receive each detection signal. The sheet sensors Se are the carry-in sensor Se1, sheet discharge sensor Se2, and full sensor Se that detects full of sheets on the tray, not shown, and each sensor transmits a respective state signal to the control means 50.

Further, the position sensors Ps are the position sensor Ps1 of the first support member (rear end support member) 19, position sensor Ps2 of the second support member (side end support member) 20, friction transport body position sensor Ps3, position sensor Ps4 of the paddle rotating body (paddle member) 35, and position sensor Ps5 of the pusher means 37, and each sensor transfers a respective state signal to the control means. In addition, for the driver circuit of each driver motor, the control means 50 transmits command signals to each circuit to control motor start, motor halt and speed control by PWM control, encode control or the like.

[Post-Processing Operation]

Figure 23:
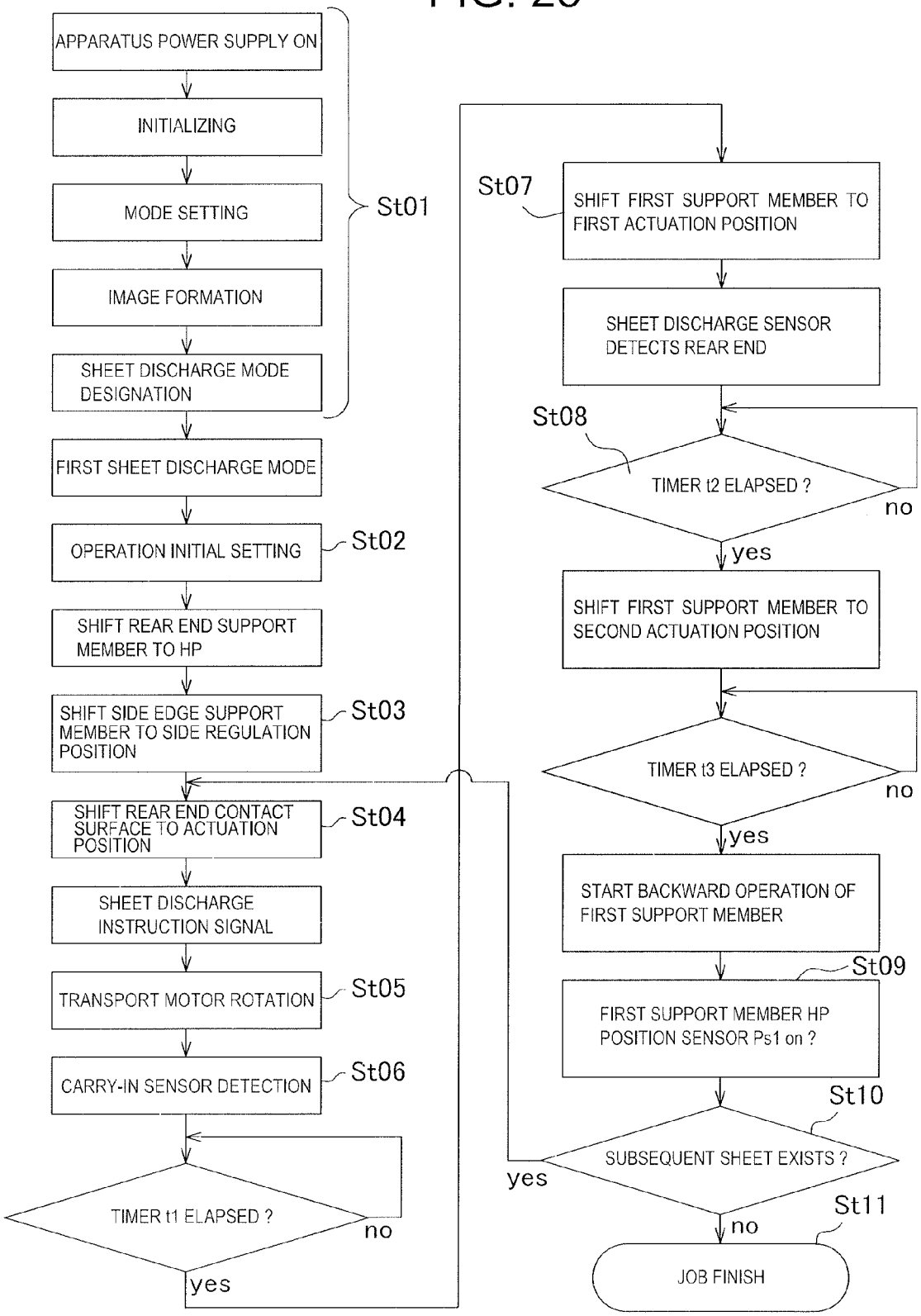
FIG. 23 is an operation explanatory diagram (flowchart) of a first sheet discharge mode of the post-processing apparatus of FIG. 2.
Figure 24:
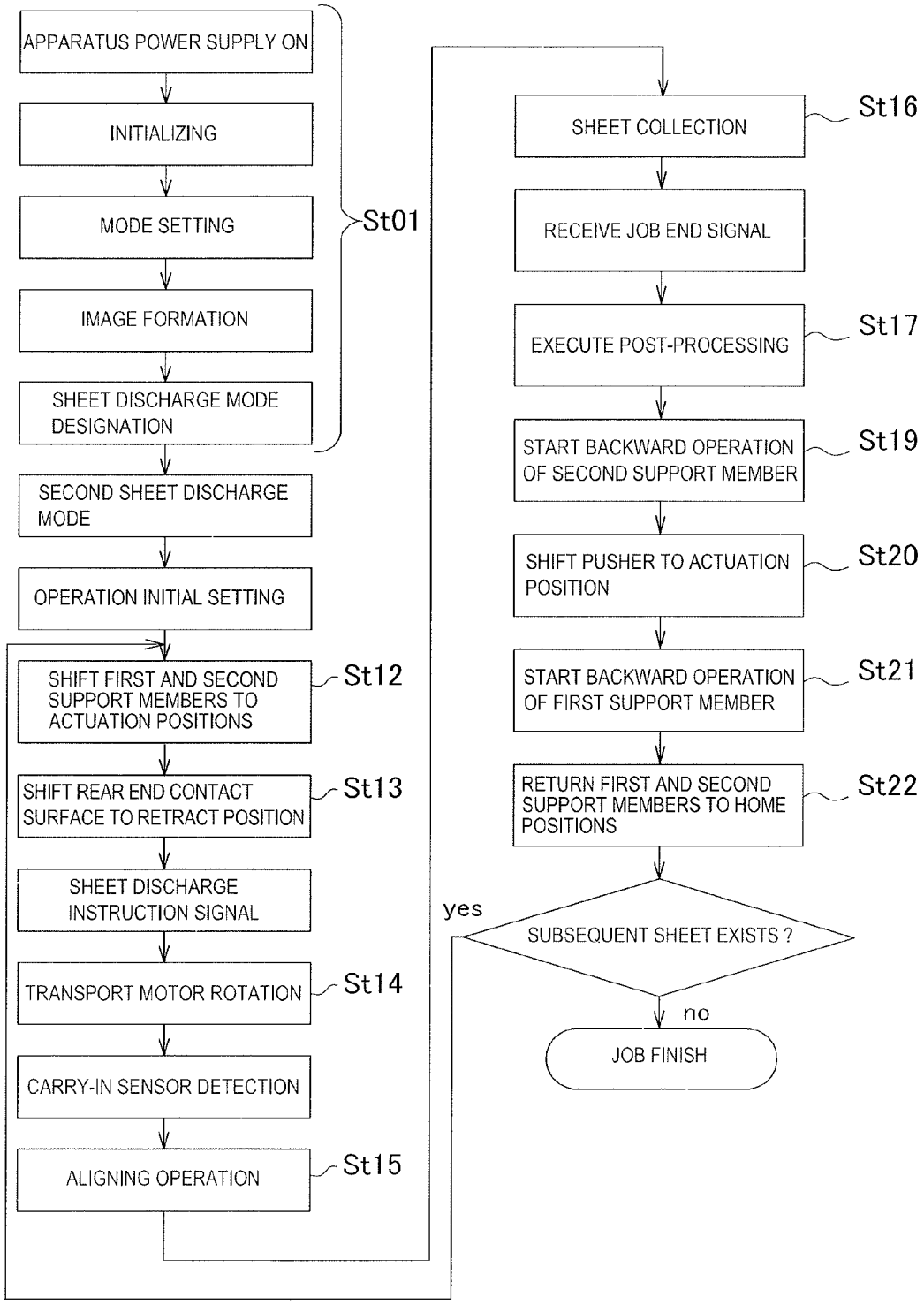
FIG. 24 is an operation flow of a second sheet discharge mode of the post-processing apparatus of FIG. 2.
Figures 25A, 25B:
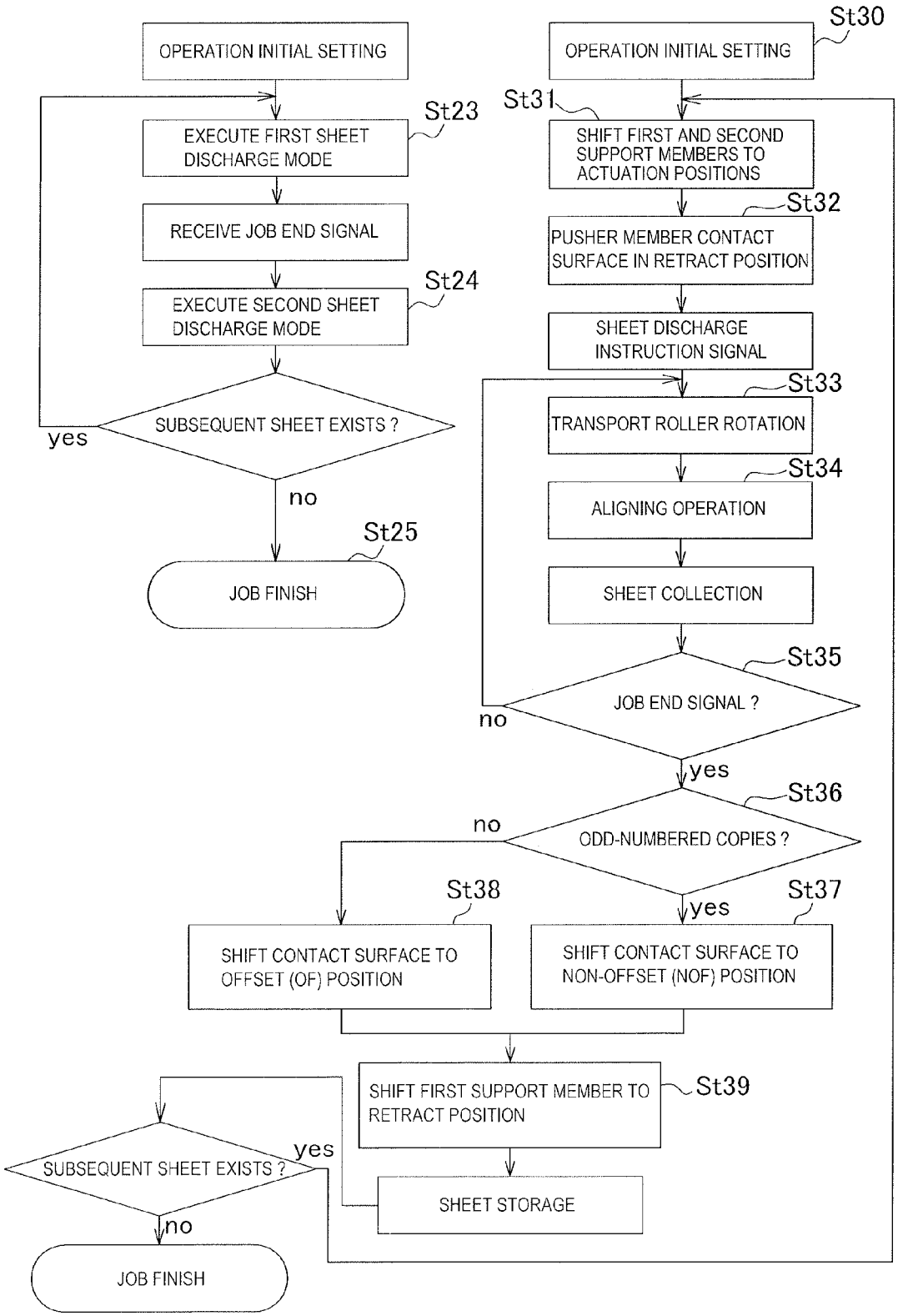
FIG. 25A is a diagram showing an operation flow of a third sheet discharge mode of the post-processing apparatus of FIG. 2 and shows Embodiment 1.
FIG. 25B is a diagram showing another operation flow of the third sheet discharge mode of the post-processing apparatus of FIG. 2 and shows Embodiment 2.

FIG. 23 shows the case where the first sheet discharge mode (straight sheet discharge operation) is set in the mode setting in the image formation apparatus A, FIG. 24 shows the second sheet discharge mode (staple binding operation), and FIGS. 25A and 25B show the case where the third sheet discharge mode (jog sheet discharge operation) is set.

The sheet discharge control means 50 executes initializing operation in apparatus power supply ON (St01). For example, this initializing operation is to execute the following initial position setting. The means 50 detects whether the first support member 19 is in the waiting position (home position) using the position sensor Ps1, and in "No", shifts to the sensor "ON" position. Similarly, the second support member 20 is shifted to the waiting position (home position).

Next, the pusher means 37 is shifted to the home position. In the apparatus shown in the figure, the home position is set at the waiting position, and the rear end contact surface 39*s* is retraced to outside the tray (states of FIGS. 5A and 5B). Further, this initializing operation is to set the post-processing means 23 (the means shown in the figure is the staple unit) at the initial state.

[First Sheet Discharge Mode]

Then, the sheet discharge control means 50 receives a mode setting signal from the image formation control section 45. When the first sheet discharge mode is designated with this command signal, the post-processing control means 50 executes the following initial operation (St02)

Further, as the initial operation setting, the sheet discharge control means 50 determines whether or not the first and second support members 19, 20 are positioned in the home positions. When the members are in positions except the home positions, the positions of the members are shifted to the home positions (St03). Concurrently therewith, the sheet discharge control means 50 shifts the rear end contact surface 39*s* of the slide member 38 to a regulation position protruding to inside the tray (state of FIG. 3A). This operation shifts the slide member 38 from the home position by a beforehand set shift amount with the pusher motor M5. Then, the rear end contact surface 39*s* is set at the position protruding slightly to the inside of the tray by about 2 mm from the rear end regulation surface 16 of the stack tray 15 (see Dz shown in FIG. 4A).

Further, as the initial operation setting, the sheet discharge control means 50 determines whether or not the first support member 19 is in the home position. When the member is in a position except the home position, the means 50 shifts the position, while determining whether or not the second support member 20 is in the predetermined position of the sheet side edge. This determination is made with the third sensor flag 22*g* described previously and a detection signal of the seventh position sensor Sp7. Next, based on the sheet size information sent from the image formation control section 45, the sheet discharge control means 50 calculates a side edge guide position of the second support member 20. In this calculation, for example, in the apparatus configuration for carrying out a sheet from the sheet discharge outlet 13 in the center reference, the position of (sheet width size/2-defined value) is calculated from the "reference position".

The defined value at this point is set in consideration of a bias amount by skew or register of the sheet in the sheet discharge path 11 and size error of the sheet. Then, the value is set at a position biased by a predetermined amount to the sheet center side from the sheet side edge fed from the sheet discharge outlet 13. By this means, the side edge of the sheet carried out of the sheet discharge outlet 13 in any posture always engages in the end surface guide 20*e* and is carried out to the stack tray 15. Then, the sheet discharge control means 50 shifts the position of the second support member 20 from the defined position to the side edge guide position corresponding to the designated sheet size. This shift amount is made by pulse control of the second shift motor SM2 (St03).

Concurrently with the position setting of the first and second support members 19, 20, the sheet discharge control means 50 shifts the rear end contact surface 39*s* of the slide member 38 to the regulation position protruding to inside the tray (state of FIG. 3A; St04). This operation shifts the slide member 38 from the home position by a beforehand set shift amount with the pusher motor M5. Then, the rear end contact surface 39*s* is set at the position protruding slightly to the inside of the tray by about 2 mm from the rear end regulation surface 16 (see Dz shown in FIGS. 15A, 15B and 15*c*).

Upon receiving a job start signal from the image formation control section 45, the post-processing control section 50 rotates the transport motor M1 to rotate the transport rollers 14*a* and sheet discharge rollers 14*b* in the sheet discharge direction (st05). By this means, the sheet carried out to the main-body sheet discharge outlet 136 is carried in the sheet carry-in path 11, and the carry-in sensor Se1 detects the sheet front end. For example, this detection signal is used in determining a sheet jam from a time difference between detection of the sheet front end with this sensor and subsequent detection of the sheet rear end and the sheet size information and the like, and thus is used in control of the subsequent post-processing operation (St06).

The control means 50 starts a timer t1 when the carry-in sensor Se1 detects the sheet front end. This timer t1 time is set at a predicted time such that the sheet front end arrives at a predetermined position from the sheet discharge outlet 13. When this time t1 has elapsed, the control means 50 shifts the first support member 19 from the waiting position to the first actuation position Ap1 (St07). Accordingly, the timer time t1 is set at timing at which the sheet front end shifts from the sheet discharge outlet 13 to the predetermined first actuation position Ap1 and then the sheet engagement surface 19*s* of the support member 19 engages in the sheet lower surface.

When the sheet discharge sensor Se2 detects the sheet rear end, the control means 50 starts a timer t2 (St08). This timer time t2 is set at timing at which the sheet rear end separates from the nip point of the sheet discharge rollers 14*b*. Then, after a lapse of the timer time t2, the control means 50 shifts the first support member 19 from the first actuation position Ap1 to the second actuation position Ap2 (St09). The shift amount Δk is set to be larger than the radius of the sheet discharge roller. Accordingly, after separating from the sheet discharge rollers 14*b*, the sheet rear end is pushed in the sheet direction by the predetermined amount Δk by the first support member 19. As a result, such a rear end remaining phenomenon is not invited that the sheet rear end remains on the sheet discharge roller periphery.

Next, when the sheet discharge sensor Se2 detects the sheet rear end, the control means 50 starts the timer t3 concurrently with the timer t2, and after a lapse of the time, shifts the first support member 19 backward to the waiting position. The timer time t3 is set at a time required for the first support member 19 to shift from the first actuation position Ap1 to the second actuation position Ap2, and is set so that the timer time t3 has elapsed after the support member 19 shifted to the second actuation position Ap2 (St09).

Then, the control means 50 detects the state in which the first support member 19 returns to the waiting position Wp with the home position sensor Sp1. Then, the control means 50 determines whether or not a subsequent sheet exists with the information from the image formation apparatus (St10).

When the subsequent sheet exists, the means 50 repeats prior steps 05 to 10. Then, when the subsequent sheet does not exist, the means 50 halts the apparatus as job finish (St11). In addition, timing at which the first support means 19 starts shifting to the actuation position Ap side may be after the sheet rear end separates from the nip point of the sheet discharge roller 14*b*, and it is essential only that at least after the sheet rear end separates from the nip point of the sheet discharge roller 14*b*, the first support member 19 shifts in the direction (sheet discharge direction side) for shifting from the waiting position to the actuation position with the sheet engagement surface 19*s* of the first support member 19 engaging in the sheet lower surface.

Thus, in discharging sheets on a sheet-by-sheet basis in the first sheet discharge mode, the first support member 19 performs back and forth operation among the waiting position Wp and the actuation positions Ap1 and Ap2 on a sheet-by-sheet basis, and the sheet rear end does not remain on the sheet discharger roller periphery or rear end regulation surface 16. Further, since the sheet side edge (sheet lower surface) is guided with the end surface guide 20*e* of the second support member 20, the sheet is offset in the direction away from the second support member 20 in the sheet-discharge orthogonal direction and is dropped.

Further, in the first sheet discharge mode, the second support member 20 may be shifted to the actuation position side by a predetermined amount, so that the end surface guide 20*e* of the second support member 20 contacts the lower surface of the discharged sheet side edge (see FIGS. 26A and 26B). By this means, the sheet discharged in the center reference is guided by the second support member 20, and is capable of being offset in the direction away from the second support member 20 in the sheet-discharge orthogonal direction and dropping. Accordingly, as compared with a free fall drop of a sheet, the alignment property of the sheet discharged to the stack tray 15 is improved by guiding the sheet to one side (on the side opposite to the second support member 20) in the sheet-discharge orthogonal direction. Further, it is desirable to change the sheet contact position of the second support member 20 corresponding to the sheet size as shown in FIG. 26A.

[Second Sheet Discharge Mode]

Operation when the second sheet discharge mode is selected as the sheet discharge mode will be described next according to FIG. 24. Upon receiving a command signal of the second sheet discharge mode from the image formation control section 45, the control means 50 executes the following initial setting operation. The means 50 shifts the first and second support members 19, 20 from the home positions (waiting positions) to the actuation positions.

Concurrently therewith, the control means 50 rotates the shift motor SM1 of the first shift means 21 and the second shift motor SM2 of the second shift means 22 in respective predetermined directions, and shifts the positions of the first and second support members 19, positioned in the home positions to the actuation positions Ap above the paper mount surface 15*a* (St12). Concurrently therewith, the control means 50 shifts the friction transport body 27 to the waiting position. The means 50 positions the travel motor M3 of the friction transport body described previously in the home position to rotate. By this rotation, the friction transport body 27 waits in the retract position retracted to above the first and second support members 19, 20.

Further, the control means 50 shifts the position of the rear end contact surface 39*s* provided in the bent piece 39 of the slide member 38 to the waiting position retracted to outside the tray. In this operation, the pusher motor M5 is actuated, and the sensor flag is detected with the position sensor Ps5.

By the initial operation as described above, the first and second support members 19, 20 are positioned between the sheet discharge outlet 13 and the paper mount surface 15*a* while protruding to the inside of the tray, and are prepared in a state enabling the sheet rear end portion fed from the sheet discharge outlet 13 and the sheet side end portion respectively to be mounted on the first support member 19 and second support member 20.

Next, upon receiving a sheet discharge instruction signal from the image formation control section 45, the control means 50 rotates the transport motor M1, and carries in an image-formed sheet from the carry-in entrance 12. This sheet passes through the sheet carry-in path 11, is guided to the sheet discharge outlet 13, and is loaded from the sheet discharge outlet 13 on the first and second support members 19, 20 below.

With reference to a signal such that the sheet discharge sensor Se2 detects the sheet rear end portion, after a lapse of a predetermined time, the control means 50 rotates the travel motor M3 a predetermined angle. By this travel motor, the friction transport body 27 shifts from the waiting position retracted to above the sheet top surface to the actuation position to engage in the top surface of the sheet, and drags and transports the sheet in the travel direction inclined a predetermined angle with respect to the sheet discharge direction (St15). At this point, the sheet rear end is struck by the rear end regulation stopper 24, the sheet side edge is struck by the side edge regulation stopper 25, and the sheet is positioned (St15).

By subsequent rotation of the travel motor M3, the friction transport body 27 returns to the waiting position spaced above the sheet, and the motor is halted. By repeating the operation of steps St14 and St15 as described above, sheets continuously fed from the sheet discharge outlet 13 are collected on the first and second support members 19, 20 and collated (St16). In addition, in the case of no subsequent sheet, the aligning transport means 26 (friction transport body 27) does not shift to the home position, and halts in the sheet strike position in FIG. 11B. Next, upon receiving a job end signal from the image formation control section 45, the control means 50 issues a post-processing operation instruction (command) signal. Upon receiving this command signal, the post-processing unit 23 executes the post-processing operation, and after finish of the operation, transmits a processing end signal to the control means 50.

Then, the control means 50 starts backward operation of the second support member 20 (St19), and support of a bunch of sheets by the second support member 20 is released. Subsequently, the means 50 starts the pusher motor M5, and shifts the rear end contact surface 39S of the bent piece 39 of the slide member 38 from the waiting position to the predetermined position inside the tray. Then, the rear end of the bunch of sheets supported by the first support member 19 is pushed to the predetermined position above the paper mount surface 15*a* (St20). Subsequently, the means 50 starts backward operation of the first support member 19 (St21). In addition, operation start timing of backward of the second support member 20, proceeding of the slide member 38 and backward of the first support member 19 is not limited to shifting to next operation after completing each operation, and it is essential only that the first support member 19 supports the rear end of the bunch of sheets at least at the time support of the bunch of sheets by the second support member 20 is released. Then, after the first and second support members 19, 20 return to the home positions (St22), the control means 50 determines whether or not a subsequent sheet exists, and when the subsequent sheet exists, returns to step S12 to repeat operation of the same prior steps St12 to St22. Meanwhile, when the subsequent sheet does not exist, the means 50 halts the operation as job finish.

Thus, in the second sheet discharge mode, a bunch of sheets is formed by repeating temporarily mounting a sheet on the first support member 19 and second support member 20 and causing the sheet to strike the side edge regulation stopper 25 and rear end regulation stopper 24 by the aligning transport means 26. Subsequently, the means 50 executes the post-processing operation (that is not executed in the third sheet discharge mode described later), first retracts the second support member 20 to push the bunch of sheets by the slide member 38, retracts the first support member 19 and thereby drops the bunch of sheets onto the stack tray 16. Accordingly, the bunch of sheets is mounted while offsetting to the second support member 20 side in the sheet-discharge orthogonal direction of the sheet (the side closer to the second support member 20 and side edge regulation stopper 25 than the sheet discharged in the center reference).

In addition, in retracting the first support member 19 and second support member 20, the second support member 20 is first retracted, and the rear end of a bunch of sheets is thereby supported by the first support member 19. Accordingly, the front end of the bunch of sheets hangs over the stack tray 15, the front end portion lands on the stack tray, the first support member 19 is next retracted, the sheet bunch rear end portion thereby lands, and the bunch of sheets drops onto the stack tray. By this means, it is possible to suppress fluctuations in the sheet width direction (sheet-discharge orthogonal direction) of the bunch of sheets.

[Third Sheet Discharge Mode]

Described next is the case where the third sheet discharge mode is selected as the sheet discharge mode. In this mode, sheets fed from the sheet discharge outlet 13 are sorted (jog sorted) for each number of copies and stored on the paper mount surface 15*a*. In regard to the jog sort mechanism, FIGS. 19A and 19B describe Embodiment 1, and FIGS. 20A and 20B describe Embodiment 2. Operation of each Embodiment will be described.

Upon receiving a job end signal next, the control means 50 executes the first sheet discharge mode, and repeats the mode sequentially. By such operation, in the first sheet discharge mode, sheets discharged from the sheet discharge outlet 13 on a sheet-by-sheet basis are guided by the second support member 20, and thereby are collected on the stack tray 15 on a sheet-by-sheet basis while being offset in the direction away from the second support member 20 in the sheet-discharge orthogonal direction (reference numeral Sh1 in FIG. 26B), and in the second sheet discharge mode, sheets are collected on the stack tray 15 with the sheet discharge position being offset to the second support member 20 side by a predetermined amount in the sheet-discharge orthogonal direction (reference numeral Sh2 in FIG. 26B). By such operation, sheets are jog-sorted and stored for each number of copies on the stack tray (St25). By this means, the sheets discharged in the first sheet discharge mode and the sheets discharged in the second sheet discharge mode are discharged to the stack tray 15 while being offset in the mutually away directions, and therefore, sorting of bunches of sheets is clarified in jog sort. In addition, in the second sheet discharge mode of this case, the operation (post-processing operation) in steps 17 and 18 described previously is not executed.

[Sheet Discharge Operation in Embodiment 1 of the Jog Sort]

The control means 50 sorts sheets fed from the sheet discharge outlet 13 into the non-offset position "nof" and the offset position "of" in the sheet-discharge orthogonal direction to store on the paper mount surface 15*a*. Therefore, the control means 50 stores (St23) sheets fed to the sheet discharge outlet 13 on the stack tray 15 by the same operation as in the first sheet discharge mode. Then, upon receiving a job end signal, the control means 50 executes the sheet discharge operation of the second sheet discharge mode (St24). At this point, among the steps of the second sheet discharge mode, the post-processing operation (St17) is not executed.

Next, upon receiving a job end signal, the control means 50 executes the first sheet discharge mode, and repeats the mode sequentially. By such operation, in the first sheet discharge operation, sheets are collected on the stack tray 15 in the sheet discharge reference (center reference or side reference) from the sheet discharge outlet 13, and in the second sheet discharge mode, sheets are collected on the stack tray 15 with the sheet discharge position being offset by a predetermined amount. By such operation, sheets are jog-sorted and stored for each number of copies on the stack tray 15 (St25). In addition, in the second sheet discharge mode in this case, the operation (post-processing operation) in step 17 described previously is not executed.

In addition, in Embodiment 1, in executing the first sheet discharge mode, the lower side of the sheet side edge may be guided by the second support member 20 to offset the sheet in the direction away from the second support member 20 in the sheet-discharge orthogonal direction (the direction opposite to the sheet offset direction in the second sheet discharge mode) to drop (see FIG. 26B). By this means, the sheets (reference numeral Sh1 in FIG. 26B) discharged in the first sheet discharge mode and the sheets (reference numeral Sh2 in FIG. 26B) discharged in the second sheet discharge mode are discharged to the stack tray 15 while being offset in the mutually away directions, and therefore, sorting of bunches of sheets is clarified in jog sort.

Thus, in Embodiment 1, sheets (bunches) are offset-discharged in the sheet-discharge orthogonal direction on the stack tray 15. At this point, as shown in steps St19 to St21, the second support member 20 that supports the sheet side edge is first retracted, then the first support member 19 that supports the sheet rear end is retracted, and therefore, the sheets are discharged to the stack tray 15 while landing in the sheet discharge direction. Accordingly, since the sheets do not fluctuate in the sheet-discharge orthogonal direction (offset direction), sorting is clarified in bunches of sheets discharged in the first sheet discharge mode and bunches of sheets discharged in the second sheet discharge mode.

In addition, in aligning sheets discharged onto the first and second support members 19, 20 in executing the second sheet discharge mode, sheets are required to be offset at least in the sheet-discharge orthogonal direction. As in this Embodiment, sheets may be offset and aligned in the inclined direction (in the sheet discharge direction and sheet-discharge orthogonal direction) toward the rear end regulation stopper 24 and side edge regulation stopper 25. Alternatively, sheets may be offset only in the direction (sheet-discharge orthogonal direction) for aligning only by the rear end regulation stopper 25.

[Sheet Discharge Operation in Embodiment 2 of the Jog Sort]

Embodiment 2 will be described next. As described according to FIGS. 20A and 20B, in Embodiment 2, with the first and second support members 19, 20 rested in the actuation positions Ap, sheets are carried out from the sheet discharge path 11 onto both support members. At this point, the aligning transport means 26 described previously causes the sheet to strike the rear end regulation stopper 24 and the side edge regulation stopper 25 to align and position.

As in the first sheet discharge mode as described previously, the control means 50 executes the initializing operation and initial setting operation (St30). This operation positions the first and second support members 19, 20 in the actuation positions Ap (St31), and rests the rear end contact surface 39*s* of the pusher means 37 in the waiting position Wp (St32). Then, the means 50 rotates the sheet discharge rollers 14*b* to wait for carrying-out of a sheet from the image formation apparatus A.

When a sheet is carried out of the image formation apparatus A, the control means 50 carries out the sheet from the sheet discharge outlet 13 onto the first and second support members (St33). Next, the control means 50 shifts the aligning transport means 26 to the actuation position in which the friction transport body 27 thereof engages in the sheet top surface from the waiting position, and shifts the sheet toward each of rear end and side edge regulation stoppers 24, 25 using the transport body travel means 28 to strike and align the sheet (St34).

Next, the control means 50 determines whether or not the image formation control section 45 issues a job end signal (St35). When the job is not finished in this determination, the means 50 repeats steps 33 and 34, and stacks a subsequent sheet on the preceding sheet to collect. Further, upon receiving a job end signal, the control means 50 determines whether the collected sheets are the odd-numbered copiers or the even-numbered, copiers (St36).

Then, at the time of the odd-numbered copies, the control means 50 shifts the sheet contact surface 39*s* of the pusher means 37 to the beforehand determined non-offset position "NOF" (St37). Meanwhile, in the even-numbered copies, the control means 50 shifts the pusher means 37 so that the sheet contact surface 39*s* coincides with the offset position "OF" (St38). By this operation, sheets collected on the first and second support members 19, 20 are sorted into the non-offset position "NOF" and offset position "OF" that are different positions spaced a distance in the sheet discharge direction.

Next, the control means 50 shifts backward the first support member 19 from the actuation position Ap to the retract position Wp (St39). In this operation, the sheets drop and land onto the paper mount surface 15*a* starting at the side edge on the opposite side while being supported by the second (side edge) support member 20. Then, the control means 50 shifts the second support member 20 from the actuation position Ap to the waiting position Wp, and the entire sheets drop onto the paper mount surface and are stored. In addition, operation start timing of backward operation of the first support member 19 and backward of the second support member 20 is not limited to shifting to next operation after completing each operation, and it is essential only that the second support member 20 supports the side edge of the bunch of sheets at least at the time support of the bunch of sheets by the first support member 19 is released.

Thus, in Embodiment 2, sheets (bunches) are offset-discharged in the sheet-discharge orthogonal direction on the stack tray 15. At this point, as shown in step St39, the first support member 19 that supports the sheet rear end is first retracted, then the second support member 20 that supports the sheet side edge is retracted, and therefore, the sheets are discharged to the stack tray 15 while landing in the sheet-discharge orthogonal direction. Accordingly, since the sheets do not fluctuate in the sheet discharge direction (offset direction), sorting is clarified in respective bunches of sheets discharged to the stack tray 15.

[Third Sheet Discharge Mode]

Figure 27A:
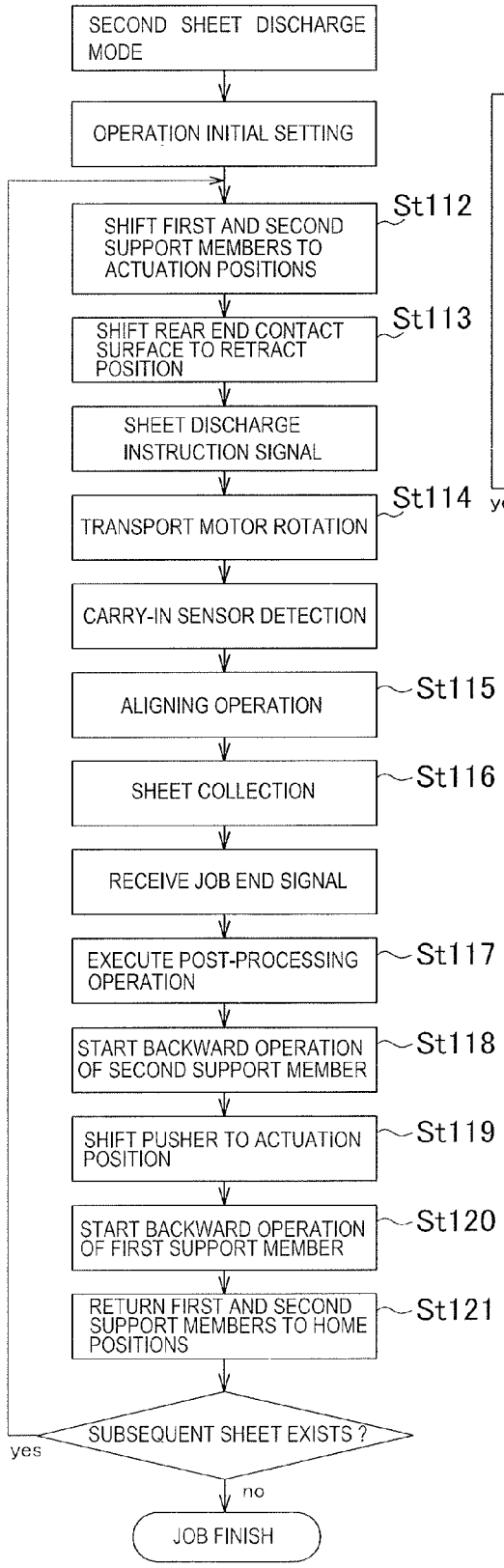
FIG. 27A is a diagram illustrating a sheet discharge mode of the post-processing apparatus of FIG. 2 and is an operation flow of the second sheet discharge mode.
Figure 27B:
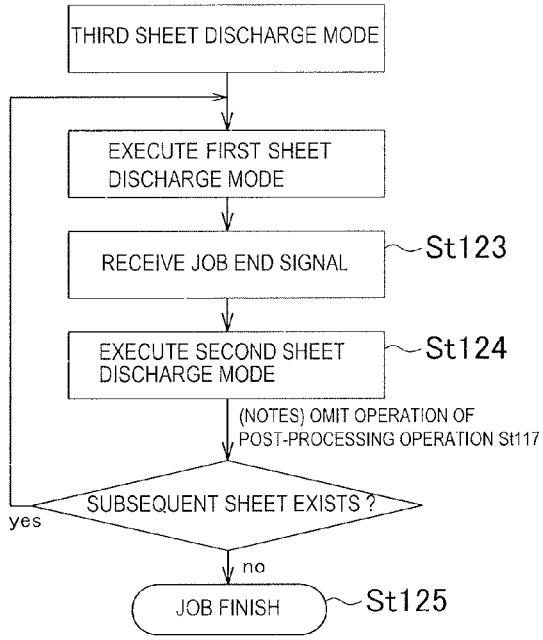
FIG. 27B is a diagram illustrating another sheet discharge mode of the post-processing apparatus of FIG. 2 and is an operation flow of the third sheet discharge mode.

The third sheet discharge mode may also be performed as described below. Operation when the third sheet discharge mode is selected as the sheet discharge mode will be described according to FIG. 27B. When the third sheet discharge mode is selected, by the same operation as in the first sheet discharge mode, the control means 50 stores sheets fed to the sheet discharge outlet 13 on the stack tray 15 (St123). Then, upon receiving a job end signal, the control means 50 executes sheet discharge operation of the second sheet discharge mode (St124).

Next, upon receiving a job end signal, the control means 50 executes the first sheet discharge mode, and repeats the mode sequentially. By such operation, in the first sheet discharge operation, sheets are collected on the stack tray 15 in the sheet discharge reference (center reference or side reference) from the sheet discharge outlet 13. In the next second sheet discharge mode, sheets are collected on the stack tray 15 with the sheet discharge position being offset by a predetermined amount. By such operation, sheets are jog-sorted and stored for each number of copies on the stack tray (St125). In addition, in the second sheet discharge mode in this case, the operation (post-processing operation) in steps 17 and 18 is not executed.

In addition, in executing the first sheet discharge mode, the lower side of the sheet side edge may be guided by the second support member 20 to offset the sheet in the direction away from the second support member 20 in the sheet-discharge orthogonal direction (the direction opposite to the sheet offset direction in the second sheet discharge mode) to drop (see FIG. 26B). By this means, the sheets (reference numeral Sh1 in FIG. 26B) discharged in the first sheet discharge mode and the sheets (reference numeral Sh2 in FIG. 26B) discharged in the second sheet discharge mode are discharged to the stack tray 15 while being offset in the mutually away directions, and therefore, sorting of bunches of sheets is clarified in jog sort.

In addition, in this Embodiment, instead of configuring the movable guide means 19 using the support member, the means 19 may be configured using a guide member which simply engages in the sheet lower surface to guide the lower surface of the sheet that is carried out to a predetermined position between the sheet discharge outlet 13 and the paper mount surface 15*a*, and the guide member may be configured to be able to reciprocate between a retract position and an actuation position in the sheet discharge direction and to be able to shift to positions in the sheet discharge direction by a predetermined amount while engaging in the sheet lower surface in the actuation position.

The post-processing may be performed as described below.

[Post-Processing Operation]

Figure 28:
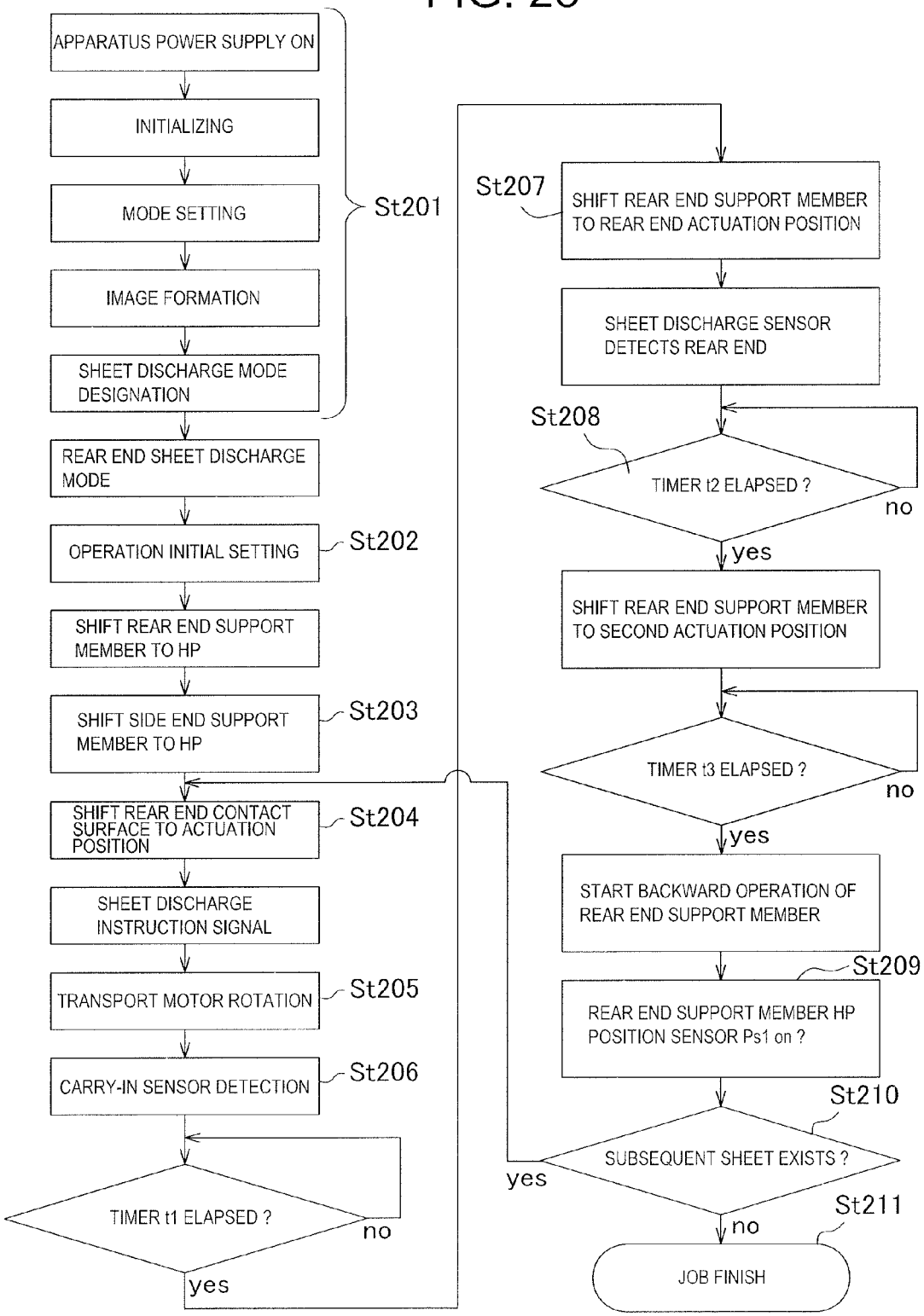
FIG. 28 is an operation explanatory diagram (flowchart) of the first sheet discharge mode of the post-processing apparatus of FIG. 2.
Figure 29A:
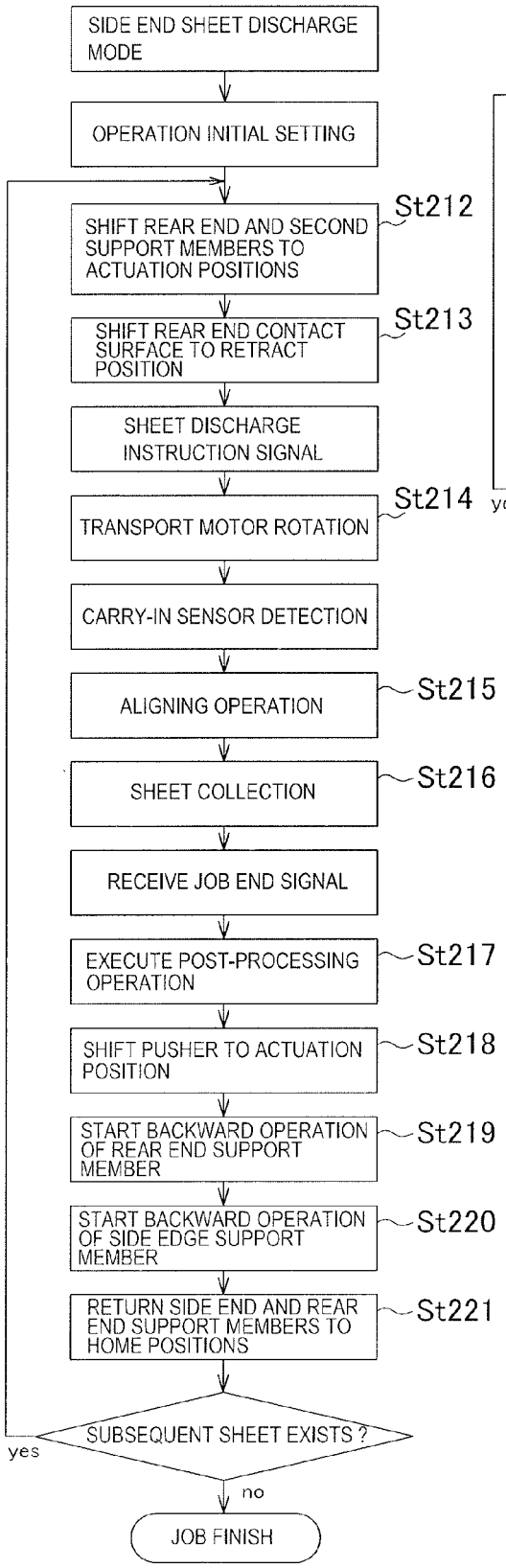
FIG. 29A is an operation flow of a sheet discharge mode of the post-processing apparatus of FIG. 2 and illustrates the second sheet discharge mode.
Figure 29B:
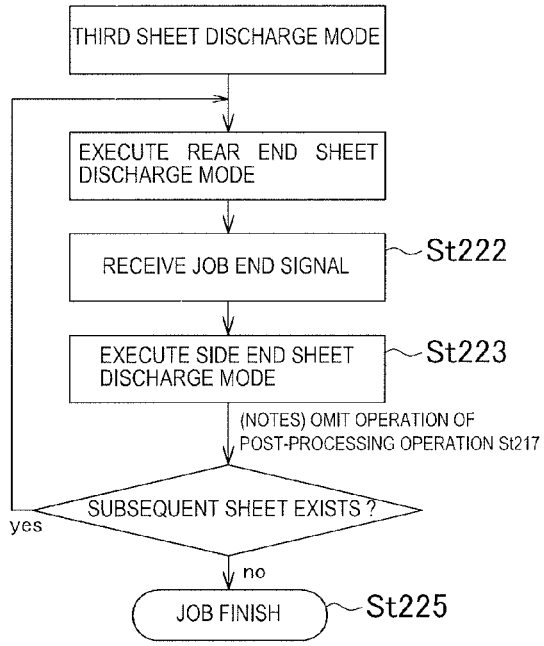
FIG. 29B is an operation flow of another sheet discharge mode of the post-processing apparatus of FIG. 2 and illustrates the third sheet discharge mode.

FIG. 28 shows the case where the first sheet discharge mode (printout sheet discharge operation) is set in the mode setting in the image formation apparatus A, and FIGS. 29A and 29B show the case where the second sheet discharge mode (staple binding operation) and the third sheet discharge mode (jog sheet discharge operation) are set.

The sheet discharge control means 50 executes initializing operation in apparatus power supply ON (St201). For example, this initializing operation is to execute the following initial position setting. The means 50 detects whether the rear end support member 19 is in the retract position Wp (home position) using the position sensor Ps1, and in "No", shifts to the sensor "ON" position. Similarly, the side edge support member 20 is shifted to the retract position Wp (home position).

Next, the pusher means 37 is shifted to the home position. In the apparatus shown in the figure, the home position is set at the retract position Wp, and the paper press surface 39*s* is retraced to outside the stack tray 15 (states of FIGS. 5A and 5B). Further, this initializing operation is to set the post-processing means 23 (the means shown in the figure is the staple unit) at the initial state.

[First Sheet Discharge Mode]

Then, the sheet discharge control means 50 receives a mode setting signal from the image formation control section 45. When the first sheet discharge mode is designated with this command signal, the post-processing control means 50 executes the following initial operation (St202)

Further, as the initial operation setting, the sheet discharge control means 50 determines whether or not the rear end support member 19 and side edge support member 20 are positioned in the home positions. When the members are in positions except the home positions, the positions of the members are shifted to the home positions (St203). Concurrently therewith, the sheet discharge control means 50 shifts the paper press surface 39*s* of the sheet push member 38 to a regulation position protruding to inside the tray (state of FIG. 3A; St204). This operation shifts the sheet push member 38 from the home position by a beforehand set shift amount with the pusher motor M5. Then, the paper press surface 39*s* is set at the position protruding slightly to the inside of the tray from the rear end regulation surface 16 of the stack tray 15.

Upon receiving a job start signal from the image formation control section 45, the post-processing control section 50 rotates the transport motor M1 to rotate the transport rollers 14*a* and sheet discharge rollers 14*b* in the sheet discharge direction (St205). By this means, the sheet carried out to the main-body sheet discharge outlet 6 is carried in the sheet carry-in path 11, and the carry-in sensor Se1 detects the sheet front end. For example, this detection signal is used in determining a sheet jam from a time difference between detection of the sheet front end with this sensor and subsequent detection of the sheet rear end and the sheet size information and the like, and thus is used in control of the subsequent post-processing operation (St206).

The control means 50 starts a timer t1 when the carry-in sensor Se1 detects the sheet front end. This timer t1 time is set at a predicted time such that the sheet front end arrives at a predetermined position from the sheet discharge outlet 13. When this time t1 has elapsed, the control means 50 shifts the rear end support member 19 from the retract position Wp to the actuation position Ap (St207). Accordingly, the timer time t1 is set at timing at which the sheet front end shifts from the sheet discharge outlet 13 to the predetermined actuation position Ap and then the sheet engagement surface 19*s* of the rear end support member 19 engages in the sheet lower surface.

When the sheet discharge sensor Se2 detects the sheet rear end, the control means 50 starts a timer t2 (St208). This timer time t2 is set at timing at which the sheet rear end separates from the nip point of the sheet discharge rollers 14*b*.

The control means 50 detects a state in which the rear end support member 19 returns to the retract position Wp with the home position sensor Sp1 (St209). Then, the means 50 determines whether or not a subsequent sheet exists with the information from the image formation apparatus (St210). When the subsequent sheet exists, the control means repeats prior steps St205 to St210. Then, when the subsequent sheet does not exist, the means 50 halts the apparatus as job finish (St211).

[Second Sheet Discharge Mode]

Operation when the second sheet discharge mode is selected as the sheet discharge mode will be described next according to FIG. 29A. Upon receiving a command signal of the second sheet discharge mode from the image formation control section 45, the control means 50 executes the following initial setting operation. The means 50 shifts the rear end support member 19 and side edge support member 20 from the home positions (retract positions) to the actuation positions.

Concurrently therewith, the control means 50 rotates the shift motor SM1 of the first tray shift means 21 and the second shift motor SM2 of the second tray shift means 22 in respective predetermined directions, and shifts the positions of the rear end support member 19 and side edge support member 20 positioned in the home positions to the actuation positions Ap above the paper mount surface 15*a* (St212). Concurrently therewith, the control means 50 shifts the friction transport body 27 to the retract position. The means 50 positions the travel motor M3 of the friction transport body described previously in the home position to rotate. By this rotation, the friction transport body 27 waits in the retract position retracted to above the rear end support member 19 and side edge support member 20.

Further, the control means 50 shifts the position of the paper press surface 39*s* provided in the bent piece 39 of the slide member 38 to the retract position Wp retracted to outside the stack tray 15. In this operation, the pusher motor M5 is actuated, and the sensor flag is detected with the position sensor Ps5.

By the initial operation as described above, the rear end support member 19 and side edge support member 20 are positioned between the sheet discharge outlet 13 and the paper mount surface 15*a* while protruding to the inside of the tray, and are prepared in a state enabling the sheet rear end portion fed from the sheet discharge outlet 13 and the sheet side edge portion respectively to be mounted on the rear end support member and side edge support member 20.

Next, upon receiving a sheet discharge instruction signal from the image formation control section 45, the control means 50 rotates the transport motor M1, and carries in an image-formed sheet from the carry-in entrance 12. This sheet passes through the sheet carry-in path 11, guided to the sheet discharge outlet 13, and is loaded from the sheet discharge outlet on the rear end support member 19 and side edge support member 20 below.

With reference to a signal such that the sheet discharge sensor Se2 detects the sheet rear end portion, after a lapse of a predetermined time, the control means 50 rotates the travel motor M3 a predetermined angle. By this travel motor, the friction transport body 27 shifts from the retract position retracted to above the sheet top surface to the actuation position to engage in the top surface of the sheet, and drags and transports the sheet in the travel direction inclined a predetermined angle with respect to the sheet discharge direction (St215). At this point, the sheet rear end is struck by the rear end regulation stopper 24, the sheet side edge is struck by the side edge regulation stopper 25, and the sheet is positioned.

By subsequent rotation of the travel motor M3, the friction transport body 27 returns to the retract position spaced above the sheet, and the motor is halted. By repeating the operation of steps 14 and 15 as described above, sheets continuously fed from the sheet discharge outlet 13 are collected on rear end support member 19 and side edge support members 20 and collated (St216). Next, upon receiving a job end signal from the image formation control section 45, the control means 50 issues a post-processing operation instruction (command) signal. Upon receiving this command signal, the post-processing unit 23 performs the post-processing operation (St217), and after finish of the operation, transmits a processing end signal to the control means 50.

Then, the control means 50 starts the pusher motor M5, and shifts the paper press surface 39*s* of the bent piece 39 of the sheet press member 38 from the retract position to the predetermined position inside the stack tray 15. Then, the rear end of the bunch of sheets supported by the rear end support member 19 is pushed to the predetermined position above the paper mount surface (St218). Subsequently, the control means 50 starts backward operation of the rear end support member 19 (St219), and almost concurrently therewith, starts backward operation of the side edge support member 20 (St220). Then, after the rear end support member 19 and side edge support member 20 return to the home positions (St221), the control means 50 determines whether or not a subsequent sheet exists, and when the subsequent sheet exists, returns to step S212 to repeat operation of the same prior steps St212 to St221. Meanwhile, when the subsequent sheet does not exist, the means 50 halts the operation as job finish.

[Third Sheet Discharge Mode]

Operation when third sheet discharge mode is selected as the sheet discharge mode will be described next according to FIG. 29B. When the third sheet discharge mode is selected, the control means 50 stores a sheet fed to the sheet discharge outlet 13 by the same operation as in the first sheet discharge mode (St222). The, the control means 50 receiving a job end signal executes the sheet discharge operation of the second sheet discharge mode (St223).

Next, upon receiving a job end signal, the control means 50 executes the first sheet discharge mode, and repeats the mode sequentially. By such operation, in the first sheet discharge operation, sheets are collected on the stack tray 15 in the sheet discharge reference (center reference or side reference) from the sheet discharge outlet 13, and in the second sheet discharge mode, sheets are collected on the stack tray 15 with the sheet discharge position being offset by a predetermined amount. By such operation, sheets are jog-sorted and stored for each number of copies on the stack tray 15.

Further, the post-processing operation may be performed as described below.

[Post-Processing Operation]

Figure 30:
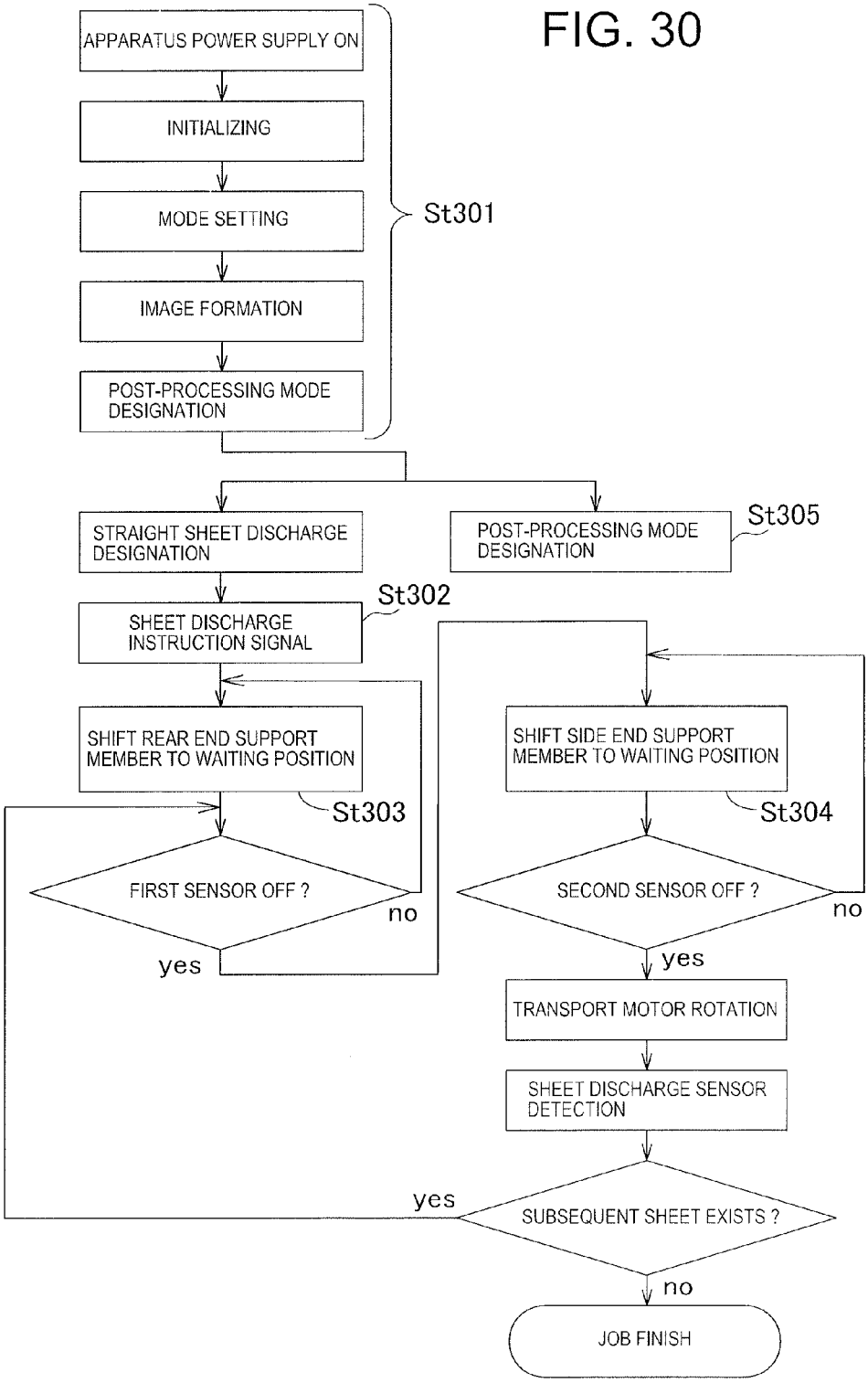
FIG. 30 is an operation explanatory diagram (flowchart) of the first sheet discharge mode of the post-processing apparatus of FIG. 2.
Figure 31:
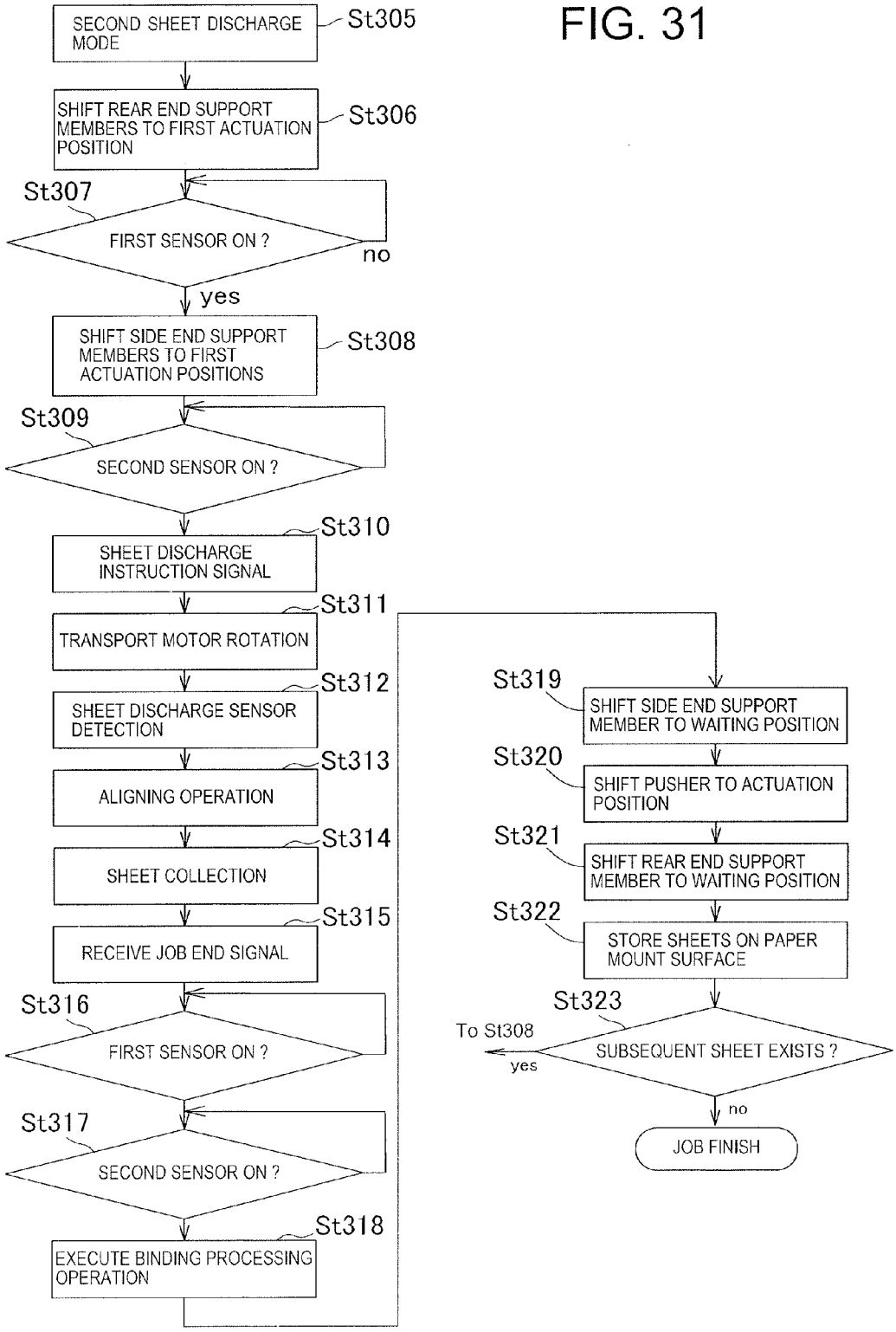
FIG. 31 is an explanatory diagram of a staple binding mode (second sheet discharge mode) of the post-processing apparatus of FIG. 2.
Figure 32:
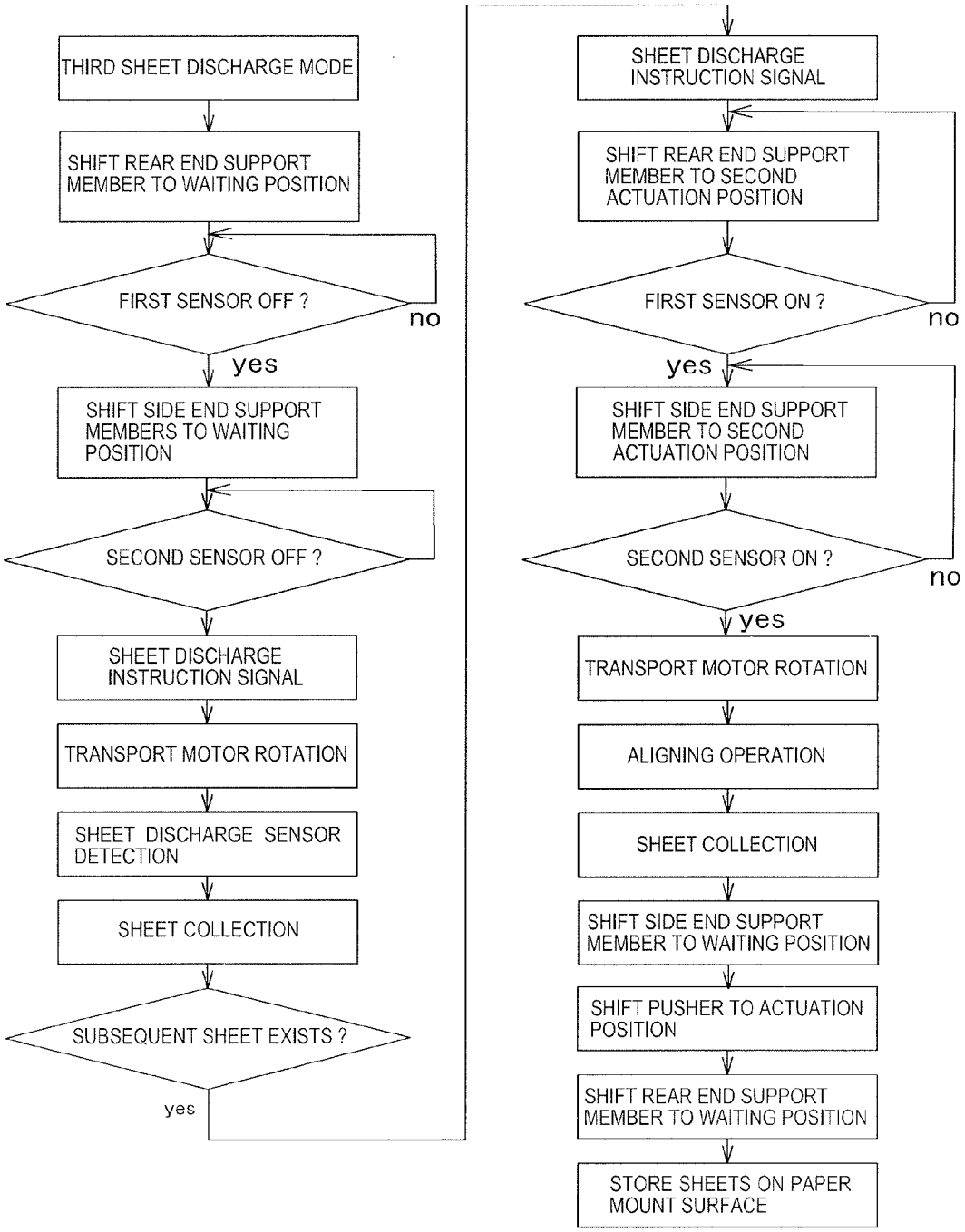
FIG. 32 is an explanatory diagram of a jog sort mode (third sheet discharge mode) of the post-processing apparatus of FIG. 2.

FIG. 30 shows the case where the first sheet discharge mode (printout sheet discharge operation) is set in the mode setting in the image formation apparatus A. FIG. 31 shows the second sheet discharge mode (binding processing sheet discharge operation), and FIG. 32 shows the case where the third sheet discharge mode (jog sort sheet discharge operation) is set.

The first sheet discharge mode will be described. The control means 50 executes initializing operation in apparatus power supply ON (St301). In this initializing operation, the post-processing apparatus B is set at an initial state. The rear end support member 19 is positioned in the waiting position Xp3, and this position is detected by the sensor Ps1. Further, the side end support member 20 is positioned in the waiting position Yp3, and this position is detected by the sensor Ps2. In addition, each support member in this waiting position makes the first sensor Ts1 and second sensor Ts2 constituting the tray position detection means 41 each OFF state.

Next, the control means 50 shifts the pusher means 37 to the home position. In the apparatus shown in the figure, the home position is set at the retract position, and the paper press surface 39*s* is retraced to outside the stack tray 15 (states of FIGS. 5A and 5B). Further, this initializing operation sets the post-processing means 23 (the means shown in the figure is the staple unit) at the initial state.

[First Sheet Discharge Mode (Printout Mode)]

Then, the sheet discharge control means 50 receives a mode setting signal from the image formation control section 45. When the first sheet discharge mode is designated with this command signal, the post-processing control means executes the following operation.

Upon receiving a sheet discharge instruction signal from the image formation apparatus A (St302), the control means 50 determines whether or not the rear end support member 19 is positioned in the waiting position Xp3 with the first sensor Ts1 (St303). Next, the means 50 determines whether or not the side end edge support member 20 is positioned in the waiting position Yp3 with the second sensor Ts2 (St304). In each position detection, when the position sensor Ps1 described previously is ON and the first sensor Ts1 is OFF, the rear end support member 19 is positioned in the waiting position Xp3. Meanwhile, when the position sensor Ps2 is ON and the second sensor Ts2 is OFF, the side end support member 20 is positioned in the waiting position Yp3.

When the rear end support member 19 and the side end support member 20 are not positioned in the waiting positions, the control means 50 shifts the member to the waiting position. After positioning both support members in the waiting positions, the means 50 starts sheet discharge operation. Upon receiving a sheet discharge instruction signal from the image formation apparatus A, the control means 50 starts the transport motor M1, and rotates the transport rollers 14*a* of the sheet transport path 11 in the sheet discharge direction. Then, in a sheet fed from the image formation apparatus A, the carry-in sensor Se1 detects the front end, and the sheet discharge sensor Se2 detects the sheet front end and rear end.

Thus, when the first sheet discharge mode is set, the control means 50 positions the rear end support member 19 and side end support member 20 in the waiting positions Xp3 and Yp3, and discharges the sheet from the sheet discharge outlet 13 to the paper mount surface 15*a* of the stack tray 15 with the transport rollers 14*a* in the sheet transport path 11. Then, sheets are stacked sequentially upward in a stacked shape on the paper mount surface 15*a* and stored. In addition, in the Embodiment as shown in the figure, it is set that sheets of different sizes are carried out from the sheet discharge outlet in the center reference.

[Second Sheet Discharge Mode (Binding Processing Mode)]

Operation when the second sheet discharge mode (staple binding processing mode) is selected as the sheet discharge mode will be described next according to FIG. 31. Upon receiving a command signal of the second sheet discharge mode from the image formation control section 45, the control means 50 executes the following initial setting operation. The means 50 shifts the side end support member 19 and side end support member 20 from the home positions (retract positions) to the actuation positions Xp1, Yp1.

Concurrently therewith, the control means 50 rotates the shift motor SM1 of the first tray shift means 21 and the shift motor SM2 of the second tray shift means 22 in respective predetermined directions, and shifts the positions of the side end support member 19 and side end support member 20 positioned in the home positions to the actuation positions Xp1 above the paper mount surface 15*a* (St306~St308). Concurrently therewith, the control means 50 shifts the friction transport body 27 to the retract position. The means 50 positions the travel motor M3 of the friction transport body described previously in the home position to rotate. By this rotation, the friction transport body 27 waits in the retract position retracted to above the side end support member 19 and side end support member 20.

Further, the control means 50 shifts the position of the paper press surface 39*s* provided in the bent piece 39 of the slide member 38 to the retract position retracted to outside the stack tray 15. In this operation, the pusher motor M5 is actuated, and the sensor flag is detected with the position sensor PS5.

By the initial operation as described above, the side support member 19 and side end support member 20 are positioned between the sheet discharge outlet 13 and the paper mount surface 15*a* while protruding to the inside of the tray, and are prepared in a state enabling the sheet rear end portion fed from the sheet discharge outlet 13 and the sheet side edge portion respectively to be mounted on the rear end support member 19 and side end support member 20.

Next, upon receiving a sheet discharge instruction signal from the image formation control section 45 (St310), the control means 50 rotates the transport motor M1, and carries in an image-formed sheet from the carry-in entrance 12 (St311). This sheet passes through the sheet carry-in path 11, guided to the sheet discharge outlet 13, and is loaded from the sheet discharge outlet on the side end support member 19 and side end support member 20 below.

With reference to a signal such that the sheet discharge sensor Se2 detects the sheet rear end portion (St312), after a lapse of a predetermined time, the control means 50 rotates the travel motor M3 a predetermined angle. By this travel motor, the friction transport body 27 shifts from the retract position retracted to above the sheet top surface to the actuation position to engage in the top surface of the sheet, and drags and transports the sheet in the travel direction inclined a predetermined angle with respect to the sheet discharge direction (St313). At this point, the sheet rear end is struck by the rear end regulation stopper 24, the sheet side edge is struck by the side edge regulation stopper 25, and the sheet is positioned.

By subsequent rotation of the travel motor M3, the friction transport body 27 returns to the retract position spaced above the sheet, and the motor is halted. By repeating the operation of steps 10 and 13 as described above, sheets continuously fed from the sheet discharge outlet 13 are collected on side end support member 19 and side end support members 20 and collated (St314). Next, upon receiving a job end signal from the image formation control section 45, the control means 50 issues a post-processing operation instruction (command) signal. Upon receiving this command signal, the post-processing unit 23 performs the post-processing operation (St316), and after finish of the operation, transmits a processing end signal to the control means 50.

Then, the control means 50 starts the pusher motor M5, and shifts the paper press surface 39*s* of the bent piece 39 of the sheet press member 38 from the retract position to the predetermined position inside the stack tray 15 (St319). Then, the rear end of the bunch of sheets supported by the rear end support member 19 is pushed to the predetermined position above the paper mount surface (St320). Subsequently, the control means 50 starts backward operation of the rear end support member 19 (St321), and almost concurrently therewith, starts backward operation of the side end support member 20. Then, after the rear end support member 19 and side end support member 20 return to the home positions, the control means 50 determines whether or not a subsequent sheet exists (St323), and when the subsequent sheet exists, returns to step S312 to repeat operation of the same prior steps St312 to St322. Meanwhile, when the subsequent sheet does not exist, the means 50 halts the operation as job finish.

[Third Sheet Discharge Mode (Jog Sort Mode)]

Operation when the third sheet discharge mode is selected as the sheet discharge mode will be described next according to FIG. 32. When the third sheet discharge mode is selected, the control means 50 stores a sheet fed to the sheet discharge outlet 13 on the stack tray 15 by the same operation as in the first sheet discharge mode. When the third sheet discharge mode is selected, the control means 50 stores a sheet fed to the sheet discharge outlet 13 on the paper mount surface 15*a* of the stack tray 15 by the same operation as in the first sheet discharge mode. Then, when first collating is finished, the control means 50 collects subsequent sheets fed from the sheet discharge outlet 13 on the sub-tray 18 by the same operation as in the second sheet discharge mode. The sheets are collected while being positioned by the rear end regulation stopper 24 and side edge regulation stopper 25.

Then, using a job end signal from the image formation section, the control means 50 stores a bunch of sheets collected on the sub-tray on the paper mount surface of the stack tray. At this point, in the second sheet discharge mode as described previously, the control means 50 sets the position of each support members at the first actuation position Xp1 or Yp1, and in contrast thereto, in the third sheet discharge mode, portions in the second actuation position Xp2 or Yp2. Then, the control means 50 receiving a job end signal executes the sheet discharge operation of the second sheet discharge mode.

Next, upon receiving a job end signal, the control means 50 executes the first sheet discharge mode, and repeats the mode sequentially. By such operation, in the first sheet discharge operation, sheets are collected on the stack tray 15 in the sheet discharge reference (center reference or side reference) from the sheet discharge outlet 13, and in the second sheet discharge mode, sheets are collected on the stack tray 15 with the sheet discharge position being offset by a predetermined amount. By such operation, sheets are jog-sorted and stored for each number of copies on the stack tray.

[Staple Operation Control]

The control means 50 detects whether or not the positions of the rear end support member 19 and side end support member 20 are in the staple processing operation state, and thereby controls the staple operation to be prohibited or executable.

The control means 50 shown in the figure detects the positions of the rear end and side end support members 19, 20, and supplies power to the staple apparatus when both the first sensor and second sensor described previously are ON, while interrupting power supply to the staple apparatus when any one of the sensors is OFF so as to "allow the staple apparatus to perform the binding processing operation" when both support members are in the staple binding state, while "prohibiting the processing of the staple apparatus" when both or one of the support members is in a state except the staple binding state.

Meanwhile, the control means 50 may be of a configuration for detecting the position of one of the rear end and side end support members 19, 20, and interrupts power supply to the staple apparatus so as to "allow the staple apparatus to perform the binding processing operation" when the one of the support members is in the staple binding state, while "prohibiting the processing of the staple apparatus" when the one of the support members is in a state except the staple binding state.

In addition, this Embodiment describes the case of prohibiting the staple operation with the switching circuit for interrupting power supply to the staple apparatus, and may adopt a shutter mechanism for interrupting space into which the staple apparatus proceeds from outside the apparatus housing.

Supplements A1 to A10, etc. are added to the above-mentioned Embodiments.

(Supplement A1)

A sheet storage apparatus characterized by being provided with a sheet discharge path having a sheet discharge outlet, a stack tray having a paper mount surface disposed on the downstream side of the sheet discharge outlet with a height difference formed, a sheet discharge roller disposed in the sheet discharge outlet, movable guide means for carrying out a sheet from the sheet discharge outlet to the paper mount surface in cooperation with the sheet discharge roller, guide shift means for shifting a position of the movable guide means between an actuation position above the paper mount surface and a retract position retracted therefrom, and sheet discharge control means for controlling the guide shift means, where in the movable guide means is formed a sheet engagement surface that engages in a lower surface of the sheet fed from the sheet discharge roller, the sheet engagement surface is configured to be able to reciprocate between the actuation position and the retract position, while being able to shift to a position by a predetermined amount in a sheet discharge direction in the actuation position, and the sheet discharge control means shifts the sheet engagement surface by a predetermined amount in the sheet discharge direction while engaging in the lower surface of sheet after a rear end of the sheet separates from the sheet discharge roller, and then, shifts backward toward the retract position.

(Supplement A2)

The sheet storage apparatus as described in supplement A1, characterized in that the sheet discharge control means shifts the position of the movable guide means so that the sheet engagement surface shifts from the retract position to the actuation position of engaging in the sheet lower surface during the operation for carrying out the sheet with the sheet discharge roller.

(Supplement A3)

The sheet storage apparatus as described in supplement A2, characterized by being further provided with an upper portion regulation surface provided between the sheet discharge outlet and the movable guide means to regulate a position of a rear end surface of the sheet on the movable guide means, and a lower portion regulation surface provided between the paper mount surface of the stack tray and the movable guide means to regulate a position of a rear end surface of a sheet loaded on the paper mount surface, where the upper portion regulation surface protrudes relative to the lower portion regulation surface in the sheet discharge direction.

(Supplement A4)

The sheet storage apparatus as described in any one of supplements A1 to A3, characterized in that the movable guide means is comprised of a plate member that enables the rear end portion of the sheet fed from the sheet discharge outlet to be loaded thereon in the actuation position, and that the sheet discharge control means has an operation mode for positioning and holding the movable guide means in the actuation position during operation for carrying out the sheet with the sheet discharge roller.

(Supplement A5)

The sheet storage apparatus as described in supplement A4, characterized in that the sheet discharge control means has at least a first sheet discharge mode and a second sheet discharge mode, the first sheet discharge mode is to execute operation for carrying out the sheet from the sheet discharge outlet to the stack tray, the second sheet discharge mode is to execute operation for collecting sheets fed from the sheet discharge outlet in the shape of a bunch on the plate member constituting the movable guide means, and in the first sheet discharge mode, the sheet discharge control means shifts the movable guide means between the actuation position and the retract position on a basis of a sheet fed from the sheet discharge outlet, and thereby discharges the sheet to the stack tray, and in the second sheet discharge mode, forms a bunch of sheets in a state in which the movable guide means is in the actuation position, then shifts the support member to the retract position, and thereby discharges the bunch of sheets to the stack tray.

(Supplement A6)

The sheet storage apparatus as described in supplement A3, characterized in that the upper portion regulation surface is comprised of a movable regulation member attached to an apparatus frame to be movable in position, and that the lower portion regulation surface is comprised of a fixed regulation member fixed to the apparatus frame, and that the movable regulation member is provided with regulation surface shift means for shifting a position of its sheet end regulation surface.

(Supplement A7)

The sheet storage apparatus as described in supplement A5, characterized in that the sheet discharge control means is configured to be able to execute a straight sheet discharge mode for carrying out a sheet from the sheet discharge outlet to the stack tray, and a sheet bunch formation mode for collecting sheets fed from the sheet discharge outlet on the movable guide means, and that the sheet end regulation surface of the movable regulation member is disposed in a position displaced by a predetermined amount so as to protrude to the paper mount surface side relative to the sheet end regulation surface of the fixed regulation member in the straight sheet discharge mode, while in the sheet bunch formation mode, retracting to a position spaced apart from sheets collected on the movable guide means.

(Supplement A8)

The sheet storage apparatus as described in supplement A5, characterized in that in the sheet bunch formation mode, the movable regulation member carries out the bunch of sheets collected on the movable guide means by the regulation surface shift means to the stack tray.

(Supplement A9)

The sheet storage apparatus as described in any one of supplements A1 to A8, characterized in that in the sheet discharge path is disposed sheet end detection means for detecting a rear end of the sheet carried out of the sheet discharge outlet, and that the sheet discharge control means shifts the movable guide means backward from the actuation position to the retract position, after shifting the movable guide means from the retract position to the actuation position based on a detection signal from the sheet end detection means and feeding the sheet rear end portion in the sheet discharge direction.

(Supplement A10)

An image formation system characterized by being comprised of an image formation apparatus that forms an image on a sheet sequentially, and a sheet storage apparatus provided with a stack tray to store the sheet fed from the image formation apparatus, where the sheet storage apparatus is the sheet storage apparatus as described in any one of supplements A1 to A9.

The background art, object and the others on the invention concerning supplements A1 to A10 will be described next. The invention concerning supplements A1 to A10 relates to the sheet storage apparatus that stores a sheet carried out of an image formation apparatus or the like on the stack tray, and relates to improvements in the sheet carrying-out mechanism for storing the sheet reliably on a tray paper mount surface.

Generally, this kind of sheet storage apparatus stores a sheet fed by a sheet discharge roller from a sheet discharge outlet disposed on the upstream side on a tray paper mount surface. A height difference forming a difference in height is formed between the sheet discharge outlet and the tray paper mount surface, and the sheet is fed out from the sheet discharge outlet starting at the front end to the rear end gradually. Then, after the sheet rear end separates from the roller, the sheet drops under its own weight, and is stacked on sheets stored on the paper mount surface.

In such a sheet discharge mechanism, the sheet rear end may remain (rear end remaining phenomenon) on the roller periphery positioned on the lower side after separating from the nip point. This is because large friction resistance works due to the effect of static electricity and the like when the sheet front end shifts in the sheet discharge direction while rubbing against the sheets stored on the paper mount surface, and there is a problem that the sheet is not carried out by the friction force of the roller periphery acting on the sheet rear end.

Then, Patent Document 2 (Japanese Unexamined Patent Publication No. 2001-26366) discloses a paddle sheet discharge mechanism installed on a roller rotating shaft so as to rotate an elastic member (paddle member) longer than the roller outside diameter in the sheet discharge direction on the roller side that engages in the sheet lower surface in carrying out a sheet carried out of an image formation apparatus by the sheet discharge roller.

Similarly, in also Patent Document 3 (Japanese Unexamined Patent Publication No. 2002-265117) is proposed a paddle sheet discharge mechanism in which a paddle member longer than the roller outside diameter is disposed on the roller rotating shaft of the sheet discharge roller to be rotatable, and a slide friction clutch is disposed between the rotating shaft and the paddle member. Then, when a sheet is nipped between the sheet discharge rollers, the paddle member engages in the sheet lower surface to remain in this position, and when the sheet rear end separates from the rollers, rotates in the same direction as that of the rollers At this point, the paddle front end kicks the sheet rear end to the tray side.

As described above, in storing a sheet from the sheet discharge roller on the stack tray on the downstream side, a sheet jam is sometimes invited in a state in which the sheet rear end is caught on the periphery of the roller that nips. To resolve such a sheet jam due to sheet rear end remaining, conventionally, the paddle mechanism is disposed on the same shaft as that of the sheet discharge roller to rotate the elastic piece made of rubber, resin or the like in the same direction as that of the roller. Alternatively, as distinct from the paddle mechanism, a press guide mechanism is adopted in which a press guide member that presses a sheet is disposed in the shape of landing steps on the tope surface of the sheet to carry out.

Then, when the paddle mechanism is adopted, the rear end of the sheet separating from the nip portion of the sheet discharge rollers is kicked by the paddle member in the sheet discharge direction. In this kick of the sheet rear end, the conveyed transport force is different between a sheet curled upward and a sheet curled downward, or is different between a thick strong sheet and a thin weak sheet. Accordingly, in the method of kicking the sheet rear end in the sheet discharge outlet, since the sheet is kicked out onto the tray paper mount surface in an unstable state, the storage posture is irregular or rear end remaining on the roller periphery may not be dissolved.

Meanwhile, in adopting the press mechanism in the shape of landing steps, the mechanism is a load in carrying out the sheet front end from the sheet discharge outlet, and sheet discharge failure may be invited in which a sheet curled downward in the sheet discharge direction is guided onto the tray so as to wind. Accordingly, it is desirable that the sheet discharge outlet of a sheet carries the sheet from the sheet discharge roller to the stack tray reliably with a simplified inexpensive structure without requiring space.

Then, the inventor of the present invention arrived at the idea of arranging, below the roller nip portion, a push out mechanism provided with a jump function for guiding a sheet so that the sheet rear end does not remain on the roller periphery and an offset function for shifting the sheet to a predetermined rear end regulation position in carrying out the sheet from the sheet discharge outlet.

It is an object of the invention concerning supplements A1 to A10 to provide a sheet storage apparatus that dissolves a sheet jam that a sheet rear end remains on the periphery of the sheet discharge roller and that enables the sheet to drop from above to a predetermined position of a paper mount surface accurately to store in carrying out the sheet from a sheet discharge outlet to the tray paper mount surface with a simplified structure at low cost.

To attain the above-mentioned object, the invention concerning supplements A1 to A10 is characterized in that movable guide means that engages in the sheet lower surface is provided between the sheet discharge roller in the sheet discharge outlet and the tray paper mount surface, is attached to an apparatus frame to be able to reciprocate in the direction crossing the sheet discharge direction of the sheet, is shifted by a predetermined amount in the sheet discharge direction with the front end engaging in the sheet lower surface after the sheet rear end separates from the sheet discharge roller, and is next shifted to a retract position retracted from the tray paper mount surface.

Further, the configuration will be described specifically. The apparatus is provided with a sheet discharge path (11) having a sheet discharge outlet (13), a stack tray (15) having a paper mount surface (15*a*) disposed on the downstream side of the sheet discharge outlet with a height difference formed where the paper mount surface has a height difference from the sheet discharge outlet, a sheet discharge roller (14*b*) disposed in the sheet discharge outlet, movable guide means (19) for carrying out a sheet from the sheet discharge outlet to the paper mount surface in cooperation with the sheet discharge roller, guide shift means for shifting a position of the movable guide means between an actuation position above the paper mount surface and a retract position retracted therefrom, and sheet discharge control means (50) for controlling the guide shift means.

In the movable guide means is formed a sheet engagement portion (19S) that engages in a lower surface of the sheet fed from the sheet discharge roller, and the sheet engagement portion is configured to be able to reciprocate between the actuation position above the paper mount surface and the outside retract position, while being able to shift to a position by a predetermined amount in the sheet discharge direction in the actuation position. The sheet discharge control means shifts the sheet engagement portion by a predetermined amount in the sheet discharge direction while engaging in the lower surface of the sheet after a rear end of the sheet separates from the sheet discharge roller, and then, shifts backward toward the retract position.

The invention concerning supplements A1 to A10 is to shift the movable guide means engaging in the sheet lower surface by a predetermined amount in the direction crossing the sheet discharge direction after the sheet rear end separates from the sheet discharge roller, and then shift to the retract position outside the tray in carrying out the sheet from the sheet discharge outlet, and therefore, exhibits the following effects.

In carrying out the sheet by the sheet discharge roller, since the sheet rear end is supported by the movable guide means, even when friction resistance such as static electricity acts on between the sheet front end portion and loaded sheets on the paper mount surface, the posture of the sheet rear end is maintained linearly between the roller nip point and the movable guide means, the transport force of the roller acts on the sheet rear end, and it is possible to carry out the sheet reliably.

Concurrently therewith, after the sheet rear end separates from the roller nip point, the movable guide means shifts by a predetermined amount in the sheet discharge direction so as to eject the sheet, and therefore, the sheet rear end neither mounts on the periphery of the sheet discharge roller nor remains in this position. Accordingly, there is no fear of a sheet jam due to sheet rear end remaining.

Further, the movable guide means retracts from above the tray after reliably positioning the sheet rear end portion in a predetermined position on the tray paper mount surface, and therefore, the sheet rear end is dropped and stored in a correct position on the tray paper mount surface.

Supplements B1 to B9, etc. are added to the above-mentioned Embodiments.

(Supplement B1)

A sheet storage apparatus characterized by being provided with a sheet discharge outlet that carries out a sheet, a stack tray having a paper mount surface to load sheets disposed on the downstream side of the sheet discharge outlet, sub-tray means disposed between the sheet discharge outlet and the paper mount surface to temporarily hold a sheet discharged from the sheet discharge outlet, and offset means for displacing the sheet by a predetermined amount in the sheet-discharge orthogonal direction or in the sheet discharge direction to discharge to the stack tray, where the sub-tray means is comprised of first and second support members that support a rear end portion and a side end portion of the sheet fed from the sheet discharge outlet to mount thereon, first shift means for causing the first support member to reciprocate between an actuation position to support the sheet rear end portion above the paper mount surface and a retract position out of support of the sheet, second shift means for causing the second support member to reciprocate between an actuation position to support the sheet side edge portion above the paper mount surface and a retract position out of support of the sheet, and sheet discharge control means for controlling the first and second shift means, and in shifting the first support member and the second support member from the actuation positions to the retract positions, the sheet discharge control means first shifts the support member positioned in a direction in which the offset means offsets the sheet to the retract position, and then, shifts the other support member to the retract position.

(Supplement B2)

The sheet storage apparatus as described in supplement B1, characterized in that the offset means is configured to execute first sheet discharge operation for storing a sheet on the paper mount surface from the sheet discharge outlet, and second sheet discharge operation for offsetting at least in the sheet-discharge orthogonal direction on the first and second support members from the sheet discharge outlet to collect, and then storing on the paper mount surface corresponding to sheet collation information, and that in the second sheet discharge mode, the sheet discharge control means first shifts the side edge support member that supports the side end portion of sheets collected on the first and second support members, and then shifts the rear end support member that supports the rear end portion of the sheets from the actuation position to the retract position.

(Supplement B3)

The sheet storage apparatus as described in supplement B2, characterized in that the offset means has a side edge regulation stopper that regulates the side edge of the sheet discharged to the first and second support members, and alignment means for aligning the sheet toward the side edge regulation stopper, and that in executing the second sheet discharge operation, after aligning the sheet on the first and second support members in the side edge regulation stopper by the alignment means, the sheet discharge control means shifts the side edge support member to the retract position to then shift the rear end support member to the retract position.

(Supplement B4)

The sheet storage apparatus as described in supplement B1 or B2, characterized in that in the side edge support member is formed an end surface guide that regulates a position of the side edge of the sheet carried from the sheet discharge outlet to the paper mount surface, and that in executing the first sheet discharge operation, the sheet discharge control means rests the side edge support member in a position in which the end surface guide regulates the position of one side edge of the sheet shifting from the sheet discharge outlet to the paper mount surface.

(Supplement B5)

The sheet storage apparatus as described in supplement B1, characterized in that the offset means is configured to shift sheets mounted on the first and second members from the sheet discharge outlet to different positions in the sheet discharge direction for each number of copies and then store on the paper mount surface, and that at this point, the sheet discharge control means first shifts the rear end support member from the actuation position to the retract position, and then, shifts the side edge support member from the actuation position to the retract position.

(Supplement B6)

The sheet storage apparatus as described in supplement B5, characterized in that the offset means has a slide member that reciprocates by a predetermined stroke along the rear end support member, a rear end contact surface formed in the slide member to engage in the sheet rear end, and a drive motor that causes the slide member to reciprocate, and that the rear end contact surface is configured to push the sheet rear end to a plurality of different positions in the sheet discharge direction from a waiting position retracted from the sheet rear end on the support member.

(Supplement B7)

The sheet storage apparatus as described in supplement B5 or B6, characterized in that in the first and second support members are disposed regulation stoppers that regulate the position of the mounted sheet, and friction transport means for shifting the sheet fed from the sheet discharge outlet toward the regulation stoppers, and that the friction transport means is able to shift to a retract position separated from the sheet on the first and second support members.

(Supplement B8)

The sheet storage apparatus as described in any one of supplements B1 to B7, characterized in that the sheet discharge control means is provided with a binding processing mode for collating, collecting and performing binding processing on sheets fed from the sheet discharge outlet on the sub-tray means and then carrying out to the stack tray means, and a jog sheet discharge mode for displacing sheets fed from the sheet discharge outlet to the stack tray by a predetermined amount in the sheet discharge direction or the sheet-discharge orthogonal direction to perform offset sheet discharge.

(Supplement B9)

An image formation system characterized by being comprised of an image formation apparatus that forms an image on a sheet sequentially, and a sheet storage apparatus provided with a stack tray to store the sheet fed from the image formation apparatus, where the sheet storage apparatus is the sheet storage apparatus as described in any one of supplements B1 to B8.

The background art, object and the others on the invention concerning supplements B1 to B9 will be described next. The invention concerning supplements B1 to B9 relates to the sheet storage apparatus that stores a sheet fed from an image formation apparatus or the like on the stack tray, and relates to improvements in the sheet storage mechanism for enabling the sheet to be stored neatly in a correction on the paper mount surface having a height difference from the sheet discharge outlet.

Generally, as this type of apparatus, such a stack mechanism is widely known that a stack tray is disposed on the downstream side of a sheet discharge path and that a sheet is dropped onto a paper mount surface having a height difference from a sheet discharge outlet to store. Then, such a post-processing mechanism is also known that a sub-tray is provided between the sheet discharge outlet and the paper mount surface to temporarily hold a sheet, the sheet undergoes post-processing such as binding processing, paper folding processing and punching processing on the tray, and that the processed sheet is stored on the paper mount surface.

For example, Patent Document 1 (Japanese Patent Gazette No. 4901082) discloses an apparatus in which a stack tray is disposed in a sheet discharge path of an image formation apparatus, support members are provided between a sheet discharge outlet and a paper mount surface to support the sheet rear end and sheet corner, and that binding processing is performed on a bunch of sheets collated and collected on the support members to store on the paper mount surface. In the apparatus in the Document, the rear end support member for supporting the sheet rear end and corner support member for supporting the sheet corner are disposed between the sheet discharge outlet and the paper mount surface, and the apparatus is provided with a shift mechanism that causes both support members to reciprocate between actuation positions above the tray and waiting positions outside the tray.

As described above, in the post-processing mechanism in which the support members to temporarily collect sheets are provided above the stack tray and are configured to be able to proceed and retract between above the tray and outside the tray, it is possible to make the apparatus small and compact. Meanwhile, it is also known that when a difference in height from the sheet discharge outlet is increased, the storage capacity is increased on the paper mount tray but the storage posture is in disorder on the sheet that is dropped from the sheet discharge outlet and stored, and that when the difference in height is decreased, the storage capacity is limited. Then, the mechanism is also known that moves up and down the paper mount surface of the stack tray corresponding to the load amount, but has problems that the size of the apparatus is increased and that the cost is high.

Conventionally, in the case of configuring the support members that temporarily support the sheet between the sheet discharge outlet and the paper mount surface to be able to proceed and retract with respect to the tray, the rear end support member that supports the sheet rear end and the side edge support member that supports the sheet side edge are both retracted from the sheet support positions on the tray to outside the tray at the same time, and the entire sheet is dropped onto the paper mount surface at the same time and stored.

Accordingly, the sheets (bunch) supported by the support members above the paper mount surface are dropped onto the paper mount surface and stored in a stage in which the support members are retracted. In this storage, the entire sheets are currently dropped, and therefore, are stored disorderly with the sheet posture in disorder. When the sheets are thus stored with the sheet posture in an unstable state, it is difficult to perform sorting storage for offsetting sheets for each group to load on the paper mount surface.

For example, when a sub-tray is provided between the sheet discharge outlet and the paper mount surface, and sheets are offset by a predetermined amount, collected on the sub-tray, then dropped onto the paper mount surface and are stored, such a problem arises that the sheet posture is in disorder on drop impact and it is not possible to sort.

Therefore, the inventor of the invention arrived at the idea of offsetting and collecting sheets on the sub-tray, and then dropping the sheets starting at one end to the other end of sheets gradually while holding the sheet offset posture to store on the paper mount surface.

It is an object of the invention concerning supplements B1 to B9 to provide a sheet storage apparatus that enables sheets to be collected neatly in a correct position in an apparatus configuration with a sub-tray for temporarily holding sheets disposed between a sheet discharge outlet and a paper mount surface. Further, it is another object of the invention concerning supplements B1 to B9 to provide a sheet storage apparatus that enables successive sheets to be sorted for each group, stacked and stored on the paper mount surface.

To attain the above-mentioned objects, the invention concerning supplements B1 to B9 is characterized by being provided with first and second support members that temporarily hold sheets between the sheet discharge outlet and the paper mount surface, shift means for causing each support member to reciprocate between an actuation position above the tray and a retract position outside the tray, and offset means for displacing sheets by a predetermined amount in the sheet discharge direction or the sheet-discharge orthogonal direction to discharge to the sheet mount surface, where the support member positioned in the offset direction by the offset means is first retracted, and the support member that is not positioned in the offset direction is then retracted from the tray.

Further, the configuration will be described specifically. The apparatus is provided with a sheet discharge outlet (13) that carries out a sheet, a stack tray (15) having a paper mount surface disposed on the downstream side of the sheet discharge outlet to load sheets, sub-tray means (18) disposed between the sheet discharge outlet and the paper mount surface to temporarily hold a sheet discharged from the sheet discharge outlet, and offset means for displacing the sheets by a predetermined amount in the sheet-discharge orthogonal direction or in the sheet discharge direction to discharge to the stack tray.

The sub-tray means is comprised of first and second support members (19, 20) that support a rear end portion and a side end portion of the sheet fed from the sheet discharge outlet to mount thereon, first shift means (21) for causing the first support member to reciprocate between an actuation position above the paper mount surface and a retract position outside the paper mount surface, second shift means (22) for causing the second support member to reciprocate between an actuation position above the paper mount surface and a retract position outside the paper mount surface, and sheet discharge control means (50) for controlling the first and second shift means. In shifting the first support member and the second support member from the actuation positions to the retract positions, the sheet discharge control means first shifts the member positioned in a direction in which the offset means offsets the sheet to the retract position, and then, shifts the other support to the retract position.

The invention concerning supplements B1 to B9 is provided with the first and second support members that temporarily hold the rear end portion and the side edge portion of the sheet fed from the sheet discharge outlet, and the offset means for displacing the sheet supported on the members by a predetermined amount in the sheet-discharge orthogonal direction or the sheet discharge direction and thereby offsetting the sheet to discharge on the stack tray, is to retract first the support member positioned on the side on which the sheet is offset and then retract the support member positioned on the side on which the sheet is not offset in retracting each support member from the tray to the outside, and theretofore, exhibits the following effects.

Sheets are offset by a predetermined amount in the sheet-discharge orthogonal direction or in front and back in the sheet discharge direction while being supported on the first and second support members, and are stored on the paper mount surface. Accordingly, the sheets are sorted in the sheet-discharge orthogonal direction or in sheet-discharge front and back direction and stored on the paper mount surface. Thus, the invention concerning supplements B1 to B9 causes sheets fed from the sheet discharge outlet with a job end signal fed from the image formation apparatus to be offset by a predetermined amount in the sheet-discharge orthogonal direction or in front and back in the sheet discharge direction with a job end signal from the image formation apparatus, and thereby enables group sort for each number of copies.

At this point, in the case of offsetting sheets in the sheet-discharge orthogonal direction, the side edge support member that supports the sheet side edge is first retracted to outside the tray, the sheets are dropped onto the paper mount surface with the sheet rear end portion supported by the rear end support member, the rear end support member is retracted after the sheet front end (front end in the sheet discharge direction) lands on the paper mount surface to cause the sheet rear end portion to land, and it is possible to store the sheets on the paper mount surface with little positional displacement in the sheet-discharge orthogonal direction.

In a similar manner thereto, in the case of offsetting sheets in front and back in the sheet discharge direction, the rear end support member that supports the sheet rear end portion is first retracted from the tray with the sheets supported by the side edge support member. By this means, the sheets land on the paper mount surface on the tray starting at the side end portion on the side opposite to the side edge support member while holding the state offset in front and back, the side edge support member then retracts to store the entire sheets on the paper mount surface, and it is possible to store the sheets on the paper mount surface with little positional displacement in sheet-discharge front and back direction.

Thus, the invention concerning supplements B1 to B9 is to first land one end of the sheets, then land the other end portion, and drop the sheets on the paper mount surface gradually in the order in which the posture of offset sheets does not deteriorate, and therefore, has the effect of little positional displacement.

Supplements C1 to C7 and the others are added to the above-mentioned Embodiments.

(Supplement C1)

A sheet storage apparatus characterized by being provided with a sheet discharge path having a sheet discharge outlet, a stack tray having a paper mount surface to load sheets disposed on the downstream side of the sheet discharge outlet, a sub-tray disposed between the sheet discharge outlet and the paper mount surface with a height difference formed to temporarily hold a sheet, and sheet discharge control means for selectively executing a first sheet discharge mode for directly carrying a sheet from the sheet discharge outlet in the paper mount surface and a second sheet discharge mode for carrying in the sub-tray, where the sub-tray is comprised of a rear end support member that supports a rear end portion of the sheet fed from the sheet discharge outlet, first shift means for shifting a position of the rear end support member between an actuation position to contact the sheet on the paper mount surface and a retract position out of support of the sheet, a side edge support member that supports a side edge portion of the sheet fed from the sheet discharge outlet, and second shift means for shifting a position of the side edge support member between an actuation position to contact the sheet on the paper mount surface and a retract position out of support of the sheet, the sheet discharge control means is configured to carry out the sheet from the sheet discharge outlet toward the paper mount tray with the side edge support member positioned in the actuation position in the first sheet discharge mode, and to position the rear end support member and the side edge support member in the actuation positions, collect sheets in the shape of a bunch on both support members, then shift the rear end support member and the side edge support member to the retract positions, and store the sheets on the paper mount surface in the second sheet discharge mode, in the side edge support member is formed an end surface guide that regulates a position of one side edge of the sheet dropping on the paper mount surface from the sheet discharge outlet in the actuation position at the time of execution of the first sheet discharge mode, and the end surface guide guides one side edge and thereby shifts the sheet to the other side.

(Supplement C2)

The sheet storage apparatus as described in supplement C1, characterized in that the side edge support member is configured to be able to shift to positions in the sheet-discharge orthogonal direction, and that the sheet discharge control means controls the second shift means to shift a position of the end surface guide of the side edge support member corresponding to a size in the sheet-discharge orthogonal direction of the sheet carried out of the sheet discharge outlet at the time of execution of the first sheet discharge mode.

(Supplement C3)

The sheet storage apparatus as described in supplement C1 or C2, characterized by being further provided with alignment means for offsetting the sheet fed from the sheet discharge outlet by a predetermined direction in the sheet-discharge orthogonal direction to position, where the sheet discharge control means is provided with a third sheet discharge mode, and the third sheet discharge mode is to execute the first sheet discharge mode and the second sheet discharge mode alternately on sheets continuously discharged from the sheet discharge outlet for each number of copies to collate and sort sheets on the paper mount surface.

(Supplement C4)

The sheet storage apparatus as described in any one of supplements C1 to C3, characterized in that the side edge support member is formed in the shape of an end surface inclined or curved in the direction of gradually going away from the sheet side edge toward the sheet discharge direction of the sheet carried out of the sheet discharge direction in the actuation position at the time of execution of the first sheet discharge mode.

(Supplement C5)

The sheet storage apparatus as described in any one of supplements C1 to C4, characterized in that the sheet discharge control means controls the first shift means so as to push the rear end portion of the sheet carried out of the sheet discharge outlet, in the sheet discharge direction, by the front end portion of the rear end support member, at the time of execution of the first sheet discharge mode.

(Supplement C6)

The sheet storage apparatus as described in any one of supplements C1 to C5, characterized in that in the sub-tray is disposed binding processing means for performing binding processing on a bunch of sheets which are collated and collect, and that the sheet discharge control means performs the binding processing on a bunch of sheets that are collected and then stores on the stack tray at the time of execution of the second sheet discharge mode.

(Supplement C7)

An image formation system characterized by being comprised of an image formation apparatus that forms an image on a sheet sequentially, and a sheet storage apparatus provided with a stack tray to store the sheet fed from the image formation apparatus, where the sheet storage apparatus is the sheet storage apparatus as described in any one of supplements C1 to C6.

The background art, object and the others on the invention concerning supplements C1 to C7 will be described next. The invention concerning supplements C1 to C7 relates to the sheet storage apparatus that stores a sheet fed from an image formation apparatus or the like on the paper mount surface, and relates to improvements in the sheet collection mechanism for enabling sheets to be collected neatly on the paper mount surface having a height difference from the sheet discharge outlet.

Generally, in this type of sheet storage apparatus, a sheet is carried out to a sheet discharge outlet by sheet discharge rollers disposed in a sheet discharge path, a stack tray is disposed with a height difference formed on the downstream side of the sheet discharge outlet, and the sheet is dropped onto the a paper mount surface of the tray from the sheet discharge outlet and is stored.

For example, Patent Document 4 (Japanese Patent Gazette No. 4445342) discloses a tray structure for dropping a sheet carried out of a sheet discharge outlet of an image formation apparatus on a tray paper mount surface disposed on the downstream side with a height difference formed from the sheet discharge outlet to store. In the same Document, a sub-tray is disposed between the sheet discharge outlet and the tray paper mount surface to temporarily collect sheets, and a bunch of sheets collected on the sub-tray undergoes staple binding processing, is then dropped onto the paper mount surface and is stored.

Then, the sub-tray is comprised of a support member that supports the sheet rear end portion in the sheet discharge outlet and a sheet corner support member that supports the sheet in the sheet corner portion, and both support members are configured to be able to shift between actuation positions protruding above the tray and waiting positions retracted to outside the tray.

Further, Patent Document 5 (Japanese Unexamined Patent Publication No. 2010-195579) discloses a tray mechanism for storing cards or the like in a box-shaped tray from a sheet discharge outlet in a card print system, and discloses a storage mechanism in which an inclined guide plate that guides a sheet rear end is provided between the sheet discharge outlet and the tray bottom, and the sheet fed from the sheet discharge outlet is mounted on the guide member, and then, is dropped onto the tray with reference to the plate-shaped end surface while sliding the card due to the inclination of the guide plate.

As described above, it is already known that the support members to temporarily mount sheets are disposed between the sheet discharge outlet and the paper mount surface in storing the sheets on the paper mount surface having a height difference from the sheet discharge outlet. For example, in Patent Document 4, proposed is a sheet discharge structure for collecting sheets in the shape of a bunch on the corner support member and the sheet rear end support member to perform binding processing, and then storing on the paper mount surface.

Such a sheet discharge mechanism requires a height difference with a relatively large difference in height between the sheet discharge outlet and the paper mount surface. It is the cause requiring a height adapted to the allowable maximum bunch thickness between the sheet discharge outlet and the sub-tray. Concurrently therewith, when a difference in height between the sub-tray and the paper mount surface is set to be small, it is not possible to hold a large amount of sheets, and it is difficult to make an apparatus configuration for executing image formation to post-processing continuously for a long time.

When a height difference with a large difference in height is formed between the sheet discharge outlet and the paper mount surface to dissolve such problems, in the case of dropping sheets onto the paper mount surface from the sheet discharge outlet on a sheet-by-sheet basis to store, problems occur that sheets are scattered outside the tray or are collected disorderly on the paper mount surface.

Then, the inventor of the invention arrived at the idea of regulating a drop position of a sheet by an edge portion (end surface guide) of the side edge support member constituting the sub-tray to store in a correct position in the case of directly carrying out the sheet from the sheet discharge outlet to the paper mount surface in an apparatus configuration in which the sub-tray is disposed between the sheet discharge outlet and the paper mount surface.

It is an object of the invention concerning supplements C1 to C7 to provide a sheet storage apparatus capable of collecting and storing neatly in a correct position in dropping a sheet from a sheet discharge outlet onto a paper mount surface in an apparatus configuration provided with a side edge support member to temporarily mount the sheet between the sheet discharge outlet and the paper mount surface. Further, it is another object of the invention concerning supplements C1 to C7 to provide a sheet storage apparatus capable of performing jog sort for collecting sheets from the sheet discharge outlet on the paper mount surface in different load postures for each number of copies.

To attain the above-mentioned objects, in the invention concerning supplements C1 to C7, the sub-tray with a height difference formed from the sheet discharge outlet of the sheet discharge path and the stack tray are disposed vertically in this order, and the sub-tray is provided with the side edge support member that supports a side edge portion of a sheet, and shift means for shifting the member between an actuation position for contacting the sheet on the tray and a retract position (out of support of the sheet) outside the tray. Then, in directly carrying out a sheet from the sheet discharge outlet to the paper mount tray, it is a feature that one side edge of the sheet dropping onto the paper mount surface from the sheet discharge outlet is guided by the end surface guide portion of the side edge support member so as to regulate the drop position.

Further, the configuration will be described specifically. The apparatus is provided with a sheet discharge path (11) having a sheet discharge outlet (13), a stack tray (15) having a paper mount surface to load sheets disposed on the downstream side of the sheet discharge outlet, a sub-tray (18) disposed between the sheet discharge outlet and the paper mount surface with a height difference formed to temporarily hold sheets and perform post-processing, and sheet discharge control means (55) for selectively executing a first sheet discharge mode for directly carrying a sheet from the sheet discharge outlet in the paper mount surface and a second sheet discharge mode for carrying in the sub-tray.

The sub-tray is comprised of a rear end support member (19) that supports a rear end portion of the sheet fed from the sheet discharge outlet, first shift means (21) for shifting a position of the rear end support member between an actuation position inside the tray and a waiting position outside the tray, a side edge support member (20) that supports a side edge portion of the sheet fed from the sheet discharge outlet, and second shift means (22) for shifting a position of the side edge support member between an actuation position inside the tray and a waiting position outside the tray.

The sheet discharge control means is configured to carry out the sheet from the sheet discharge outlet toward the paper mount tray with the side edge support member positioned in the actuation position in the first sheet discharge mode, and to position the rear end support member and the side edge support member in the actuation positions, collect sheets in the shape of a bunch on both support members, then shift the rear end support member and the side edge support member to the retract positions, and store the sheets on the paper mount surface in the second sheet discharge mode, in the side edge support member is formed an end surface guide (19S) that regulates a position of one side edge of the sheet dropping on the paper mount surface from the sheet discharge outlet in the actuation position at the time of execution of the first sheet discharge mode, and the end surface guide guides one side edge of the shift and thereby shifts the sheet to the other side in storing the sheet from the sheet discharge outlet on the paper mount surface.

The invention concerning supplements C1 to C7 provides the side edge support member that supports the sheet side end portion between the sheet discharge outlet and the paper mount surface, and the shift means for shifting the member between the actuation position above the paper mount surface and the waiting position retracted from the paper mount surface, is to adjust the position of the support member so that the end surface guide of the support member regulates the position of the side edge of the sheet that is directly carried out from the sheet discharge outlet toward the paper mount surface, and therefore, exhibits the following effects.

In dropping a sheet from the sheet discharge outlet onto the paper mount surface to store, the load position of the sheet may cause positional displacement. This is caused by the sheet being fed while biasing due to skew, register or the like in the sheet discharge path, the sheet dropping from the sheet discharge path flying due to the effect of wind or the like, or the sheet front end undergoing the effect of static electricity of loaded sheets to change friction resistance.

In contrast thereto, in the invention concerning supplements C1 to C7, since the end surface guide of the side edge support member regulates the position of the side edge (at the time of execution of the first sheet discharge mode as described above) of the sheet extending from the sheet discharge outlet to the paper mount surface, sheets fed from the sheet discharge outlet are loaded and stored so that respective side edges are matched.

In this case, for example, in the sheet discharge reference of the sheet discharge outlet of the sheet discharge path, for example, in the center reference, the side edge support member is disposed on either of the left and right, and the position of the end surface guide is set at a position in which the entire sheet engages in the end surface guide to regulate, in consideration of dimensional fluctuations in the sheet size and sheet width.

In this case, in the side edge support member, the rest position of the side edge support member is set on the sheet center side so that the end surface guide position is to engage in side edges of all sheets that are carried out of the sheet discharge position, in consideration of fluctuations in the sheet size and width-direction dimension. By this means, it is possible to stack and store sheets such as skewed sheets and registered sheets that cause positional displacement until arrival at the paper mount surface in a correct position in the correct posture.

Further, the invention concerning supplements C1 to C7 enables sheets to be offset by a predetermined amount in the sheet-discharge orthogonal direction, jog-sorted and stored on the paper mount surface, and in this case, it is possible to collect sheets in a correct position relatively neatly. As the jog method, the side edge support member is configured to be able to shift to positions of two or more different portions in the sheet-discharge orthogonal direction, and it is possible to group (collate) such as leftward collection of sheets of a first group and rightward of sheets of a second group. Further, the sub-tray is disposed between the sheet discharge outlet and the paper mount surface, and it is possible to sort into the first and second groups by the method of collating and collecting sheets on the sub-tray in an offset state, and then, storing a bunch of collated sheets on the paper mount surface.

Particularly, in the invention concerning supplements C1 to C7, the side edge support member is configured as the sub-tray to collate and collect sheets fed from the sheet discharge outlet to perform post-processing such as binding processing and then store on the stack tray, and is provided with the end surface guide to regulate the position of sheet side edge in directly discharging the sheet from the sheet discharge outlet to the paper mount surface without performing the post-processing, and it is thereby possible to perform sheet discharge of a plurality of modes with a simplified structure.

Supplements D1 to D10 and the others are added to the above-mentioned Embodiments.

(Supplement D1)

A sheet storage apparatus characterized by being provided with a sheet carry-in path having a sheet discharge outlet, a stack tray having a paper mount surface disposed below the sheet discharge outlet with a height difference formed, a sub-tray disposed between the sheet discharge outlet and the paper mount surface to support a rear end portion of a sheet carried out of the sheet discharge outlet, a rear end regulation surface disposed in the sub-tray to strike a rear end edge of the sheet stored on the paper mount surface to regulate, sub-tray shift means for causing the sub-tray to reciprocate between an actuation position positioned above the paper mount surface of the stack tray and a retract position retracted from above the paper mount surface, a sheet push member provided with a paper press surface that engages in the sheet rear end edge on the sub-tray, pusher shift means for causing the sheet push member to reciprocate between a retract position in which its paper press surface is retracted to outside the tray from the rear end regulation surface and an actuation position inside the tray, and control means for controlling the sub-tray shift means and the pusher shift means, where the actuation position of the sheet press member is set so that its paper press surface is positioned inside the paper mount surface with a predetermined distance formed from the rear end regulation surface, and the control means shifts the sub-tray from the retract position to the actuation position to load sheets from the sheet discharge outlet, shifts the sheet push member from the retract position to the actuation position to shift the sheets loaded on the sub-tray in the carrying-out direction, then shifts the sub-tray from the actuation position to the retract position, and next shifts the sheet push member from the actuation position to the retract position.

(Supplement D2)

The sheet storage apparatus as described in supplement D1, characterized in that in the sub-tray is disposed post-processing means for performing binding processing on loaded sheets, and that the control means collects sheets fed from the sheet discharge outlet in the shape of a bunch on the sub-tray positioned in the actuation position, then performs binding processing with the post-processing means, shifts a position of the sheet push member from the retract position to the actuation position after the binding processing, and next shifts a position of the sub-tray from the actuation position to the retract position.

(Supplement D3)

The sheet storage apparatus as described in supplement D1 or D2, characterized in that the sub-tray is comprised of a plate-shaped member supported slidably by an apparatus frame, and that the sheet push member is comprised of a slide member supported slidably by the sub-tray, and the paper press surface integrally formed in the slide member to stand in the sheet load direction.

(Supplement D4)

The sheet storage apparatus as described in any one of supplements D1 to D3, characterized in that the sub-tray is comprised of a rear end support member that supports a sheet rear end portion and a side edge support member that supports a sheet side edge portion, and that the control means shifts the side edge support member from the actuation position to the retract position after sheets are loaded on the sub-tray, then shifts the sheet push member from the retract position to the actuation position, and next shifts the rear end support member from the actuation position to the retract position.

(Supplement D5)

The sheet storage apparatus as described in supplement D4, characterized in that the rear end support member is disposed to be able to shift between the retract position and the actuation position in the sheet discharge direction, the side edge support member is disposed to be able to shift between the retract position and the actuation position in the sheet-discharge orthogonal direction, and that the post-processing means for performing binding processing is disposed in a sheet corner on the boundary portion between shift trajectories of the rear end support member and the side edge support member.

(Supplement D6)

The sheet storage apparatus as described in any one of supplements D1 to D5, characterized in that the distance between the paper press surface and the rear end regulation surface in the actuation position of the sheet push member is capable of being set at different distance positions corresponding to a sheet property such as a sheet material, sheet size and sheet weighing, and that the control means varies a rotation amount of a shift motor constituting the pusher shift means corresponding to the property of the sheet fed from the sheet discharge outlet.

(Supplement D7)

The sheet storage apparatus as described in supplement D6, characterized in that the control means sets the actuation position at a distance position such that the distance is formed to be long when the sheet fed from the sheet discharge outlet is a thin sheet or weak and of a property easy to become distorted from information from input means to input the sheet property.

(Supplement D8)

The sheet storage apparatus as described in any one of supplements D1 to D5, characterized in that the distance between the paper press surface and the rear end regulation surface in the actuation position of the sheet push member is capable of being set at different distance positions corresponding to a load amount of sheets loaded on the paper mount surface, and that the control means varies a rotation amount of a shift motor constituting the pusher shift means corresponding to a signal from load amount identifying means for identifying the load amount of sheets loaded on the paper mount surface.

(Supplement D9)

The sheet storage apparatus as described in supplement D8, characterized in that the load amount identifying means is comprised of counting means for counting the number of sheets carried out of the sheet discharge outlet, and that the control means sets the actuation position stepwise at a distance position to vary the distance corresponding to the count number from the counting means.

(Supplement D10)

An image formation system characterized by being comprised of an image formation apparatus that forms an image on a sheet, and a sheet storage apparatus which collates and collects sheets fed from the image formation apparatus to perform post-processing, and then stores on a stack tray, where the sheet storage apparatus is the sheet storage apparatus as described in any one of supplements D1 to D5.

The background art, object and the others on the invention concerning supplements D1 to D10 will be described next. The invention concerning supplements D1 to D10 relates to the sheet storage apparatus that stores a sheet carried out of an image formation apparatus or the like on a stack tray, and relates to improvements in the sheet carrying-out mechanism for storing a sheet on a tray paper mount surface reliably and neatly.

Generally, this kind of sheet storage apparatus is widely used as an apparatus which collates and collects sheets carried out from an image formation apparatus or the like on a processing tray to perform post-processing such as binding processing, and then stores on a stack tray disposed on the downstream side. Such a sheet storage apparatus is also known as a terminal apparatus of an image formation system disposed on the downstream side of the image formation apparatus as a post-processing apparatus (finisher apparatus).

For example, in Patent Document 6 (Japanese Patent Gazette No. 4203955), a processing tray is disposed between a sheet discharge outlet of a sheet discharge path and a paper mount surface of a stack tray, and sheets fed from the sheet discharge outlet are temporarily collected on the processing tray to perform post-processing such as binding processing.

Then, the post-processing processed sheets are loaded and stacked on the stack tray disposed on the downstream side.

The apparatus in Patent Document 6 is disclosed as an apparatus in which the processing tray is disposed below the sheet discharge path, sheets fed from the sheet discharge path are collated and collected to undergo the binding processing, and then, grip transport means pushes the rear end of a bunch of sheets onto the tray to drop and store onto loaded sheets.

Further, Patent Document 1 (Japanese Patent Gazette No. 4901082) discloses the structure in which the stack tray is disposed with a height difference formed below the sheet discharge path, and the support member that supports the sheet rear end portion is shifted between an actuation position positioned above the tray and a retract position retracted to outside the tray between the sheet discharge outlet and the tray paper mount surface, protrudes to inside the tray in collating and collecting sheets, and retracts to outside the tray after performing the post-processing on the sheets.

As described above, such a sheet storage mechanism is already known that the sub-tray mechanism for temporarily supporting sheets is disposed between the sheet discharge outlet of the sheet discharge path and the stack tray positioned below the outlet, performs post-processing on the sheets, and then stores the sheets on the stack tray. In such an apparatus configuration, when the sheet (single sheet or bunch of sheets) is dropped from the sub-tray onto the tray paper mount surface, such a problem occurs that the sheet rear end is caught to warp on the rear end regulation surface (fence wall surface) disposed on the stack tray to strike and regulate the sheet rear end.

It is known that such a phenomenon occurs frequently in a staple binding apparatus or the like that the sheet rear end portion is caught on the rear end regulation surface and is warped in storing a bunch of sheets from the processing tray onto the stack tray to store. For example, in Patent Document 6, a guide member is provided inside the tray while being spaced a distance apart from the rear end regulation surface disposed on the stack tray. By this means, the sheet rear end is guided by the guide member positioned on the inner side than the rear end regulation surface and drops from above to below.

However, as in Patent Document 6, when respective different members constitute the shift mechanism that pushes sheets (bunch) on the support member to the tray side and the guide (member) mechanism that guides the sheet rear end portion in the drop direction, the mechanisms are complicated and the cost is high. Concurrently therewith, in the conventional drop guide mechanism, the guide member and the grip transport mechanism that pushes a bunch of sheets are comprised of respective different mechanism members. Therefore, the rear end portion of the sheets engages in the grip transport member to shift to inside the tray, engages in the guide member in this position, and drops toward the paper mount surface.

Accordingly, the guide member disposed inside to guide the sheet rear end portion in the drop direction and the grip transport member that shifts the sheets to this point are not able to engage in the sheet rear end portion in the same position at the same time. Therefore, in the apparatus of Patent Document 6, with a bunch of sheets shifted to inside the tray by the grip member, the guide member is moved to the rear end side of the bunch of sheets with an actuation solenoid, and then, the grip member is retracted to outside the tray. In other words, a bunch of sheets is carried to inside the tray by the grip member, the guide member is moved to the back of the rear end of the bunch of sheets, and then, the grip member is retracted.

In such a complicated structure, the size and cost of the apparatus are increased, and concurrently therewith, the sheet rear end portion is transferred from the grip member to the guide member in a position spaced a distance and is dropped and guided onto the paper mount surface. Therefore, such a problem occurs that the posture of the bunch of sheets becomes disorder in transferring.

It is an object of the invention concerning supplements D1 to D10 to configure a sheet storage apparatus that enables sheets to be neatly collected on the tray paper mount surface with a simplified structure in small size, in performing post-processing on the sheets fed from the sheet discharge outlet on the sub-tray and then storing on the stack tray.

In addition, in the invention concerning supplements D1 to D10, the operation for "shifting the sub-tray from the actuation position to the retract position, and then shifting the sheet push member from the actuation position to the retract position" is assumed to include operation start timing at which after starting shifting the sub-tray toward the retract position from the actuation position, with temporal delay therefrom, the sheet push member starts shifting toward the retract position from the actuation position.

To attain the above-mentioned object, the invention concerning supplements D1 to D10 is characterized in that the sub-tray is disposed between the sheet discharge outlet of the sheet discharge path and the paper mount surface of the stack tray to be able to appear and disappear above the tray, the sheet push member having the paper press surface that engages in the sheet rear end edge is disposed on the sub-tray so as to push a bunch of sheets to inside the tray, and that the sub-tray shift means and pusher shift means that actuates the sheet push member are controlled to push a bunch of sheets to inside the tray by the paper press surface, and then, retract the sub-tray to outside the tray.

Further, the configuration will be described specifically. The apparatus is provided with a sheet discharge path having a sheet discharge outlet, a stack tray having a paper mount surface disposed below the sheet discharge outlet with a height difference formed, a sub-tray disposed between the sheet discharge outlet and the paper mount surface to support a rear end portion of a sheet carried out of the sheet discharge outlet, post-processing means for performing post-processing on the sheet supported on the sub-tray, a rear end regulation surface disposed on the sub-tray to strike a rear end edge of the sheet stored on the paper mount surface to regulate, sub-tray shift means for causing the sub-tray to reciprocate between an actuation position positioned above the paper mount surface of the stack tray and a retract position retracted from above the paper mount surface, post-processing means for performing post-processing sheets loaded on the sub-tray positioned in the actuation position, a sheet push member provided with a paper press surface that engages in the rear end edge of the sheet on the sub-tray, pusher shift means for causing the sheet push member to reciprocate between a retract position in which its paper press surface is retracted to outside the tray from the rear end regulation surface and an actuation position inside the tray, and control means for controlling the sub-tray shift means and the pusher shift means. The actuation position of the sheet press member is set so that its paper press surface is positioned inside the paper mount surface with a predetermined distance formed from the rear end regulation surface, and the control means shifts the sub-tray from the retract position to the actuation position to load sheets from the sheet discharge outlet, shifts the sheet push member from the retract position to the actuation position to shift the sheets subjected to the post-processing in the sheet carrying-out direction, then shifts the sub-tray from the actuation position to the retract position, and next shifts the sheet push member from the actuation position to the retract position.

In the invention concerning supplements D1 to D10, the sub-tray that supports at least the sheet rear end portion is disposed to be able to shift to positions between the actuation position inside the paper mount surface and the retract position outside the paper mount surface above the stack tray, the sheet push member that pushes sheets along the shift direction of the sub-tray is shifted from the retract position outside the paper mount surface to the actuation position protruding to the inside the regulation wall surface of the stack tray on the inner side than the front end of the sub-tray, the sub-tray is retracted to the outside the paper mount surface of the stack tray, then the sheet push member is retracted to the retract position, and therefore, the invention exhibits the following effects.

After carrying sheets fed from the sheet discharge path onto the sub-tray to perform the post-processing, the sheet push member carries to above the stack tray, the sub-tray is shifted backward to the outside of the stack tray with the sheet rear end regulated in the predetermined position by the paper press surface of the sheet push member, and therefore, the sheet rear end drops from the position to which the sheet rear end is pushed by the paper press surface onto the paper mount surface below. By this means, sheets are not stacked in a state in which the sheet rear end rubs against the rear end regulation surface and is caught on the wall surface to warp when dropping onto the paper mount surface.

In other words, the sheet push member having the paper press surface that engages in the sheet rear end pushes sheets to the position in which the paper mount surface is offset to the inner side of the tray than the rear end regulation surface of the stack tray, the sub-tray that supports the sheets is retracted in this state, and therefore, the sheets are loaded and stored on the paper mount surface immediately below without becoming disorder. In the process of dropping, the sheet rear end does not rub against the rear end regulation surface of the stack tray.

Thus, the invention concerning supplements D1 to D10 is to retract the sub-tray that supports sheets with the sheet rear end portion carried to inside the rear end regulation surface inside the tray, and therefore, as compared with the sheet discharge structure for clip-transporting a bunch of sheet to the inside of the stack tray to drop in the conventional manner, enables sheets to be neatly stacked and stored. Further, as compared with the conventional structure for clip-transporting the sheet rear end portion to the inside of the tray, moving the guide member to the back of the sheet rear end portion in this position, and then, retracting the grip member to the outside of the tray, it is possible to store a bunch of sheets neatly without the collection posture of the bunch deteriorating with a simplified structure.

Supplements E1 to E8 and the others are added to the above-mentioned Embodiments.

(Supplement E1)

A sheet post-processing apparatus characterized by being provided with a sheet discharge path having a sheet discharge outlet, a stack tray disposed on the downstream side of the sheet discharge outlet to store a sheet fed from the sheet discharge path, a sub-tray disposed between the sheet discharge outlet and the stack tray to temporarily collect sheets, a staple apparatus that performs binding processing on the sheets collected on the sub-tray, tray shift means for causing the sub-tray to reciprocate between an actuation position above the stack tray and a waiting position outside the tray, and control means for controlling the staple apparatus and the tray shift means, where the control means actuates the staple apparatus or prohibits actuation with a detection signal from tray position detecting means for detecting whether or not the sub-tray is positioned in the actuation position.

(Supplement E2)

The sheet post-processing apparatus as described in supplement E1, characterized in that the control means prohibits power supply to the staple apparatus when the sub-tray is not positioned in the actuation position.

(Supplement E3)

The sheet post-processing apparatus as described in supplement E1 or E2, characterized in that the sub-tray is comprised of a rear end support member that supports a rear end portion of the sheet carried out of the sheet discharge outlet and a side edge support member that supports one side edge portion, and that the tray shift means causes the rear end support member and the side edge support member to reciprocate between waiting positions and actuation positions independently.

(Supplement E4)

The sheet post-processing apparatus as described in supplement E3, characterized in that with respect to the sheet discharge direction of the sheet carried out to the sheet discharge outlet from the sheet discharge path, the rear end support member is attached to an apparatus frame to be able to shift between the waiting position and the actuation position in the same direction as the sheet discharge direction, and that the side edge support member is attached to the apparatus frame to be able to shift between the waiting position and the actuation position in the direction orthogonal to the sheet discharge direction.

(Supplement E5)

The sheet post-processing apparatus as described in supplement E2 or E3, characterized in that the tray position detecting means is comprised of a first sensor that detects a position of the rear end support member, and a second sensor that detects a position of the side edge support member, and that the control means prohibits power supply to the staple apparatus when any one of the first sensor and the second sensor does not detect that the sub-tray is in the actuation position.

(Supplement E6)

The sheet post-processing apparatus characterized in that the control means has a binding processing mode for collecting sheets carried out of the sheet discharge outlet on the sub-tray to perform binding processing, and then storing on the stack tray, and a jog sort mode for offsetting sheets carried out of the sheet discharge outlet for each number of copies on the sub-tray to collect, and then storing on the stack tray, and is configured to set the side edge support member in different positions in the sheet-discharge orthogonal direction in the binding processing mode and the jog sort mode, and that the tray position detecting sensor is disposed in a position such that the position of the side edge support member is detected in the binding processing mode and that the position is not detected in the jog sort mode.

(Supplement E7)

The sheet post-processing apparatus as described in any one of supplements E1 to E6, characterized in that the sub-tray is disposed between the sheet discharge outlet of the sheet discharge path and the paper mount of the stack tray, the sheet discharge path is provided with a housing cover to cover above, and that the housing cover is formed at a narrow distance to prevent a foreign substance from entering from the sheet support surface of the sub-tray positioned in the actuation position.

(Supplement E8)

A system characterized by being comprised of an image formation apparatus that forms an image on a sheet, and a sheet post-processing apparatus which collates and collects sheets fed from the image formation apparatus to perform binding processing, where the sheet post-processing apparatus is provided with the configuration as described in any one of supplements E1 to E7.

The background art, object and the others on the invention concerning supplements E1 to E8 will be described next. The invention concerning supplements E1 to E8 relates to improvements in safety of the mechanism related to the sheet post-processing apparatus which collates and collects sheets fed from the image formation apparatus to perform binding processing.

Generally, this type of sheet post-processing apparatus is widely known as a finisher apparatus which is coupled to a sheet discharge outlet of an image formation apparatus and collates and collects image-formed sheets on a processing tray to perform binding processing with a stapler apparatus or the like.

For example, Patent Document 7 (Japanese Unexamined Patent Publication No. 2000-169036) discloses a post-processing apparatus for guiding sheets fed from an image formation apparatus to a sheet discharge outlet of a sheet discharge path, and collating and collecting the sheets on a processing tray disposed with a height difference formed on the downstream side to perform binding processing. Then, the binding processing apparatus hits a staple installed in a head portion to insert into a bunch of sheets with a drive cam coupled to a drive motor, and bends the staple tips with the anvil to bind.

In such an apparatus, when the finger or foreign substance enters the head portion of the staple apparatus, an unexpected accident may be invited. Particularly, there is the risk that the accident occurs when a sheet jam arises on the processing tray and is cleared, or a foreign substance enters together with the sheet onto the processing tray.

Therefore, in the apparatus of Patent Document 7, a sensor means for detecting entry of a foreign substance from outside is disposed in the carry-in entrance to carry the sheet in the processing tray from the sheet discharge path, and disclosed are a detection mechanism for prohibiting staple operation when a transport mechanism is opened due to the foreign substance with the sensor, and the control apparatus thereof.

Further, Patent Document 1 (Japanese Patent Gazette No. 4901082) discloses the apparatus in which the support member that temporarily holds the sheet is disposed between the sheet discharge outlet and the stack tray, and sheets fed from the sheet discharge outlet onto the support member are collected and undergo the binding processing. The staple apparatus in the Document is provided with a unit shift mechanism that retracts to the inside of the apparatus in non-operation (non-staple mode), and shifts to the processing position of the support member above the stack tray in operation (staple mode).

As described above, the detection mechanism for detecting a state in which a foreign substance enters onto the processing tray and prohibiting staple operation and the control mechanism thereof are already known. However, in the conventional apparatus, when a sheet on the processing tray jams, the sensor detects that space above the tray is opened for the jam handling or the like, and the derive motor of the staple apparatus is halted with the detection signal.

Thus, conventionally, when the space above sheets collected on the tray for binding processing is detected and space for a foreign substance to enter is formed, power supply to the staple apparatus is prohibited. Therefore, when small allowable space is formed above sheets collected on the processing tray, it is not possible to detect the space. This is because it is necessary to form space corresponding to the maximum load amount above the tray.

Then, the inventor of the invention arrived at the idea of detecting open/close operation of a sub-tray and prohibiting operation of a staple apparatus based on findings in which the sub-tray that temporarily supports sheets on the downstream side of the sheet discharge outlet is disposed to be able to proceed and retract above the stack tray, and is retracted to form handling space when a sheet jam or staple jam occurs.

It is an object of the invention concerning supplements E1 to E8 to provide a sheet post-processing apparatus in which a binding processing apparatus does not operate not to cause an accident in handling a jam of sheet or staple in an apparatus configuration for temporarily collecting sheets fed from a sheet discharge path above a stack tray to perform binding processing.

To attain the above-mentioned object, the invention concerning supplements E1 to E8 is characterized in that the sub-tray that collects sheets fed from the sheet discharge outlet is disposed between the sheet discharge outlet of the sheet discharge path and the paper mount surface of the stack tray, and is configured to be able to shift to positions between an actuation position above the paper mount surface and a retract position retracted therefrom by tray shift means, and that operation of the staple apparatus is prohibited with a signal from the position detection sensor of the sub-tray when the sub-tray is not positioned in the actuation position by the tray shift means or mutual operation.

Further, the configuration will be described specifically. The apparatus is provided with a sheet discharge path having a sheet discharge outlet, a stack tray disposed on the downstream side of the sheet discharge outlet to store a sheet fed from the sheet discharge path, a sub-tray disposed between the sheet discharge outlet and the stack tray to temporarily collect sheets, a staple apparatus that performs binding processing on the sheets collected on the sub-tray, tray shift means for causing the sub-tray to reciprocate between an actuation position above the stack tray and a waiting position outside the tray, and control means for controlling the staple apparatus and the tray shift means. The control means is characterized by switching whether or not to supply power to the staple apparatus with a detection signal from tray position detecting sensor means that detects whether or not the sub-tray is positioned in the actuation position.

The invention concerning supplements E1 to E8 configures the sub-tray that temporarily supports sheets between the sheet discharge outlet and the stack tray to be able to shift to positions between the actuation position inside the stack tray and the outside retract position manually or using the tray shift means, switches whether or not to supply power to the staple apparatus disposed on the sub-tray with a detection signal from the tray position detection sensor, and therefore, exhibits the following effects.

Since the sub-tray is configured to be able to move into and back from the inside of the tray between the sheet discharge outlet and the stack tray, when a jam or defect occurs on a sheet on the sub-tray or staple, the sub-tray is retracted manually or using the tray shift means, it is thereby possible to ensure handling space, and it is thus possible to prevent a foreign substance from entering without requiring to reserve operation space above the processing tray.

Further, the invention concerning supplements E1 to E8 is to turn drive power supply of the staple apparatus on/off by detecting open/close operation of the sub-tray loaded with sheets to undergo post-processing, and therefore, enables the safe post-processing apparatus with a simplified structure at low cost to be provided as compared with the conventional case of forming handling space above the processing tray and detecting entry of a foreign substance.

What is claimed is:

1. A sheet storage apparatus comprising:

a sheet discharge outlet discharging a sheet therethrough;

a stack tray having a paper mount surface disposed on a downstream side of the sheet discharge outlet to load the sheet thereon, the paper mount surface having a difference in height to support the sheet in an inclined posture in a sheet discharge direction or a sheet-discharge orthogonal direction; and a sub-tray device disposed between the sheet discharge outlet and the paper mount surface to temporarily hold the sheet discharged from the sheet discharge outlet, the sub-tray device including a first support member supporting one sheet end edge positioned in an inclined direction of the stack tray, and a second support member supporting another sheet end edge in an inclination orthogonal direction, a first shift device for moving the first support member to reciprocate between an actuation position to support the one sheet end edge above the paper mount surface and a retract position positioned out of support of the sheet, a second shift device for moving the second support member to reciprocate between an actuation position to support the another sheet end edge above the paper mount surface and a retract position positioned out of support of the sheet, a sheet discharge control device for controlling the first and second shift devices, wherein after the first and second support members temporarily support the sheet discharged from the sheet discharge outlet, when shifting the first and second support members from the actuation positions to the retract positions, the sheet discharge control device first shifts the second support member to the retract position, and then, shifts the first support member to the retract position.

2. The sheet storage apparatus according to claim 1, wherein the stack tray includes a sheet end regulation surface disposed in a sheet load direction to strike and regulate the one sheet end edge in a front in the inclined direction in which the paper mount surface is gradually lowered.

3. The sheet storage apparatus according to claim 1, wherein the paper mount surface is formed in an inclined shape inclined to be gradually higher from an upstream side to the downstream side in the sheet discharge direction, the first support member is disposed in a position to support a sheet rear end portion, the second support member is disposed in a position to support a sheet side edge portion, and after temporarily supporting the sheet carried out of the sheet discharge outlet on the first and second support members, the sheet discharge control device first shifts the second support member to the retract position, then shifts the first support member to the retract position, and thereby stores the sheet on the paper mount surface.

4. The sheet storage apparatus according to claim 3, further comprising:

an offset device for displacing the sheet supported on the first and second support members by a predetermined amount selectively in the sheet-discharge orthogonal direction.

5. The sheet storage apparatus according to, claim 1, wherein the paper mount surface is formed in an inclined shape inclined to be gradually higher from one side to the other side in the sheet-discharge orthogonal direction, the first support member is disposed in a position to support a sheet side edge portion, the second support member is disposed in a position to support a sheet rear end portion, and after temporarily supporting the sheet carried out of the sheet discharge outlet on the first and second support members, the sheet discharge control device first shifts the second support member to the retract position, then shifts the first support member to the retract position, and thereby stores the sheet on the paper mount surface.

6. The sheet storage apparatus according to claim 5, further comprising:

an offset device for displacing the sheet supported on the first and second support members by a predetermined amount selectively in the sheet discharge direction.

7. The sheet storage apparatus according to claim 1, further comprising:

a paper press member that presses a sheet top surface of the sheet mounted on the first support member and the second support member; and a shift device for shifting the paper press member between an actuation position to press the sheet top surface and a retract position separated from the sheet top surface, wherein the sheet discharge control device first shifts the second support member from the actuation position to the retract position with the sheet pressed by the paper press member.

8. The sheet storage apparatus according to claim 7, wherein the first and second support members is provided with a friction transport member that shifts the sheet mounted on the first and second support members to a predetermined reference position, and the paper press member is comprised of the friction transport member.

9. The sheet storage apparatus according to claim 7, wherein the paper press member presses the sheet top surface of the sheet on the second support member.

10. The sheet storage apparatus according to claim 1, wherein the sheet discharge control device is provided with a binding processing mode for collating, collecting and performing binding processing on sheets fed from the sheet discharge outlet on the sub-tray device and then carrying out to the stack tray, and a jog sheet discharge mode for performing offset collection on sheets fed from the sheet discharge outlet on the stack tray.

11. An image formation system comprising:

an image formation apparatus that forms an image on a sheet sequentially; and the sheet storage apparatus according to claim 1, provided with the stack tray to store the sheet fed from the image formation apparatus.

12. The sheet storage apparatus according to claim 1, further comprising an aligning transport device for aligning the sheet mounted on the first and second support members, disposed at a corner portion between the first and second support members, wherein the first and second support members include stoppers supporting the sheet end edges, respectively, and the aligning transport device transports the sheet toward the stoppers.

13. The sheet storage apparatus according to claim 1, wherein the first support member is arranged to support a sheet rear end portion, and the second support member is arranged to support a sheet side edge portion;

the first support member has a rear end contact surface formed thereon and a sheet engagement surface formed at one end portion thereof, and the stack tray includes a rear end regulation surface formed at a rear end thereof, the rear end contact surface being located above the rear end regulation surface;

when the first support member moves from the retract position to the actuation position, the sheet engagement surface engages a lower surface of the sheet such that a sheet front end portion contacts the paper mount surface, and then, the first support member further moves outwardly in a direction away from the sheet discharge outlet to discharge the sheet from the sheet discharge outlet and to mount the sheet on the first support member such that the sheet rear end portion contacts the rear end contact surface; and when the first support member moves from the actuation position to the retract position, the rear end contact surface guides the sheet rear end portion to the rear end regulation surface.

* * * * *